US008356560B2

(12) United States Patent
Forbes et al.

(10) Patent No.: US 8,356,560 B2
(45) Date of Patent: Jan. 22, 2013

(54) RAILROAD CAR AND DOOR MECHANISM THEREFOR

(75) Inventors: James W. Forbes, Campbellville (CA); Tomasz Bis, Ancaster (CA)

(73) Assignee: National Steel Car Limited, Hamilton, Ontario (CA)

( * ) Notice: Subject to any disclaimer, the term of this patent is extended or adjusted under 35 U.S.C. 154(b) by 234 days.

(21) Appl. No.: 12/694,896

(22) Filed: Jan. 27, 2010

(65) Prior Publication Data

US 2010/0251923 A1 Oct. 7, 2010

Related U.S. Application Data

(60) Provisional application No. 61/147,735, filed on Jan. 27, 2009.

(51) Int. Cl.
*B61D 7/02* (2006.01)

(52) U.S. Cl. ..... 105/284; 105/253; 105/247; 105/290; 105/293

(58) Field of Classification Search ..... 105/247, 105/248, 253, 280, 283, 284, 286, 288, 289, 105/290, 293, 296, 299
See application file for complete search history.

(56) References Cited

U.S. PATENT DOCUMENTS

| | | | | |
|---|---|---|---|---|
| 1,421,439 | A | 7/1922 | Finckh | |
| 3,511,188 | A * | 5/1970 | Danielson | 105/280 |
| 3,717,109 | A | 2/1973 | Miller | |
| 3,800,711 | A | 4/1974 | Tuttle | |
| 3,863,986 | A | 2/1975 | Mentessi | |
| 3,878,794 | A | 4/1975 | Adler | |
| 3,931,768 | A | 1/1976 | Price et al. | |
| 3,994,238 | A | 11/1976 | Adler | |
| 4,106,813 | A | 8/1978 | Goodbary | |
| 4,120,409 | A | 10/1978 | vander Werff | |
| 4,232,989 | A | 11/1980 | Miller | |
| 4,250,814 | A | 2/1981 | Stark et al. | |
| 4,740,130 | A | 4/1988 | Prins | |
| 4,766,820 | A * | 8/1988 | Ritter et al. | 105/240 |

(Continued)

FOREIGN PATENT DOCUMENTS

CA 1082524 A1 7/2009

(Continued)

*Primary Examiner* — Mark Le
(74) *Attorney, Agent, or Firm* — Hahn Loeser & Parks, LLP

(57) ABSTRACT

A hopper car discharge outflow is controlled by closure members, at least one of which is movable. The doors are hingeless, being mounted on four bar linkages, such that the distal edge of the doors sweeps predominantly horizontally while the proximal edge of the door moves predominantly upwardly. The doors move through noncircular arcs, such that the size of the vertically projected door opening is abnormally large compared to the clearance heights of the door. The doors are driven by a longitudinal shaft that is mounted within the center sill. It drives a set of single input, double output bell cranks that drive adjacent pairs of doors, and that employs an over-center toggle to hold the doors in the closed position when the car is laded. The actuators may be mounted in shelters midway along the car, and may be offset from the centersill. The actuators may be mounted predominantly vertically such that gravity may obviate the need for a secondary lock. The doors of a transverse car need not all be of the same size. The over center may include a manual release having a fulcrum with a progressive decrease in mechanical advantage.

30 Claims, 53 Drawing Sheets

U.S. PATENT DOCUMENTS

| | | | | |
|---|---|---|---|---|
| 5,144,895 | A | 9/1992 | Murray | |
| 5,163,372 | A | 11/1992 | Galvan et al. | |
| 5,261,333 | A | 11/1993 | Miller | |
| 5,823,118 | A | 10/1998 | Manstrom | |
| 6,213,028 | B1 * | 4/2001 | Fetterman et al. | 105/247 |
| 7,523,708 | B2 * | 4/2009 | Taylor | 105/290 |

FOREIGN PATENT DOCUMENTS

| | | | |
|---|---|---|---|
| CN | 101486347 | | 7/2009 |
| EP | 0543279 | B1 | 5/1995 |
| EP | 1798103 | A2 | 6/2007 |
| GB | 1318571 | | 5/1973 |
| GB | 2013598 | | 8/1979 |

* cited by examiner

Doors Closed

Doors 20% open

Doors 40% Open

Doors 60% Open

Doors 80% Open

Doors 100% Open

Doors Closed

Doors 20% Open

Doors 40% Open

Doors 60% Open

Doors 80% Open

Doors Fully Open

*(Door Closed)*

(Door 25% Open)

(Door 50% Open)

(Fully Open)

RAILROAD CAR AND DOOR MECHANISM THEREFOR

This Application claims the benefit under 35 USC 111(b) and 35 USC 120 of U.S. Provisional Patent Application 61/147,735 of the same title filed Jan. 27, 2009, the specification thereof being incorporated by reference herein.

FIELD OF THE INVENTION

This invention relates to the field of railroad freight cars, and, in particular to rail road freight cars such as may employ bottom unloading gates or doors.

BACKGROUND

There are many kinds of rail road cars for carrying particulate material, be it sand or gravel aggregate, plastic pellets, grains, ores, potash, coal or other granular materials. Many of those cars have an upper opening, or accessway of some kind, by which the particulate is loaded, and a lower opening, or accessway, or gate, or door by which the particulate material exits the car under the influence of gravity. While the inlet opening need not necessarily have a movable gate, the outlet opening requires a governor of some kind that is movable between a closed position for retaining the lading while the lading is being transported, and an open position for releasing the lading at the destination. The terminology "flow through" or "flow through rail road car" or "center flow" car, or the like, may sometimes be used for cars of this nature where lading is introduced at the top, and flows out at the bottom.

Discharge doors for coal gondola cars or other bottom dumping cars may tend to have certain desirable properties. First, to the extent possible it is usually desirable for the door opening to be large so that unloading may tend to be relatively fast, and for the sides of any unloading chute to be relatively steep so that the particulate will tend not to hang up on the slope. Further, to the extent that the door can be large and the slope sheets steep, the interior of the car may tend to have a greater lading volume for a given car length. Further still, any increase in lading achieved will tend to be at a relatively low height relative to Top of Rail (TOR) and so may tend to aid in maintaining a low center of gravity. A low center of gravity tends to yield a better riding car that is less prone to derailment, and perhaps less prone to cause as much wear or damage to tracks.

SUMMARY OF THE INVENTION

In an aspect of the invention there is a railroad car having a body for carrying lading in the form of particulate matter. The body has at least one discharge through which the lading may be disgorged under the influence of gravity. The discharge is governed by a door mechanism. The door mechanism includes a door panel movable from a first position to a second position. The first position defines a closed position of the discharge in which the door panel obstructs exit of the lading. The second position defines an open position of the discharge. The door panel is movably connected to the car body by at least a first linkage member and a second linkage member. The car body, the linkage members and the door panel defining a four bar linkage.

In a feature of that aspect of the invention, the car is an hopper car. The car body is carried upon railroad car trucks for motion along railroad tracks in a longitudinal direction. The door panel extends cross-wise relative to the car body, and the door mechanism is a transverse door. In another feature, the car includes a longitudinally acting drive mechanism connected to move the door panel between the open position and the closed position. In a further feature, the drive mechanism includes members acting in both longitudinally forward and longitudinally rearward directions. In another feature the drive mechanism includes a bell crank having a range of travel of greater than 90 degrees as the door mechanism moves between the open position and the closed position. In still another feature, the bell crank drives first and second door members in opposite directions. In yet another feature the drive mechanism includes a longitudinally acting drive shaft. In still another feature the drive shaft is connected to the bell crank by a drag link. In an additional feature, the first linkage member is shorter than the second linkage member. In a still further additional feature, the door panel has a proximal portion and a distal portion, and any one of:

(a) the door panel moves through a non-circular arc during motion from the first position to the second position;

(b) the first linkage is connected to the door panel at a connection closer to the proximal portion than to the distal portion, the second linkage is connected to the door panel closer to the distal portion than is the first linkage, and the first and second linkages travel through arcs of travel of different angular magnitudes when the door panel moves between the first position and the second position;

(c) the first linkage is connected to the door panel at a connection closer to the proximal portion than to the distal portion, the second linkage is connected to the door panel closer to the distal portion than is the first linkage, the first linkage is connected to the body of the railcar at a first pivotal connection, and the proximal portion of the door panel moves from a position lower than the first pivotal connection to a position higher than the first pivotal connection during motion of the door panel from the closed position to the open position;

(d) the first linkage is connected to the door panel at a connection closer to the proximal portion than to the distal portion, the second linkage is connected to the door panel closer to the distal portion than is the first linkage, and the proximal portion of the door panel has an overall dz/dx when the door panel moves between the first position and the second position that is greater than one;

(e) the first linkage is connected to the door panel at a connection closer to the proximal portion than to the distal portion, the second linkage is connected to the door panel closer to the distal portion than is the first linkage, and the distal portion of the door panel has an overall dz/dx when the door panel moves between the first position and the second position that is less than one;

(f) the first linkage is connected to the door panel at a connection closer to the proximal portion than to the distal portion, the second linkage is connected to the door panel closer to the distal portion than is the first linkage, and the proximal portion of the door panel has an overall $(dz/dx)_1$ when the door panel moves between the first position and the second position that is greater than one; the distal portion of the door panel has an overall $(dz/dx)_2$ when the door panel moves between the first position and the second position; and $(dz/dx)_1$ is greater than $(dz/dx)_2$.

In still another feature, the first link is mounted to the railcar body at a first pivot fulcrum located a first distance above Top of Rail; the first door panel has a width and a length, the width being oriented cross-wise relative to the car body generally, and the length being greater than the first distance.

In another aspect of the invention there is a railroad hopper car having a plurality of outlet gates by which to discharge lading. The gates are transversely oriented. At least one of the gates is a double door gate having a pair of co-operating movable closure door panel members. At least one of the gates is a single door gate having a single movable closure door panel member. In a feature of that aspect of the invention there is the single door has a length and a width. The width is oriented cross-wise relative to the car. The double door has left and right hand door members. The left hand door member has a length and a width. The width is oriented cross-wise relative to the railroad car. The length of the single door is longer than the length of the left hand door member.

In a further aspect of the invention there is a railroad car hopper car having at a lading containment car body. The hopper car has at least a pair of first and second hopper discharges and respective first and second transverse doors operable to facilitate egress of lading from the hopper discharges. The hopper discharges have a discharge flow dividing member located therebetween, the discharge flow dividing member having first and second flanks extending downwardly therefrom toward the first and second discharges respectively, a sheltered accommodation being defined between the flanks. Each of the doors is movable from a closed position obstructing egress of lading from the respective hopper discharges to a second position less obstructive of discharge of lading from the respective hopper discharges. Each of the transverse doors has a proximal region and a distal region. The proximal region is closer to the flow dividing member than is the distal region when the doors are in their respective closed positions. Each of the proximal regions is connected to first and second linkages to the car body. The first and second linkages have pivoting connections at either end thereof. In operation, the proximal regions of the first and second doors move upwardly and inwardly into the accommodation defined between the flanks of the flow dividing member.

In another feature of that aspect of the invention, the flow dividing member is a cross-bearer. In a further feature, the railroad car includes a longitudinally extending straight-through center sill, and each the second linkage has one end pivotally mounted to its respective door, and a second end pivotally mounted within the center sill.

In still yet another aspect of the invention there is a railroad car having a body for carrying lading in the form of particulate matter. The body has at least one discharge through which the lading may be disgorged under the influence of gravity. The discharge is governed by a door mechanism. The door mechanism includes a door panel movable from a first position to a second position, the first position defining a closed position of the discharge in which the door panel obstructs exit of the lading, the second position defining an open position of the discharge. The door panel is movably connected to the car body by at least a first linkage member and a second linkage member, the car body, the linkage members and the door panel defining a four bar linkage.

In still yet another aspect, there is a railroad hopper car having a bottom discharge. Egress of lading through the hopper discharge is governed by a door assembly. The door assembly is movable between a closed position for obstructing discharge of lading from the hopper, and at least one open position for permitting discharge of lading from the hopper. The door assembly is an hingeless door assembly. The door assembly includes a door panel. The door panel is mounted to move on a non-circular path during motion between the closed position and the at least one open position.

In a feature of that aspect of the invention, the door panel has a translational component of motion and a rotational component of motion in moving between the closed position and the at least one open position. In another feature, the discharge has a length when vertically projected, the discharge has a peripheral edge for engagement by the door assembly, the peripheral edge has a clearance distance from TOR when the car is on level tangent track, and the length is greater than three times the clearance distance. In still another feature, the closed position of the door assembly the door panel is in a predominantly horizontal orientation, and in the at least one open position the door assembly is in a less predominantly horizontal orientation. In a further feature, the door assembly has a fully open position, and in the fully open position the door panel is predominantly vertically oriented.

In another feature, the railroad car has a first hopper, a second hopper, and an accommodation defined therebetween whence lading is excluded. Each of the hoppers has one of the door assemblies. Each door panel of each door assembly is movable to a most fully open position, and, in the respective most fully open position both of the door panels are at least predominantly sheltered from lading by the accommodation. In a further feature, the car has at least one actuator mounted to drive the door assemblies, and the at least one actuator is also sheltered from lading by the accommodation.

In another aspect of the invention, there is a railroad hopper car having a car body mounted on railroad car trucks for longitudinal motion along railroad tracks. The car has at least one hopper and transversely oriented doors mounted to control egress of lading from that at least one hopper. Similarly, there is at least one actuator mounted to drive the transversely oriented doors. The hopper car has a longitudinally centerline. The actuator is mounted in a position intermediate the trucks and offset transversely from the longitudinal centerline.

In another feature, the car includes both a first hopper and a second hopper. A first actuator is mounted to operate the first door assembly of the first hopper. A second actuator is mounted to operate a second door assembly of a second the hopper. The first actuator is mounted to one side of the longitudinal centerline, the second actuator is mounted to the other side of the longitudinal centerline. In still another feature, the at least one actuator includes a reciprocating piston, and the piston is mounted such that it has a predominant component of motion in the vertical direction. In another feature, the car has a drive train connecting the at least one actuator to the transversely oriented doors. The drive train includes a linkage movable to an over-center position in which to lock the doors closed. The car has a manual over-center release member located adjacent to the linkage. The manual over center release member provides a fulcrum for a lever member to act against the over center condition. The fulcrum has a radiused surface such that motion of the lever working against the radiused surface increases the length of the lever arm from the over-center to the fulcrum as the lever disengages the over-center condition.

In still another aspect of the invention there is a railroad hopper car having doors movable between an open condition and a closed condition. The hopper car having a door position indicator. The door position indicator including a member mounted to show that the doors are closed and locked.

In a feature of that aspect of the invention, the railroad hopper car has a mechanical transmission connected to drive the doors, and a mechanical motion amplifier connected between the mechanical transmission and the member mounted to show that the doors are closed and locked. In another feature, the mechanical transmission is movable to an over center condition, and the mechanical motion amplifier is connected to activate the member mounted to show that the doors are closed and locked when the mechanical transmission is in the closed and locked position.

These and other aspects and features of the invention may be understood with reference to the description which follows, and with the aid of the illustrations of a number of examples.

BRIEF DESCRIPTION OF THE FIGURES

The description is accompanied by a set of illustrative Figures in which.

DETAILED DESCRIPTION

Figure 1A:
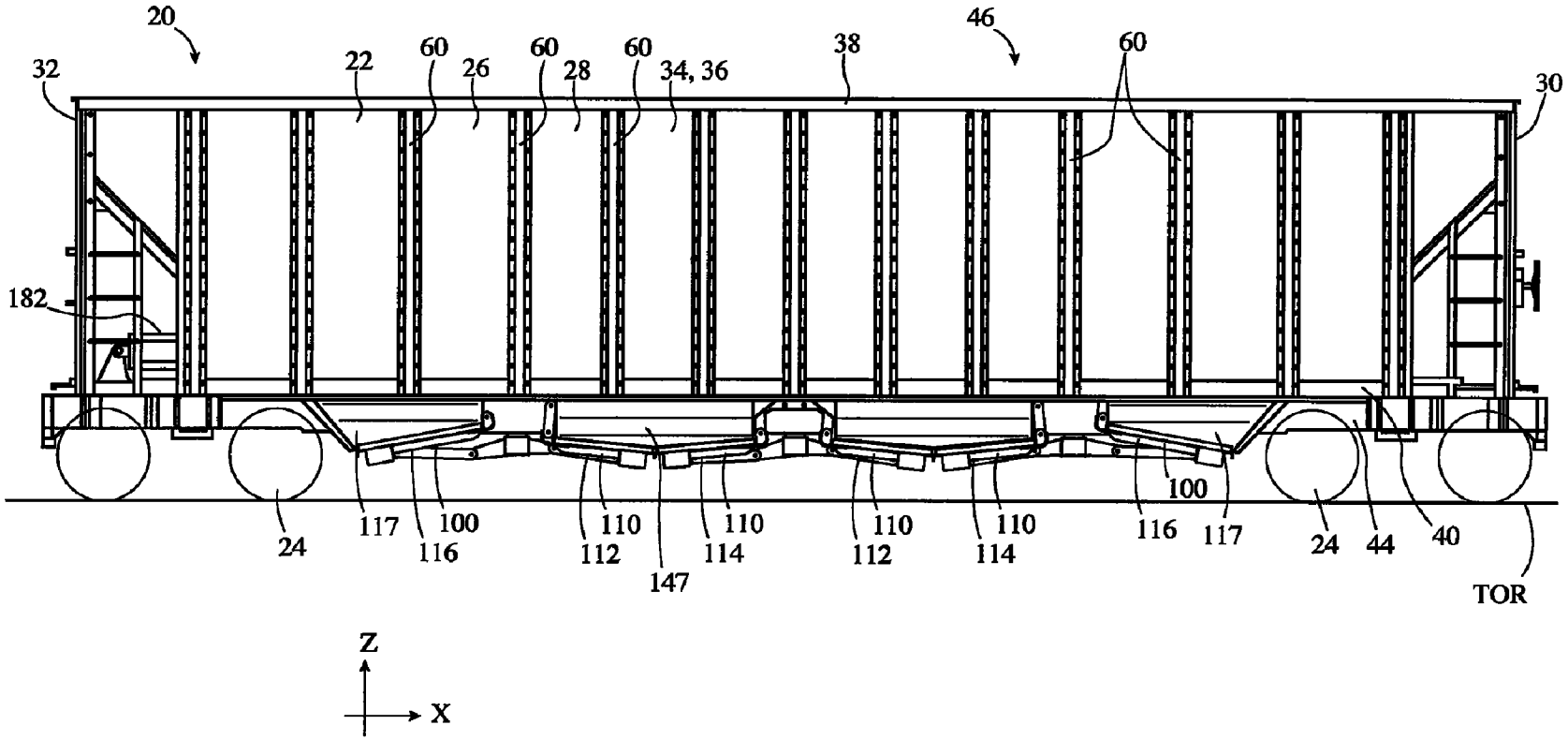
FIG. 1*a* is a general arrangement, side view of a railroad freight car.
Figure 1B:
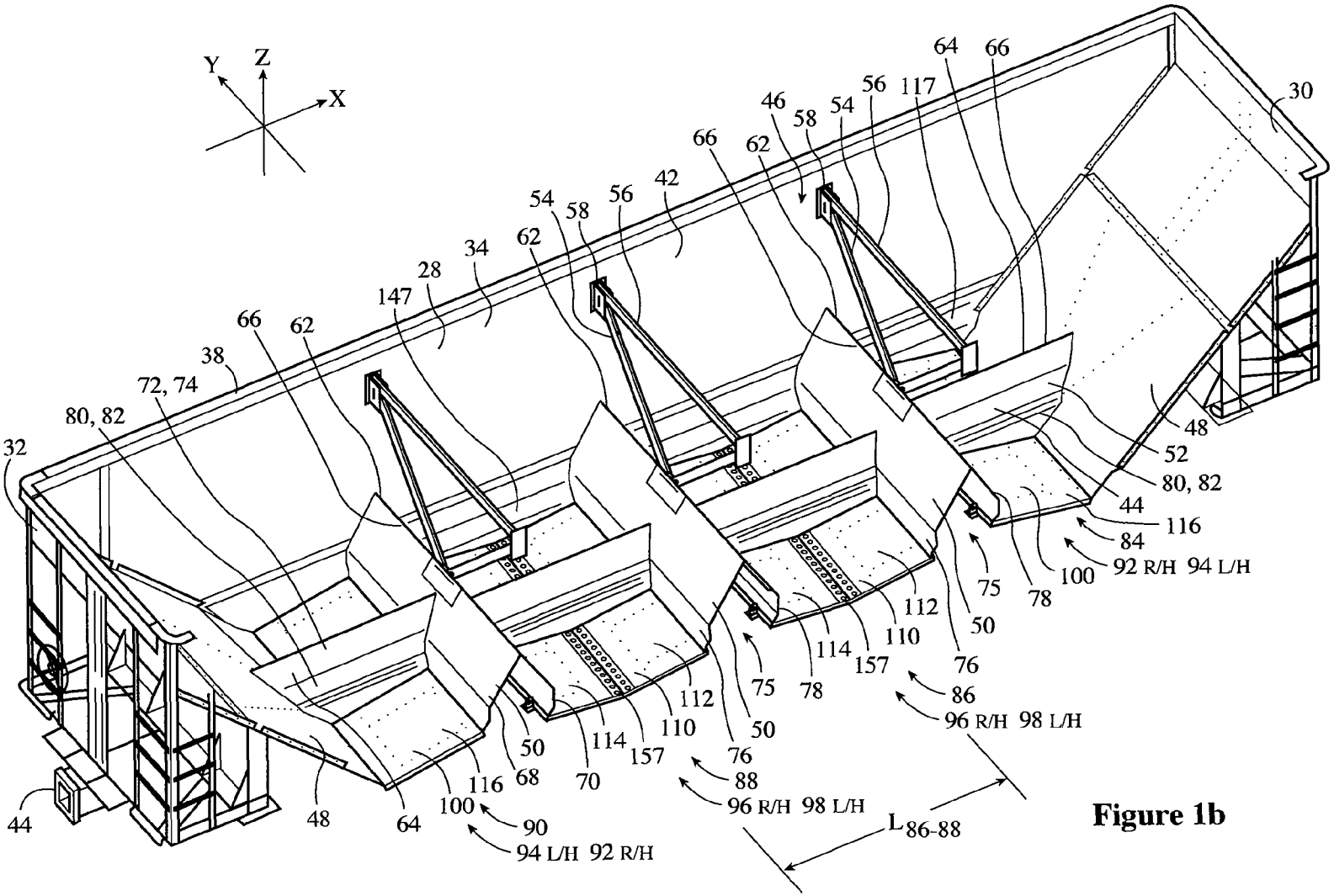
FIG. 1*b* is an isometric view of the railroad freight car of FIG. 1*a* with the near side wall removed to show the interior of the car with its discharge doors in a closed position.

The description that follows, and the embodiments described therein, are provided by way of illustration of an example, or examples, of particular embodiments of the principles, aspects or features of the present invention. These examples are provided for the purposes of explanation, and not of limitation, of those principles and of the invention. In the description, like parts are marked throughout the specification and the drawings with the same respective reference numerals. The drawings are generally to scale, and may be taken as being to scale unless otherwise noted. Unless noted otherwise, the structural members of the car may be taken as being fabricated from steel, most typically mild steel of 50 kpsi yield strength. The structure may be of welded construction, most typically, but may alternatively include mechanical fasteners such as Huck (t.m.) bolts, rivets, and so on. The structure need not be entirely, or even partially, mild steel, but could include other grades of steel in particular locations, such as the discharge sections, may include consumable wear plates, or plates of greater hardness and wear resistance. In some instances, some or all portions of the primary structure may be made of stainless steel, aluminum, or engineered plastics and composites. Nonetheless, most commonly welded mild steel construction may be assumed as the default condition.

The terminology used in this specification is thought to be consistent with the customary and ordinary meanings of those terms as they would be understood by a person of ordinary skill in the rail road industry in North America. Following from decision of the CAFC in *Phillips v. AWH Corp.*, the Applicant expressly excludes all interpretations that are inconsistent with this specification, and, in particular, expressly excludes any interpretation of the claims or the language used in this specification such as may be made in the USPTO, or in any other Patent Office, other than those interpretations for which express support can be demonstrated in this specification or in objective evidence of record in accordance with *In re Lee*, (for example, in earlier publications by persons not employed by the USPTO or any other Patent Office), demonstrating how the terms are used and understood by persons of ordinary skill in the art, or by way of expert evidence of a person or persons of at least 10 years experience in the rail road industry in North America or in other territories of the former British Empire and Commonwealth.

In terms of general orientation and directional nomenclature, for rail road cars described herein the longitudinal direction is defined as being coincident with the rolling direction of the rail road car, or rail road car unit, when located on tangent (that is, straight) track. In the case of a rail road car having a center sill, the longitudinal direction is parallel to the center sill, and parallel to the top chords. Unless otherwise noted, vertical, or upward and downward, are terms that use top of rail, TOR, as a datum. In the context of the car as a whole, the term lateral, or laterally outboard, or transverse, or transversely outboard refer to a distance or orientation relative to the longitudinal centerline of the railroad car, or car unit, or of the centerline of a centerplate at a truck center. The term "longitudinally inboard", or "longitudinally outboard" is a distance taken relative to a mid-span lateral section of the car, or car unit. Pitching motion is angular motion of a railcar unit about a horizontal axis perpendicular to the longitudinal direction. Yawing is angular motion about a vertical axis. Roll is angular motion about the longitudinal axis. Given that the rail road car described herein may tend to have both longitudinal and transverse axes of symmetry, except as otherwise noted a description of one half of the car may generally also be intended to describe the other half as well, allowing for differences between right hand and left hand parts. Similarly, where male and female parts engage, such as a ball and socket connection, a pin and bushing, a pin and slot, and so on, the male and female engaging part relationship may be interchangeable or reversible, the choice being somewhat arbitrary. Therefore unless otherwise noted, or unless the context requires otherwise, interchangeability or reversibility of mating male and female parts may be assumed as a default without requiring further description of the reverse arrangement. In this description, the abbreviation kspi stands for thousand of pounds per square inch. To the extent that this specification or the accompanying illustrations may refer to standards of the Association of American Railroads (AAR), such as to AAR plate sizes, those references are to be understood as at the earliest date of priority to which this application is entitled.

Bottom dumping gondola cars, of which coal cars may be one example, may tend to have either longitudinal doors or transverse doors. Longitudinal doors are oriented such that the doors operate on hinges or axes of rotation that are parallel to the direction of travel of the railroad car generally. An example of a car with longitudinal doors is U.S. Pat. No. 3,633,515 of Shaver, issued Jan. 11, 1972. By contrast, transverse doors are cars in which the axes of rotation of the hinges or other pivots tend to be predominantly cross-wise to the direction of travel, most often precisely perpendicular to it. An example of a car having transverse doors is shown in US Publication 2008-0066642 of Forbes, published Mar. 20, 2008.

A four bar linkage is one in which there is a reference, or base, member; a first moving link pivotally connected to the base member; a second link pivotally connected to the base member; and a third link pivotally connected to the distal ends of the first and second links. a drive input to any one of the first, second, or third links relative to the fixed base will then cause motion of all of the links relative to the reference member. In the discussion that follows, the base link is taken to be the underframe or body structure of the railcar generally, that frame of reference being taken as stationary during opening or closing of the various doors. In the examples given below the actual door panel that blocks the outlet opening of the car is the third link, namely the link that is pivotally connected to the ends of the first and second linkages, or pivot arms, rather than being connected to the frame of reference. Most typically some kind of driving mechanism is connected between the first bar, i.e., the rigid structure of the rail road car defining the datum or frame of reference, and one of the moving bars, be it the first or second pivot arms that define the second and fourth bars of the linkage, or the output member, or third bar, of the four bar linkage. Whatever bar of the linkage is driven, the remaining moving members are then slave linkages whose position is dictated uniquely by the input motion and displacement of the driven member relative to the datum. Most often the driven member is one of the pivot arms.

Four bar linkages are often analyzed as if the linkage lies in a plane. Indeed, to the extent that out of plane forces are either non-existent or symmetrical and opposite, the forces and motions in question can be considered to be wholly or predominantly in a particular plane. In the case of the examples herein, where the doors are "transverse doors" as defined above, the action of the forces, and the displacements, whether translational or rotational, may tend to be considered as occurring in a longitudinal-vertical plane. In the examples of FIGS. 1*a* to 6*f*, the drive force is carried from a pneumatic piston mounted on the longitudinal centerline of the car through a drive shaft that is mounted to translate longitudinally within the center sill. The drive shaft transmits both motion and power through drag links to bell cranks whose fulcra are rigidly mounted to the center sill. The output arms of the bell cranks drive connecting rods, or links, really, which impart motion and drive power to the door panels near the distal edges of those panels through their mounts on the distal edge backing bean or reinforcement members adjacent the door edges. All of this occurs at or near the longitudinal centerline, or central vertical-longitudinal plane of the car.

The linkages, by contrast, are spaced laterally away from the centerline of the car, although they nonetheless rotate about their base pivot mounts in parallel x-z planes, the axes of the pivots extending in the y-direction.

FIG. 1*a* shows an isometric view of an example of a rail road freight car 20 that is intended to be representative of a wide range of rail road cars in which the present invention may be incorporated. While car 20 may be suitable for a variety of general purpose uses, it may be taken as being symbolic of, and in some ways a generic example of, a flow through car, in which lading is introduced by gravity flow from above, and removed by gravity discharge through gated or valved outlets below. Flow through, or center flow cars may include open topped hopper cars, grain cars, plastic pellet cars, potash cars, ore cars, coal gondolas, and so on. In one embodiment car 20 may be a hopper car such as may be used for the carriage of bulk commodities in the form of a granular particulate, be it in the nature of relatively coarse gravel or fine aggregate in the nature of fine gravel or sand or various ores or concentrate or coal. Car 20 may be symmetrical about both its longitudinal and transverse, or lateral, centerline axes. Consequently, it will be understood that the car has first and second, left and right hand side beams, bolsters and so on.

By way of a general overview, car 20 may have a car body 22 that is carried on trucks 24 for rolling operation along railroad tracks. Car 20 may be a single unit car, or it may be a multi-unit car having two or more car body units, where the multiple car body units may be connected at an articulated connector, or by draw bars. To the extent that car 20 may carry relatively dense materials, draw bar connections in a unit train might be employed. Car body 22, and the various structural members and fittings described herein may be understood to be typically of metal construction, whether welded or Huck (t.m.) bolted, or riveted together, the metal members being most typically steel, stainless steel, or aluminum, as may be appropriate. Some car builders have also used reinforced plastic composites for car elements, and those materials could also be employed where suitable. Car body 22 may have a lading containment vessel or shell 26 such as may include an upstanding wall structure 28 which may have a pair of opposed first and second end walls 30, 32, that extend crosswise, and a pair of first and second side walls 34, 36 that extend lengthwise, the end walls 30, 32 and side walls 34, 36 co-operating to define a generally rectangular form of peripheral wall structure 28. Wall structure 28 may include top chords 38 running along the top of the walls, and side sills 40 running fore-and-aft along lower portions the side sheets 42 of side walls 34, 36. In some instances car 20 may have stub center sills at either end, in which case side walls 34, 36 may act as deep beams, and may carry vertical loads to main bolsters that extend laterally from the centerplates. Alternatively, or in addition to deep side beams, car 20 may include a center sill 44, which may be a straight-through center sill, running from one end of the car body to the other. In the case of a single, stand alone car unit, draft gear and releasable couplers may be mounted at either end of the center sill. In a center flow, or flow through car, the upper portion of the car may typically include means by which to admit lading under a gravity drop system. Such an intake 46, or entryway may be a large rectangular opening such as bounded by top chords 38, or the car may have one or more hatches, whether covered or uncovered.

Figure 1C:
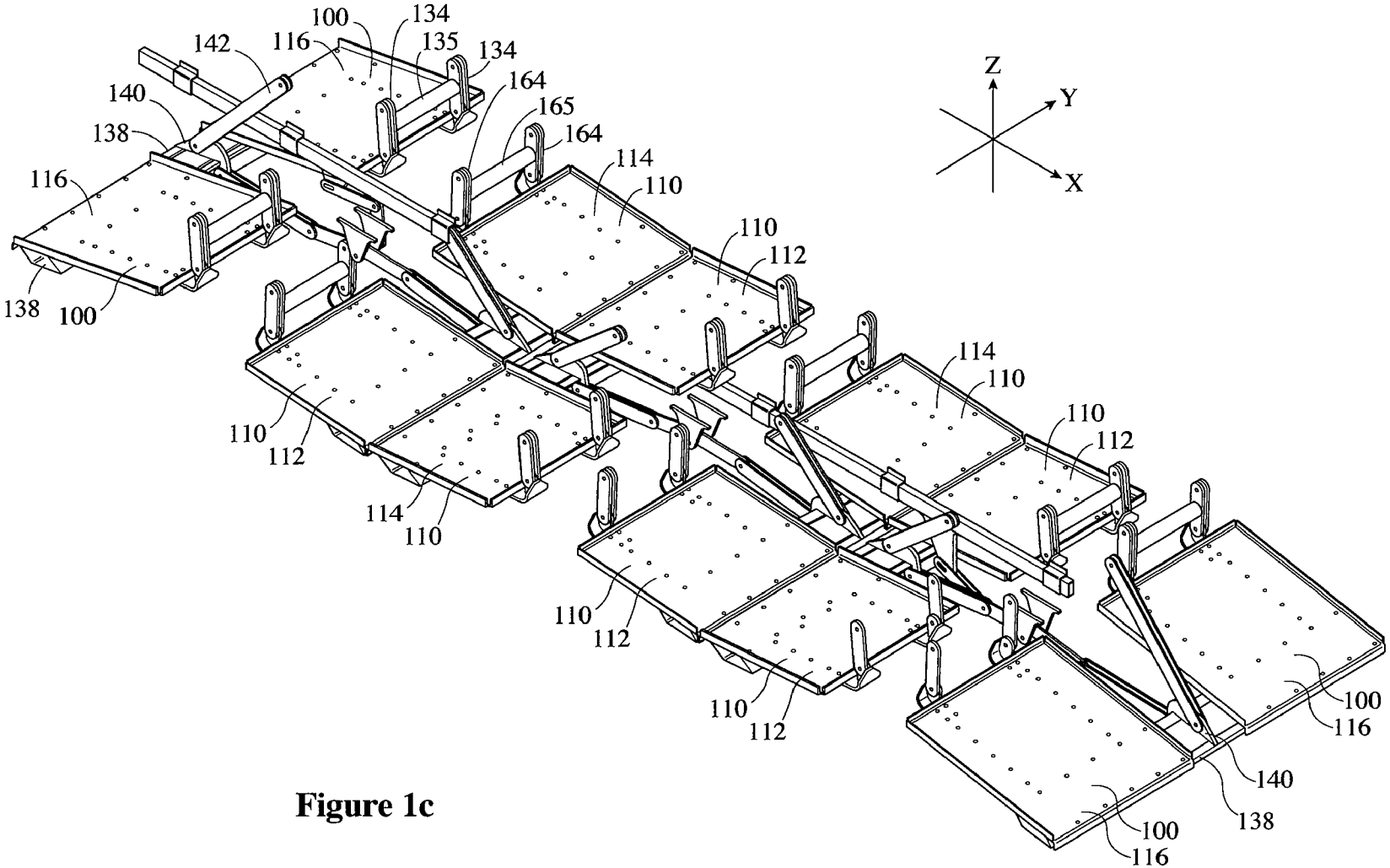
FIG. 1*c* is an isometric view of the door opening mechanism of the railroad freight car of FIG. 1*a*; with the discharge doors in a closed position.
Figure 1D:
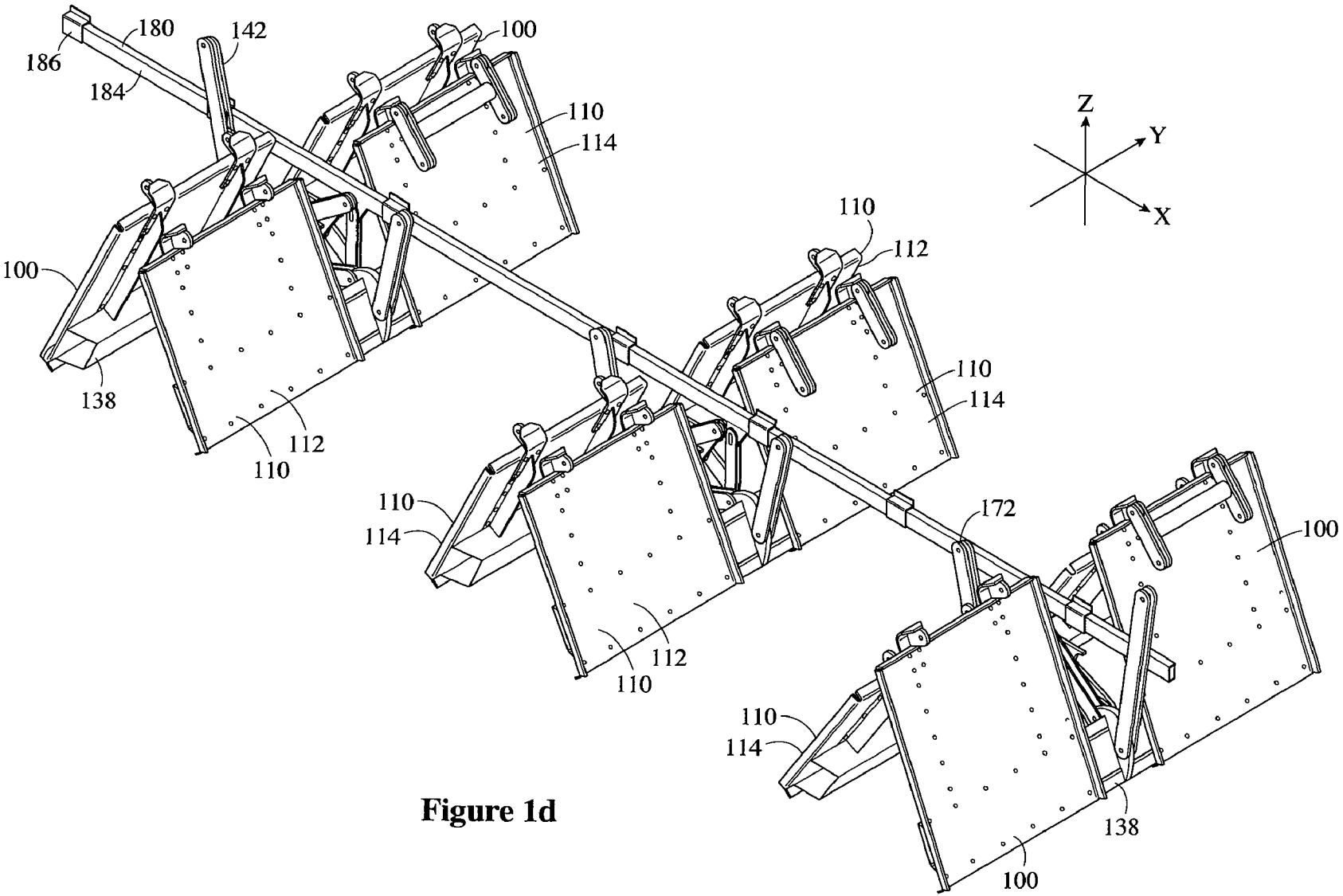
FIG. 1*d* is an isometric view of the door opening mechanism of the railroad freight car of FIG. 1*a* with the discharge doors in an open position.
Figure 2A:
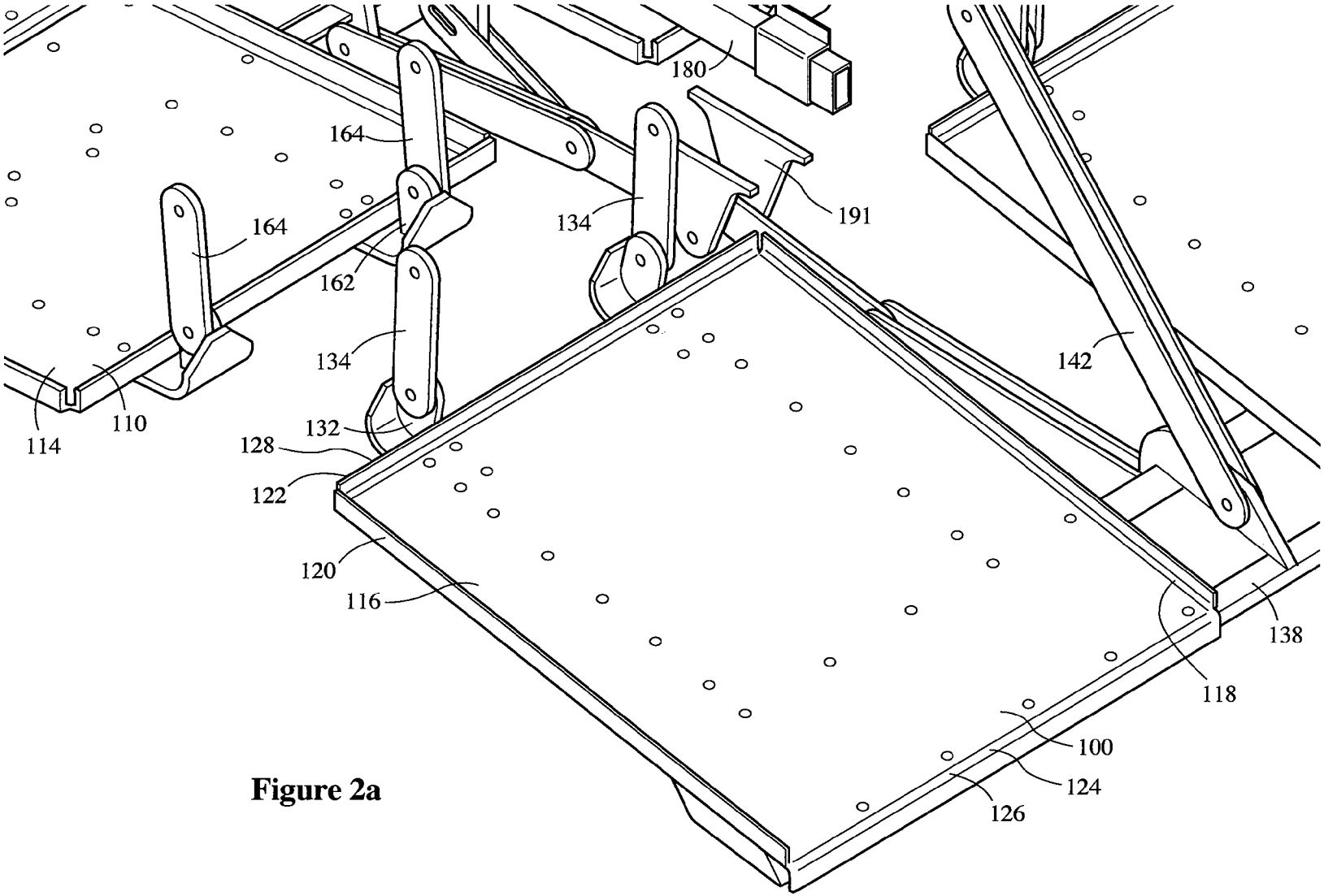
FIGS. 2*a* to 2*f* are enlarged details of FIG. 1*c;*
Figure 2B:
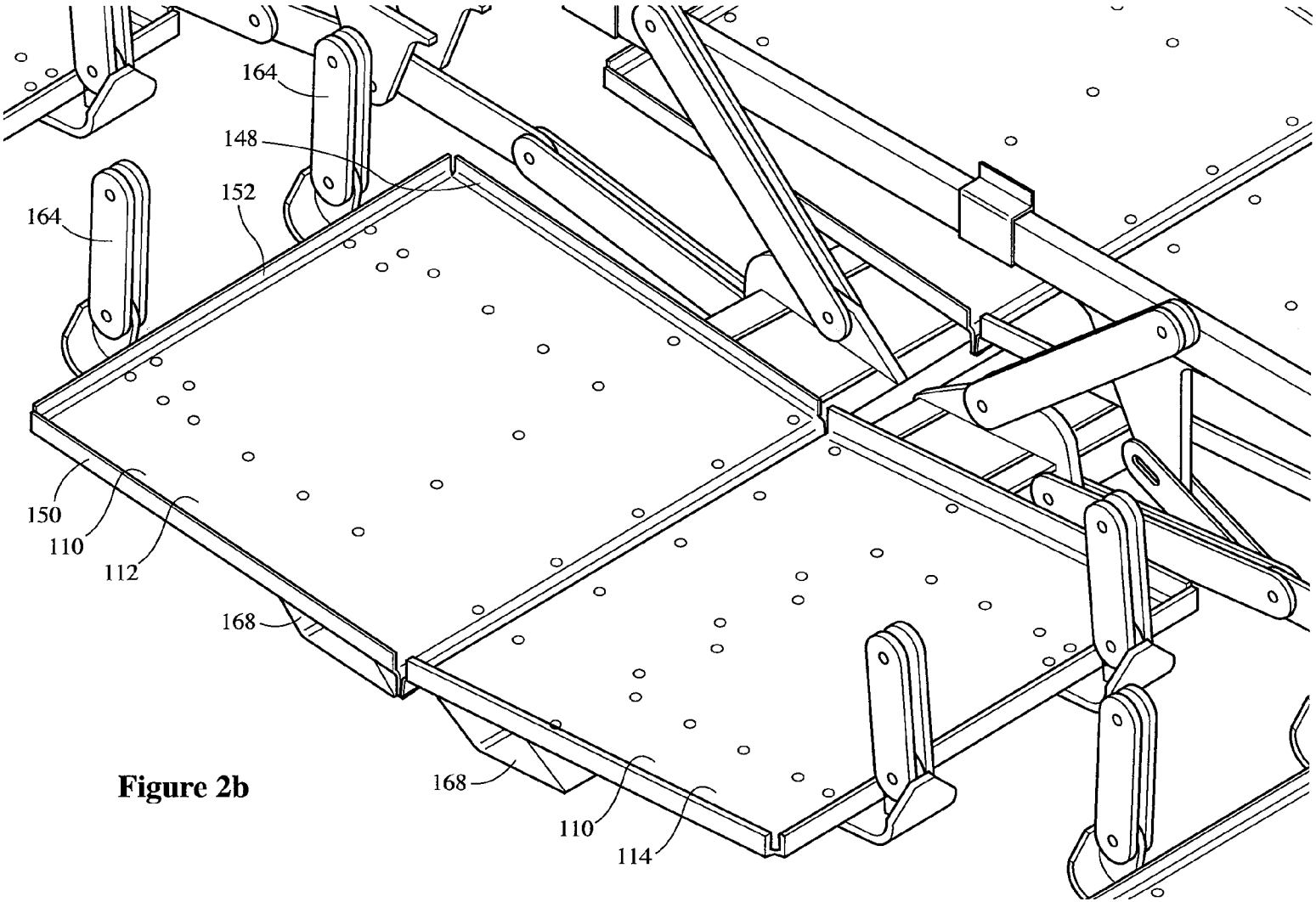
Figure 2C:
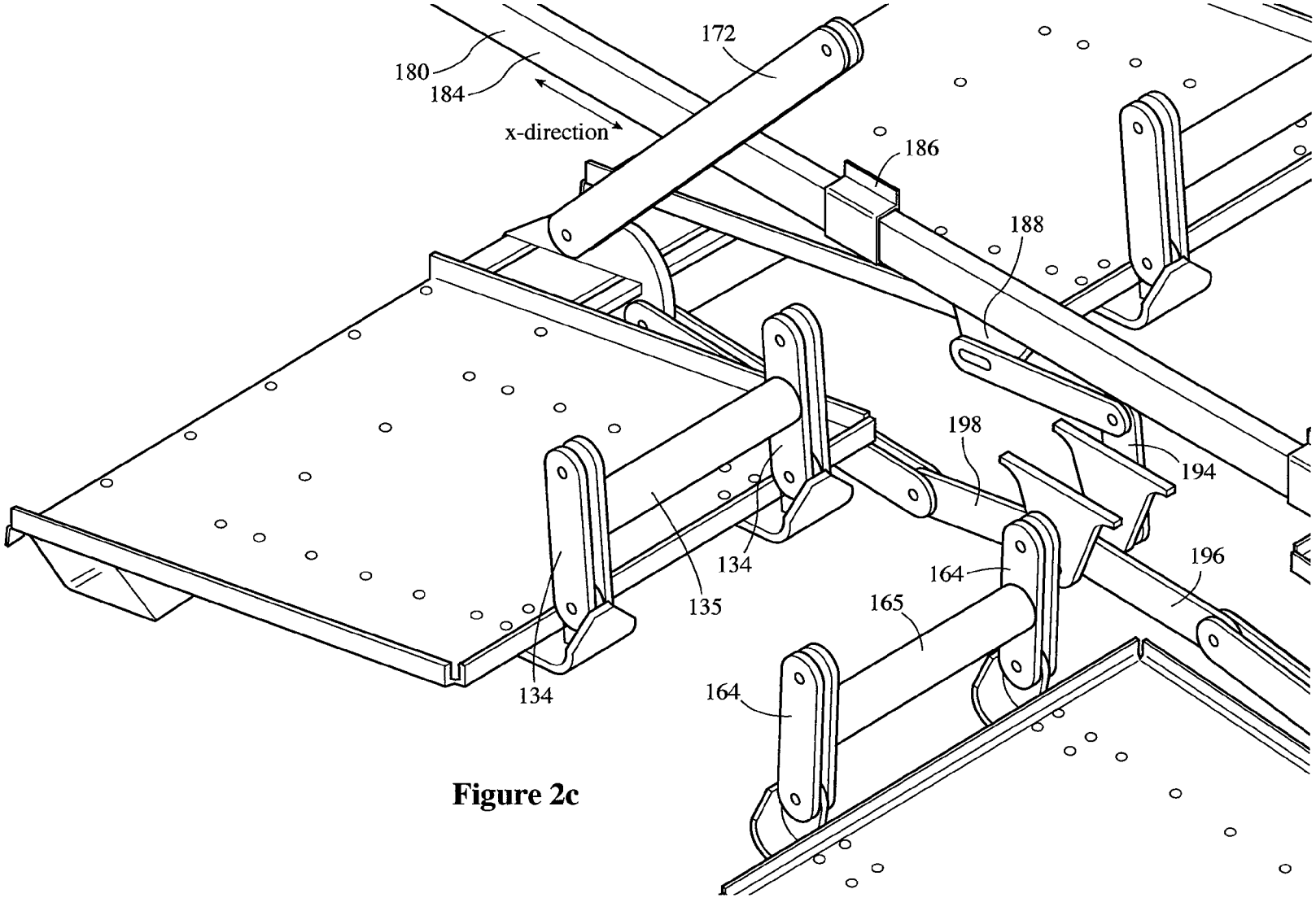
Figure 2D:
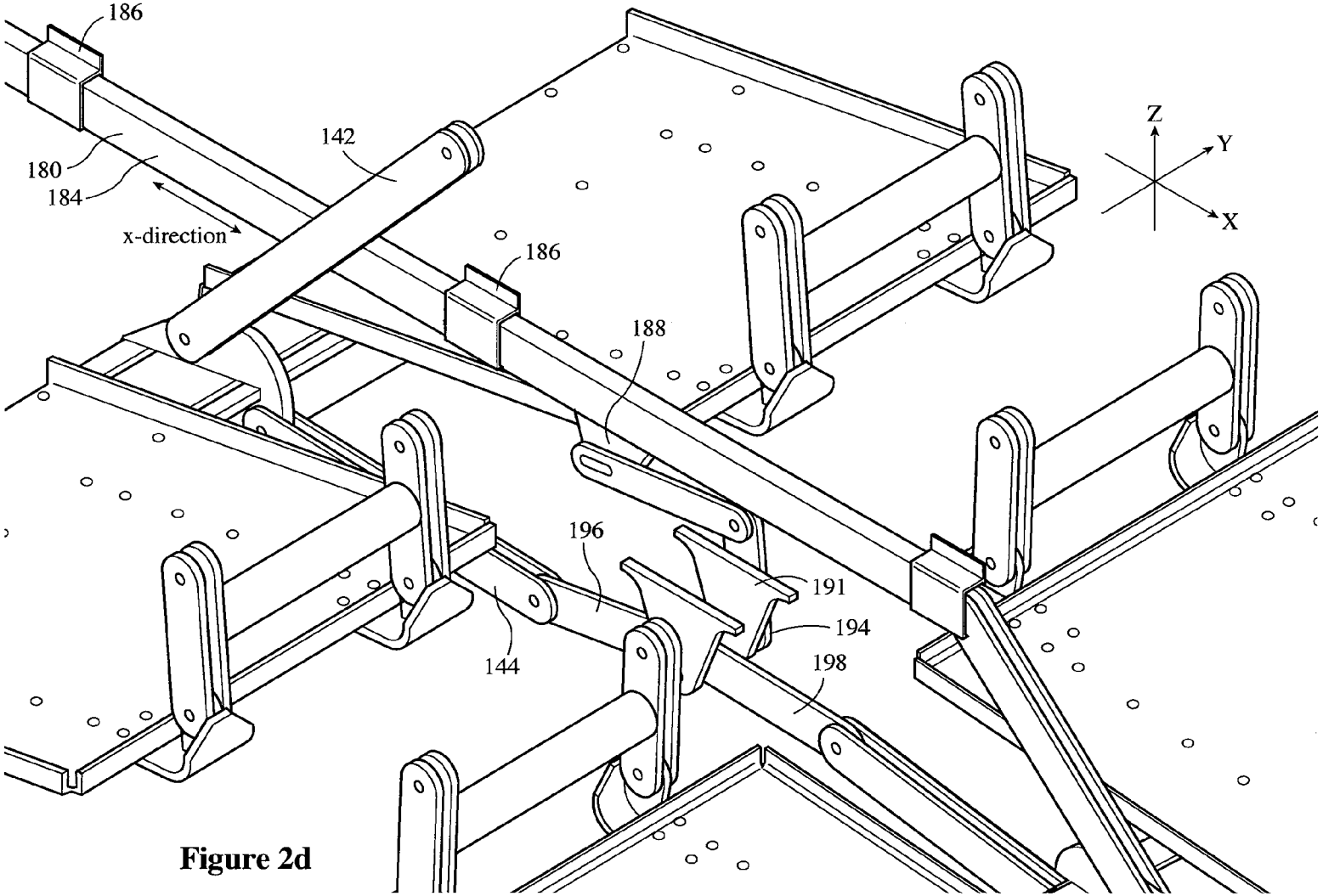
Figure 2E:
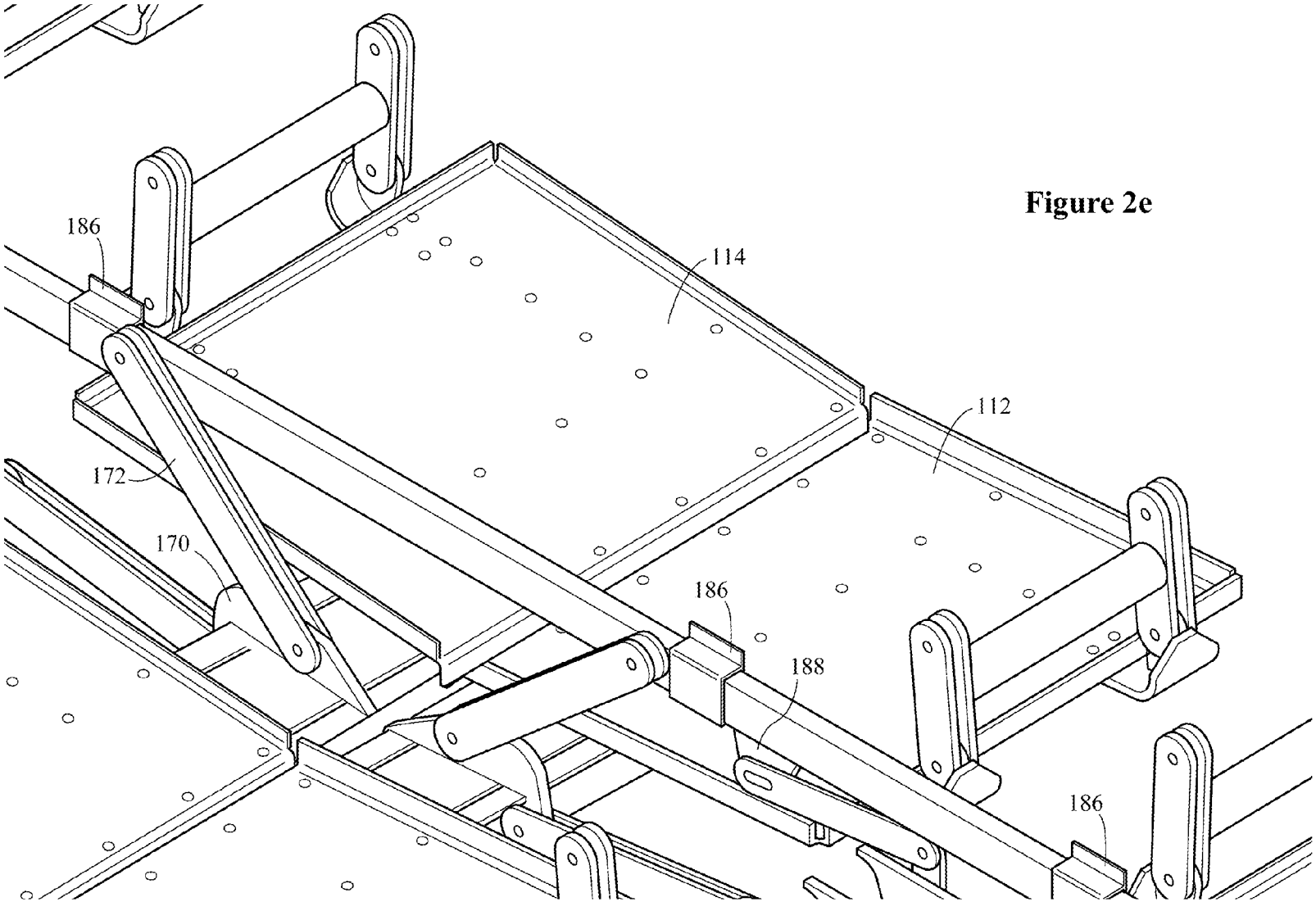
Figure 2F:
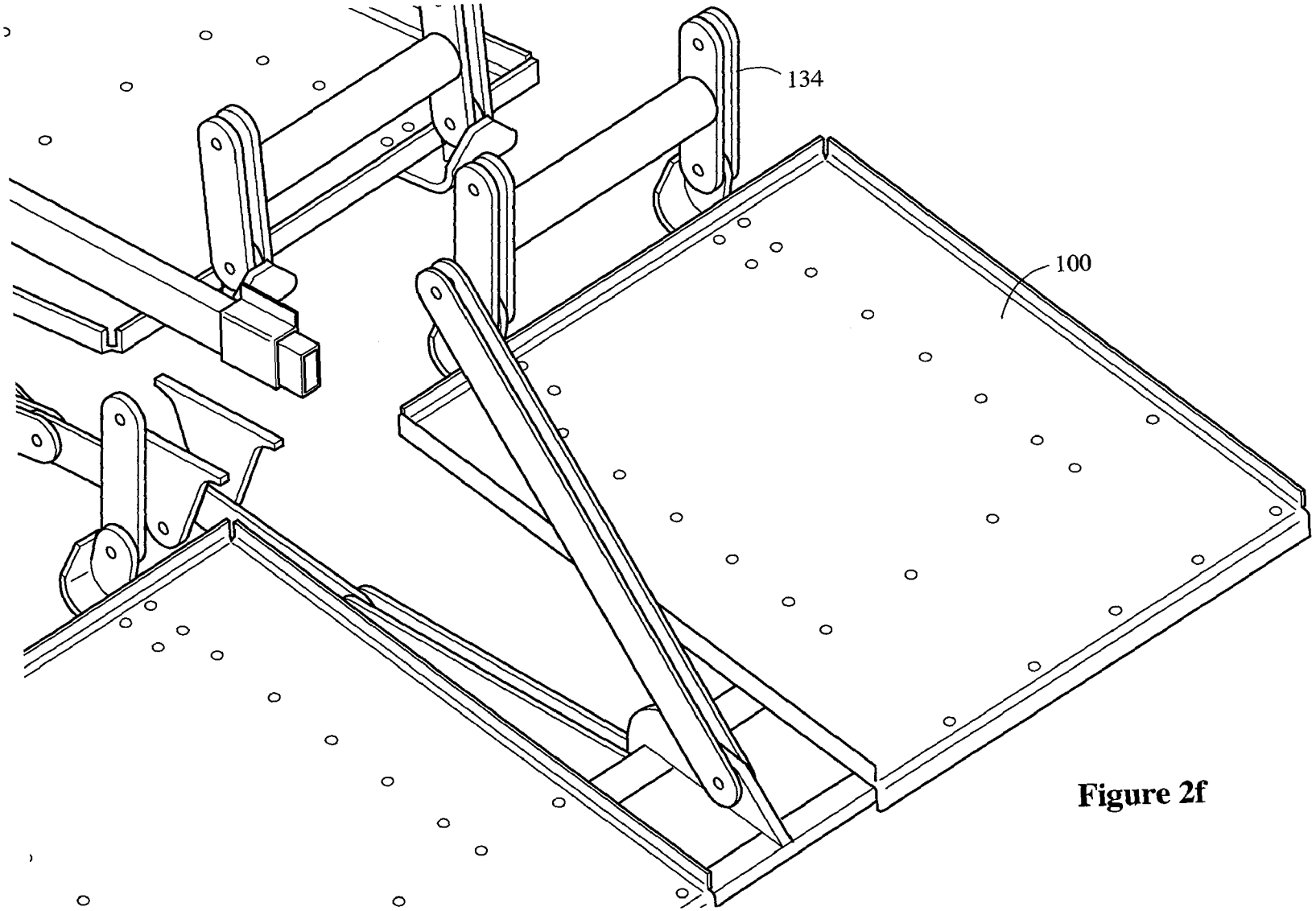
Figure 3A:
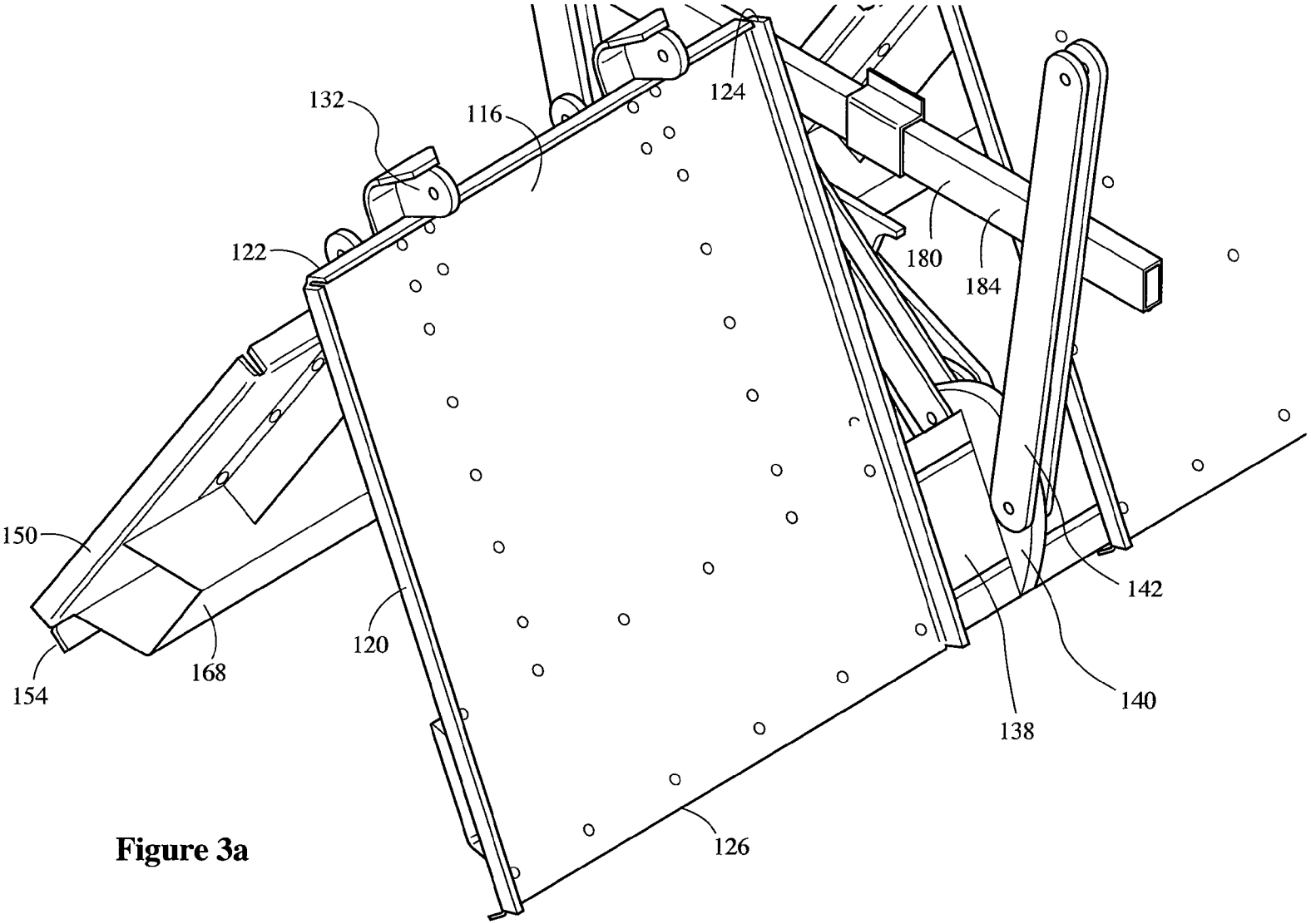
FIGS. 3*a* to 3*f* are enlarged details of FIG. 1*d;*
Figure 3B:
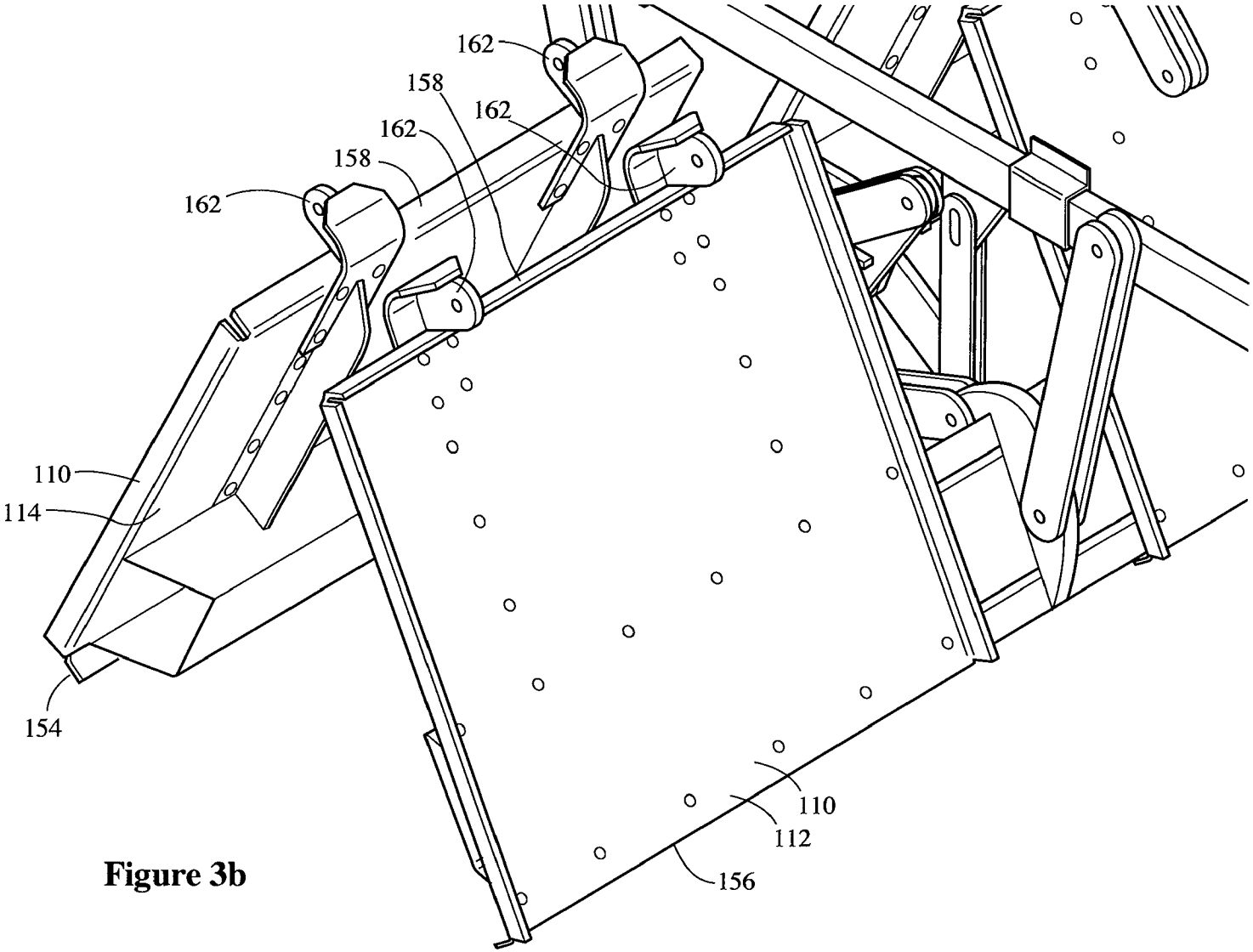
Figure 3C:
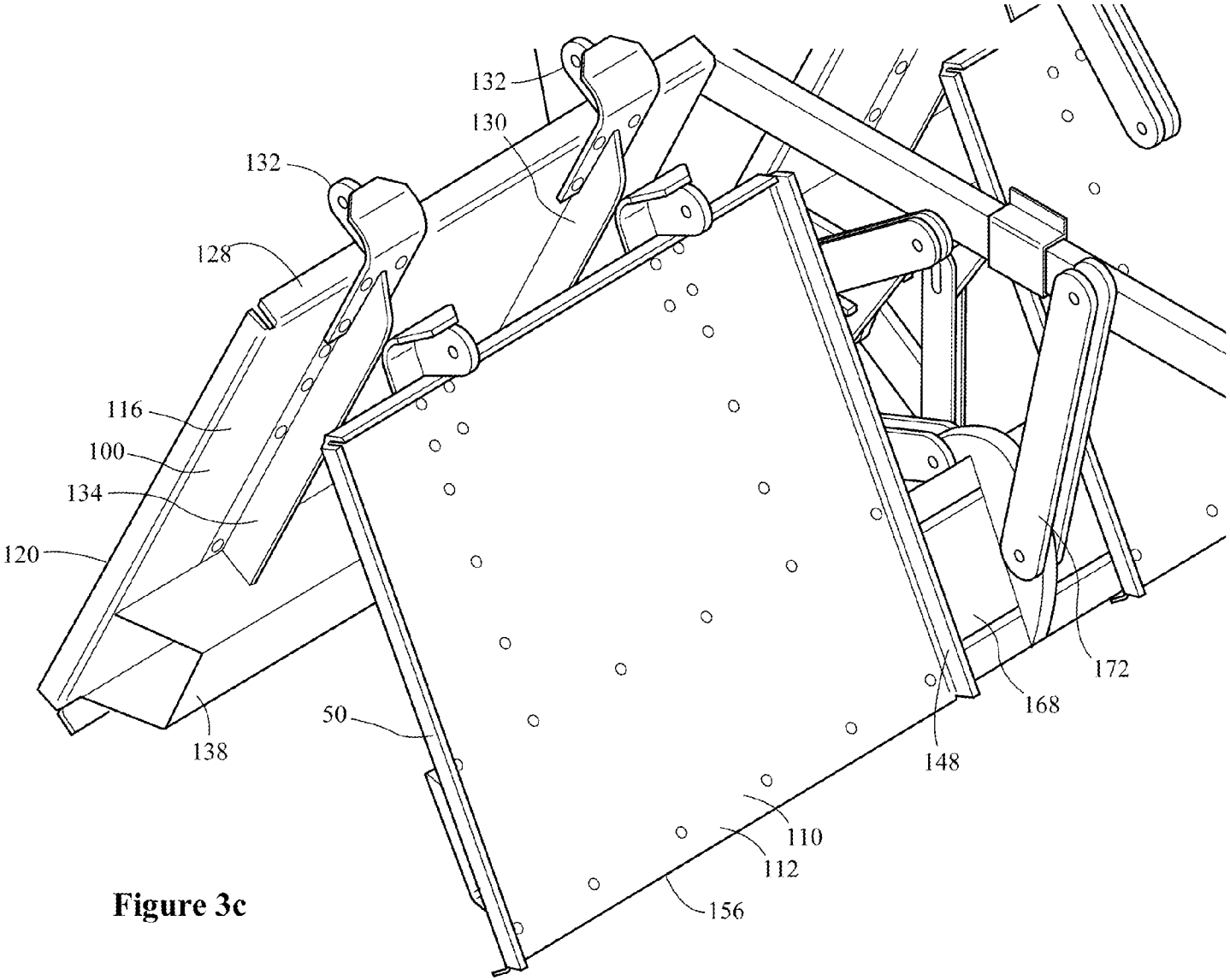
Figure 3D:
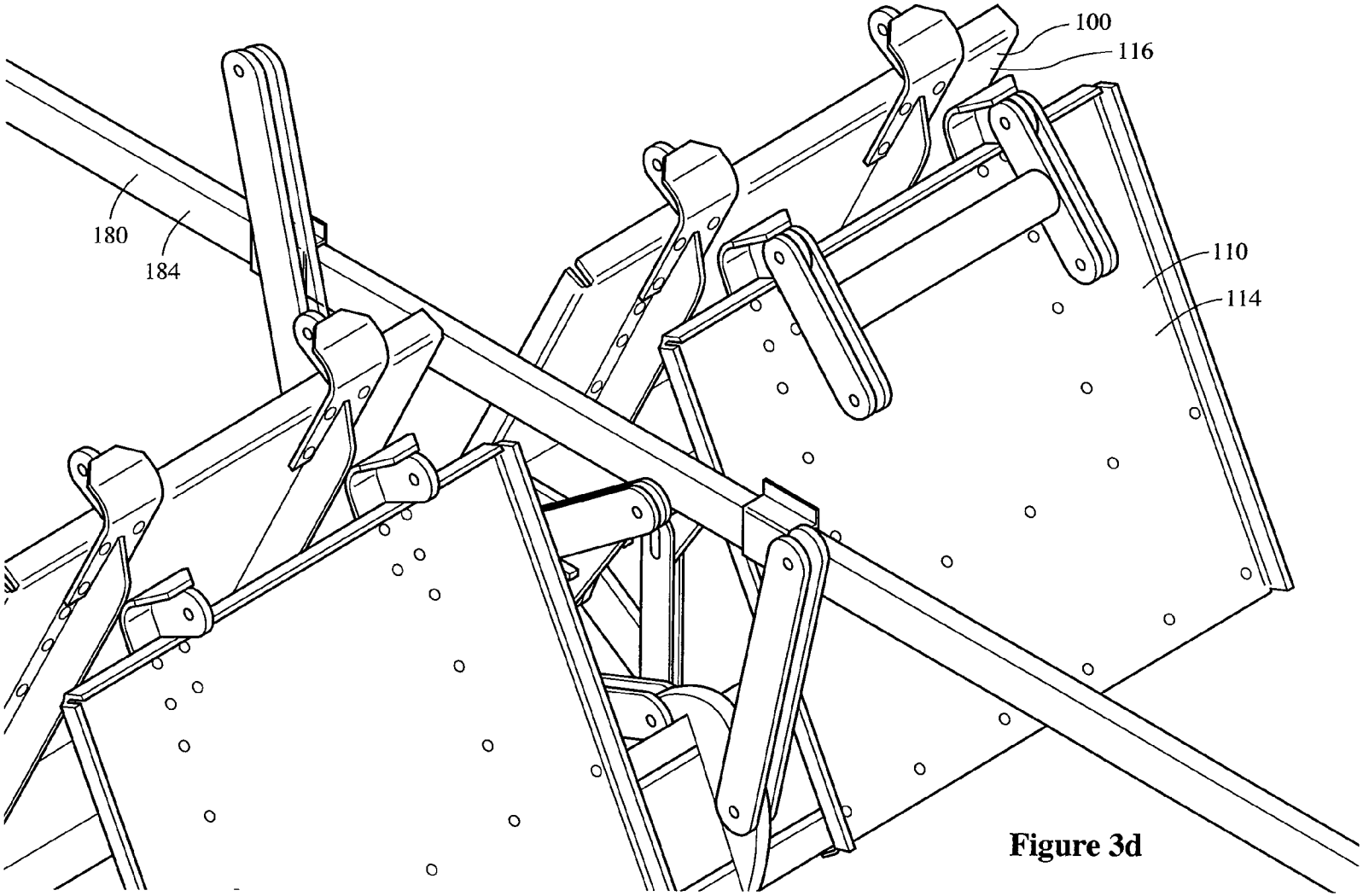
Figure 3E:
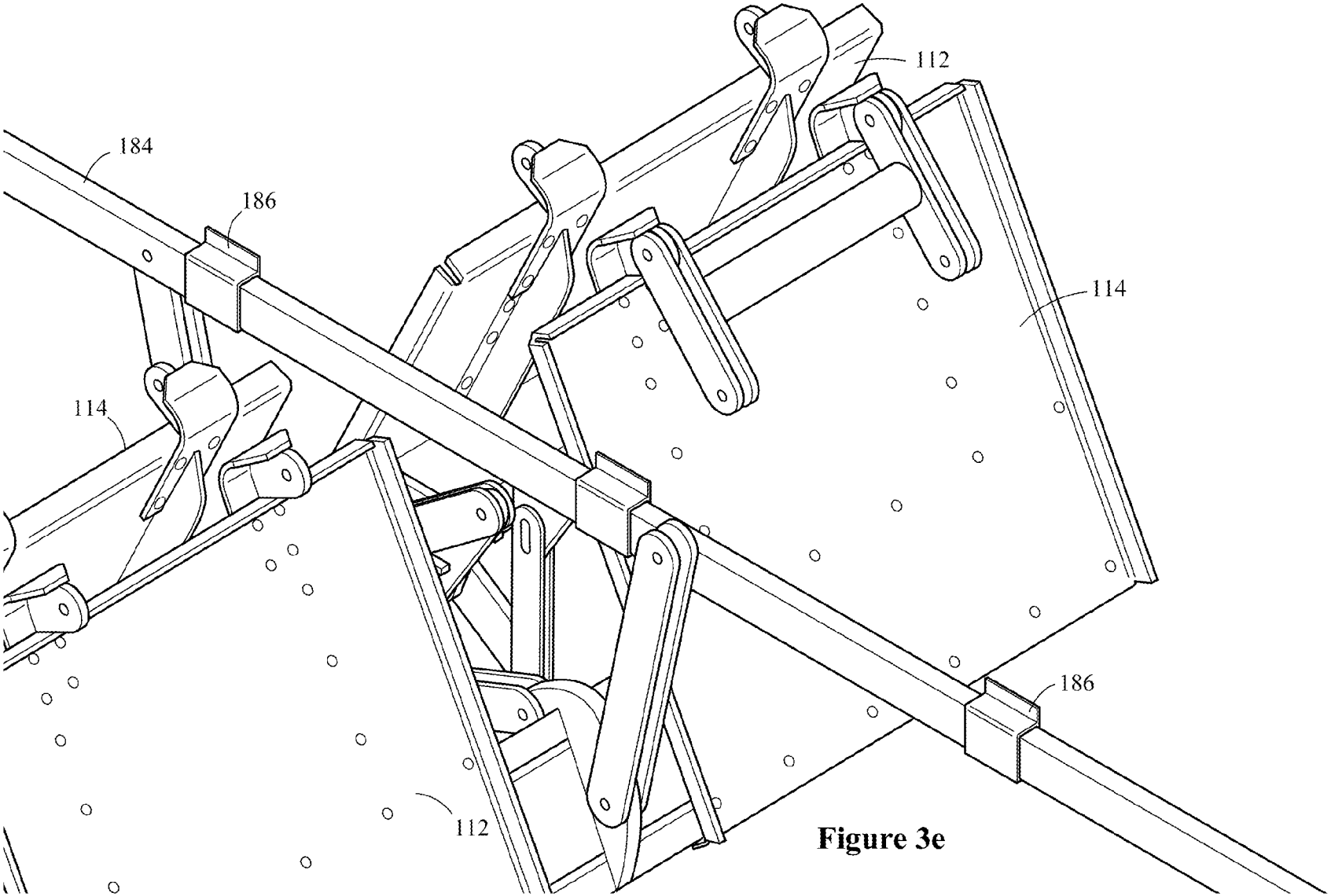
Figure 3F:
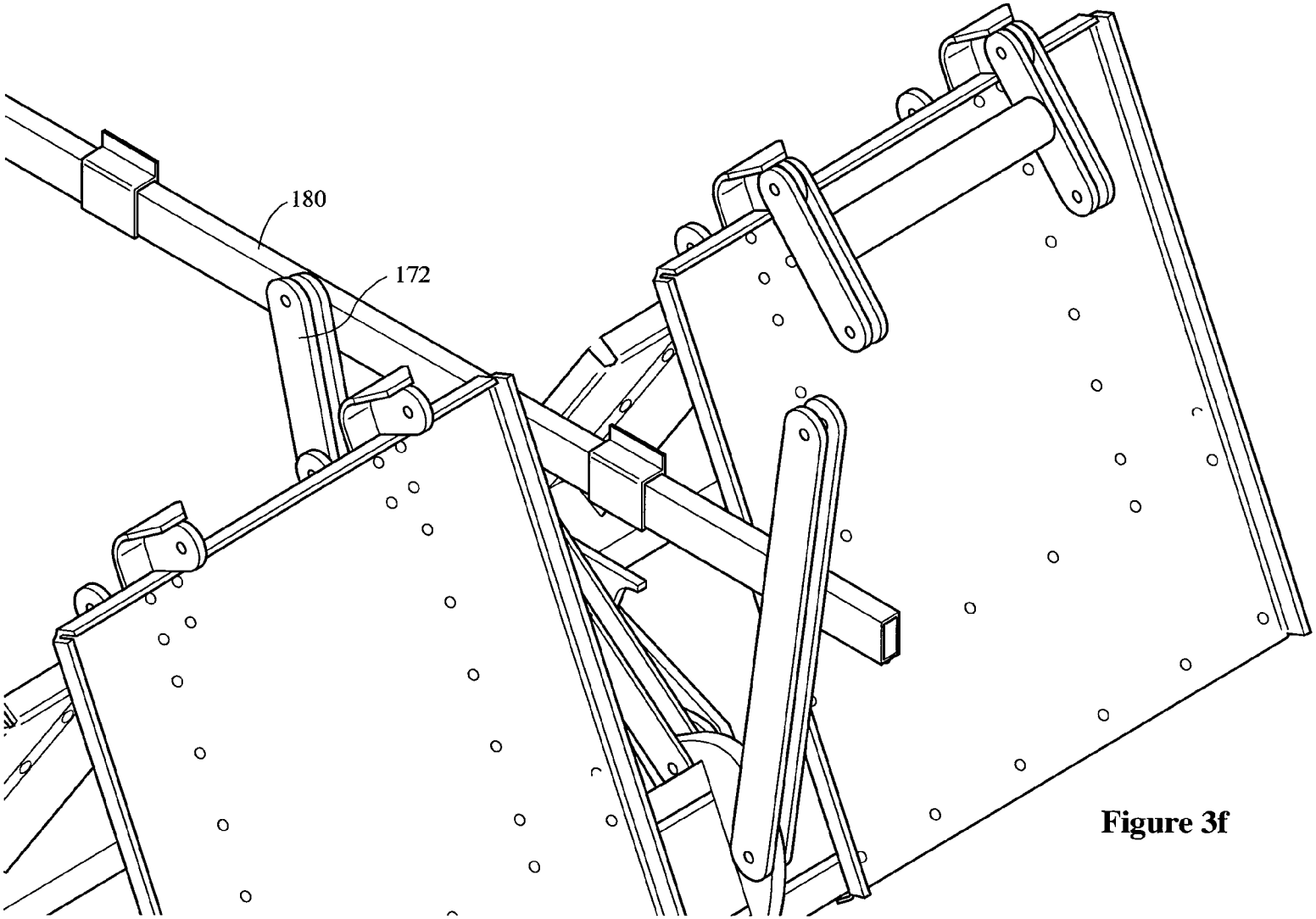
Figure 4A:
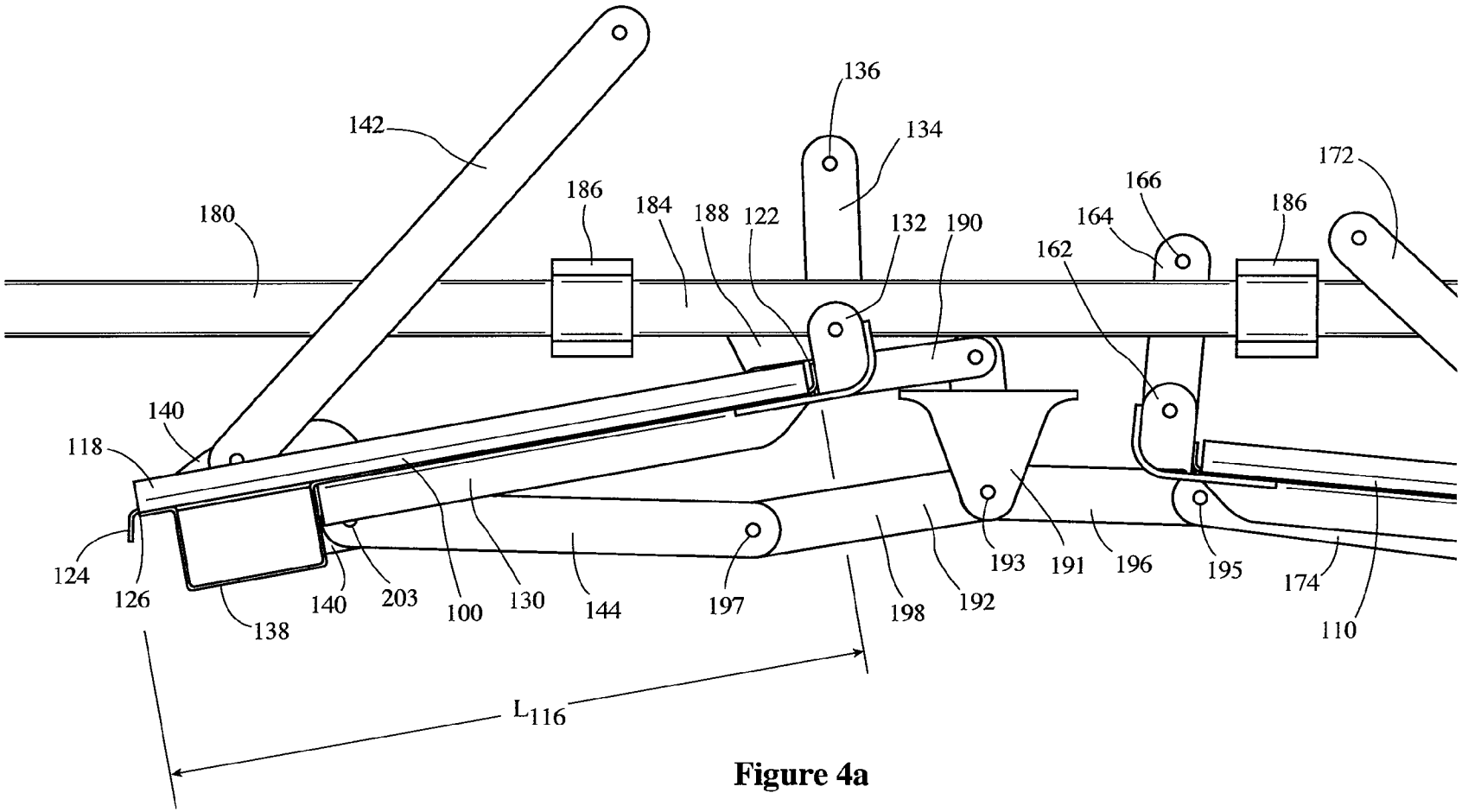
FIG. 4*a* is an enlarged side view of a portion of the door opening mechanism of FIG. 1*d;*
Figure 4B:
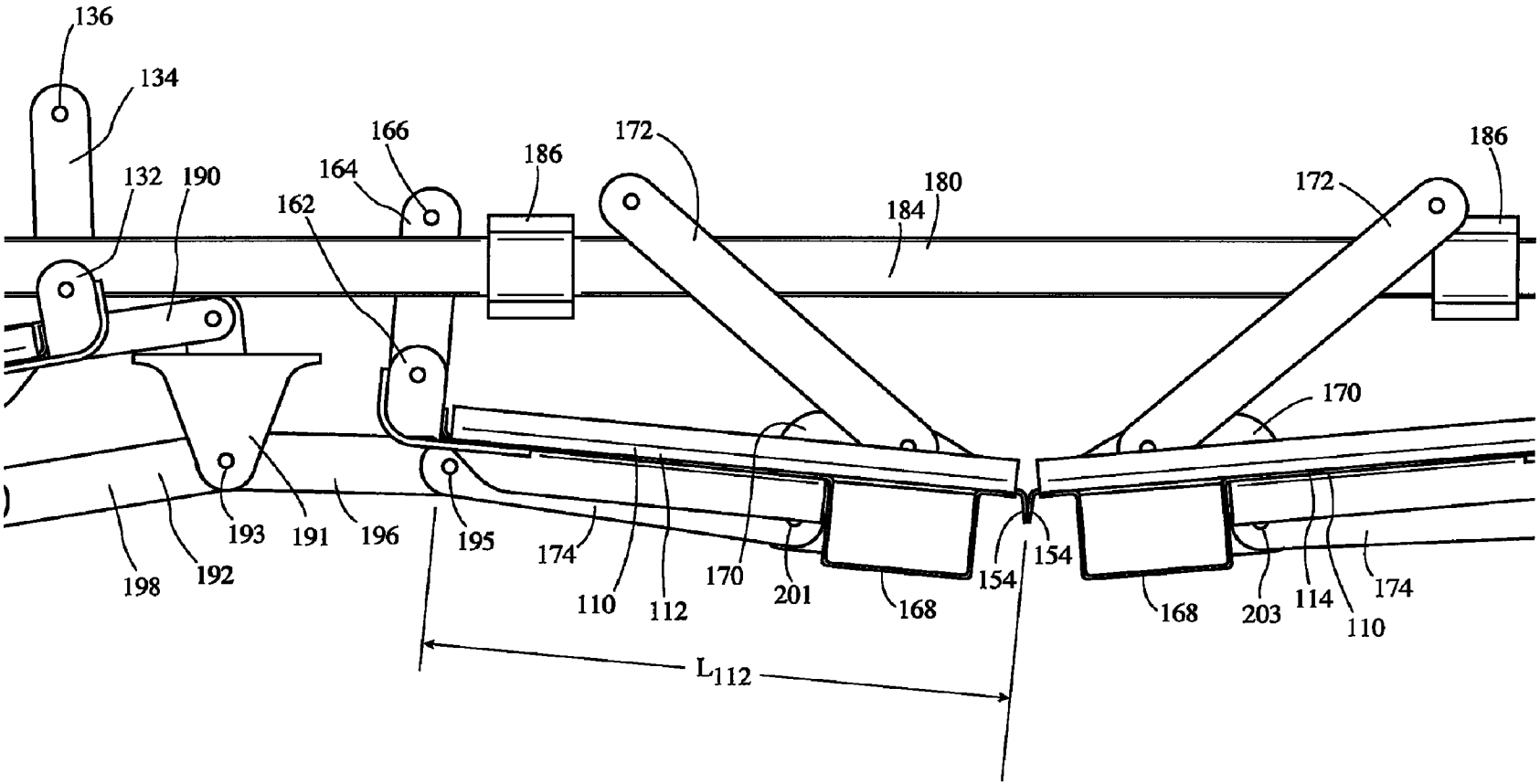
FIG. 4*b* is an enlarged side view of a second portion of the door opening mechanism of FIG. 1*d;*
Figure 4C:
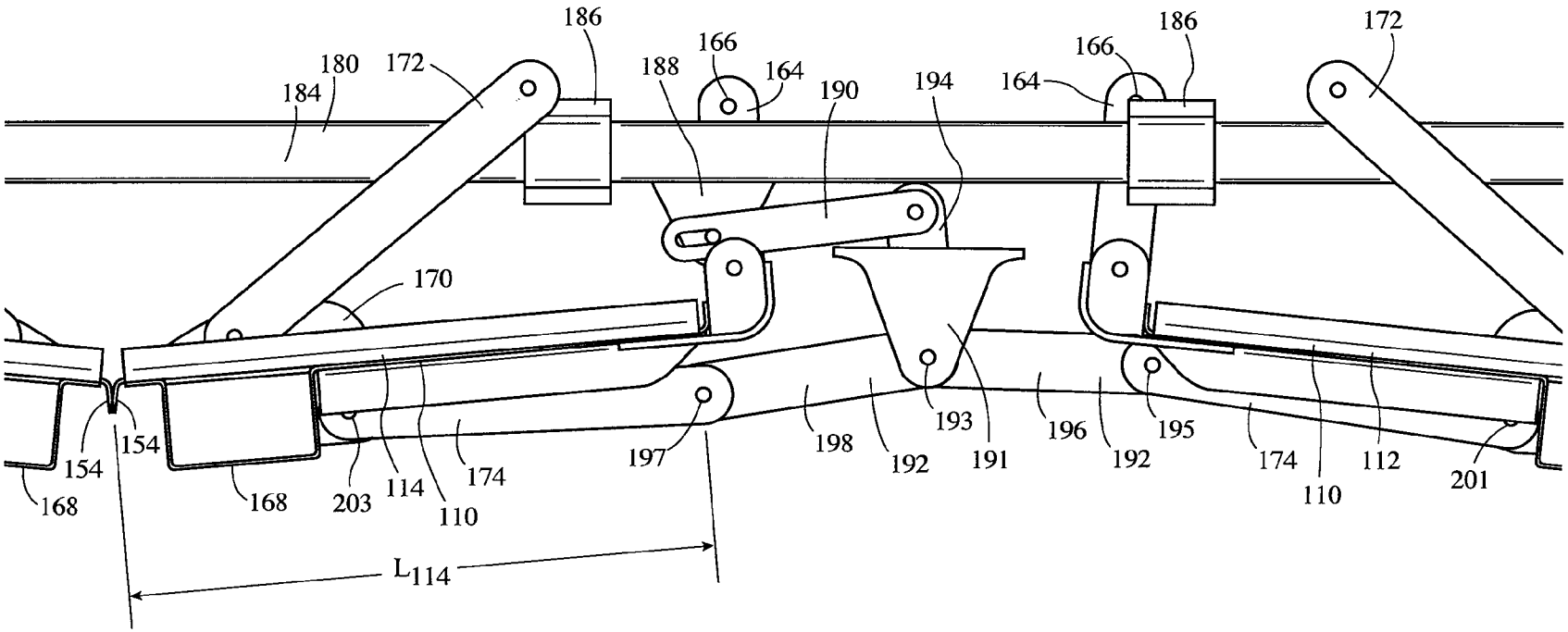
FIG. 4*c* is an enlarged side view of a third portion of the door opening mechanism of FIG. 1*d;*
Figure 5A:
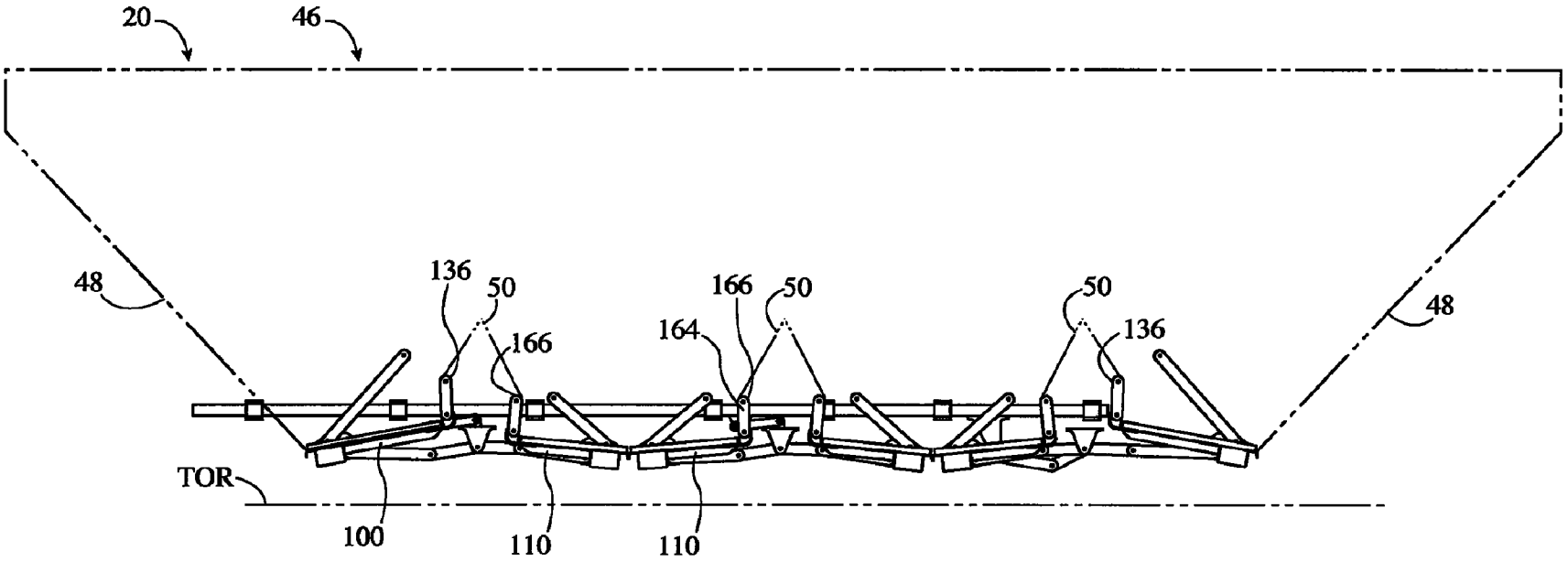
FIGS. 5*a*-5*f* show an evolution of the door opening mechanism of FIG. 1*d* moving from a closed position to an open position in 20% increments.
Figure 5B:
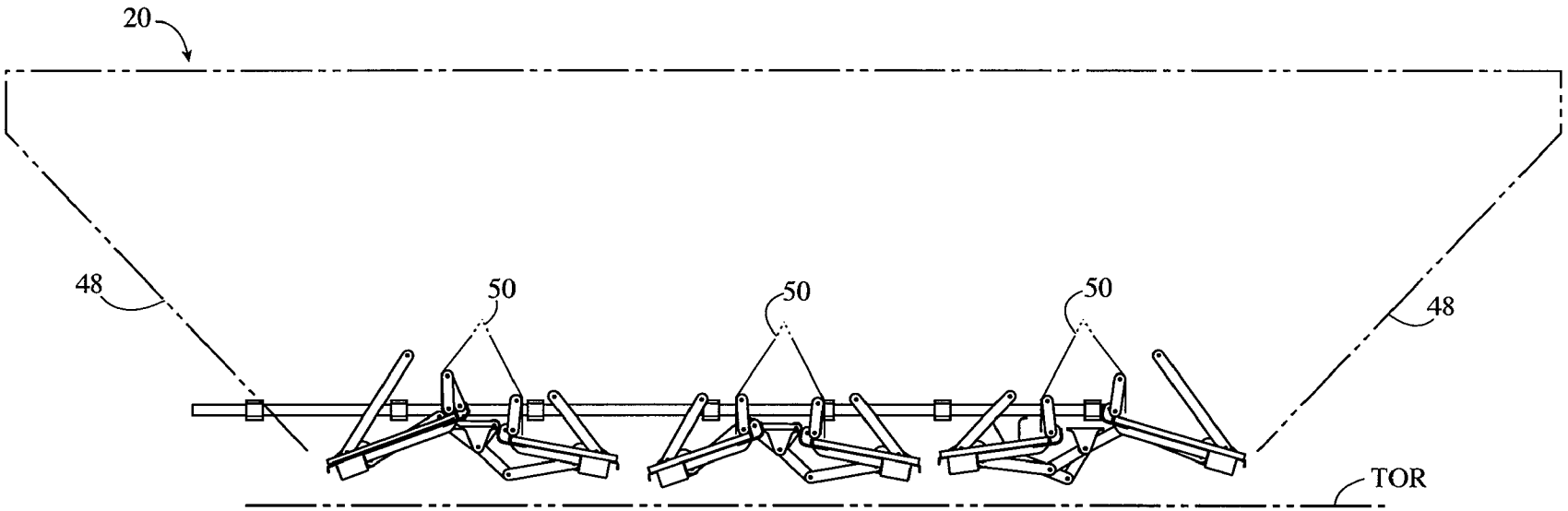
Figure 5C:
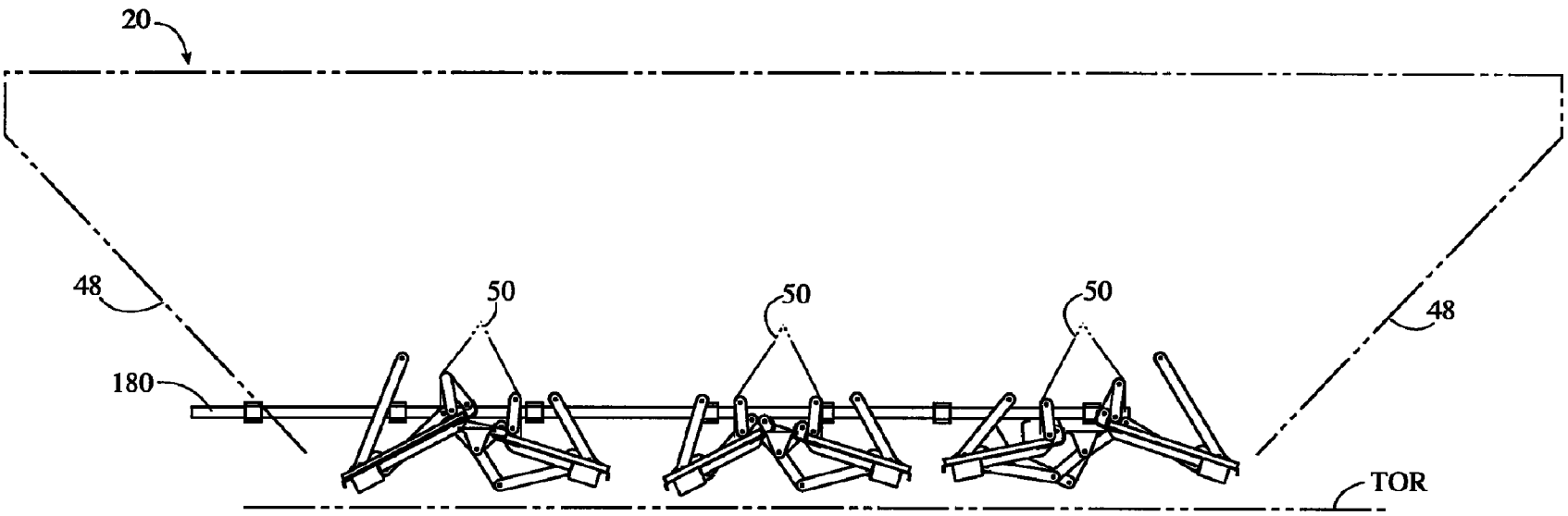
Figure 5D:
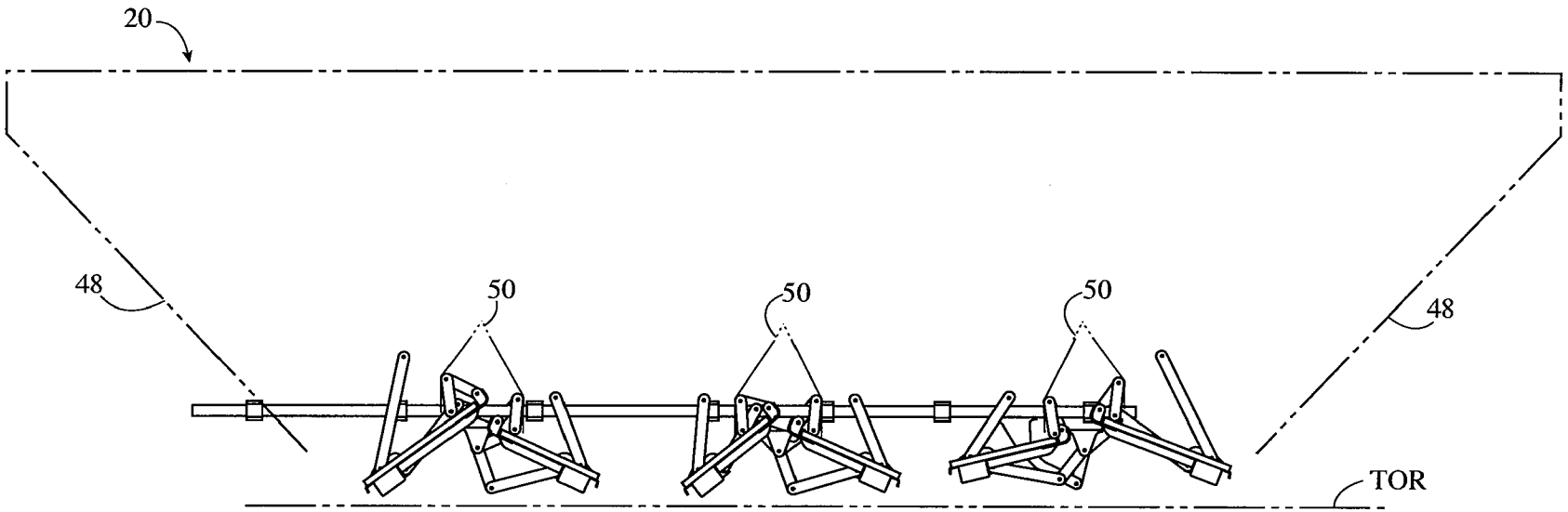
Figure 5E:
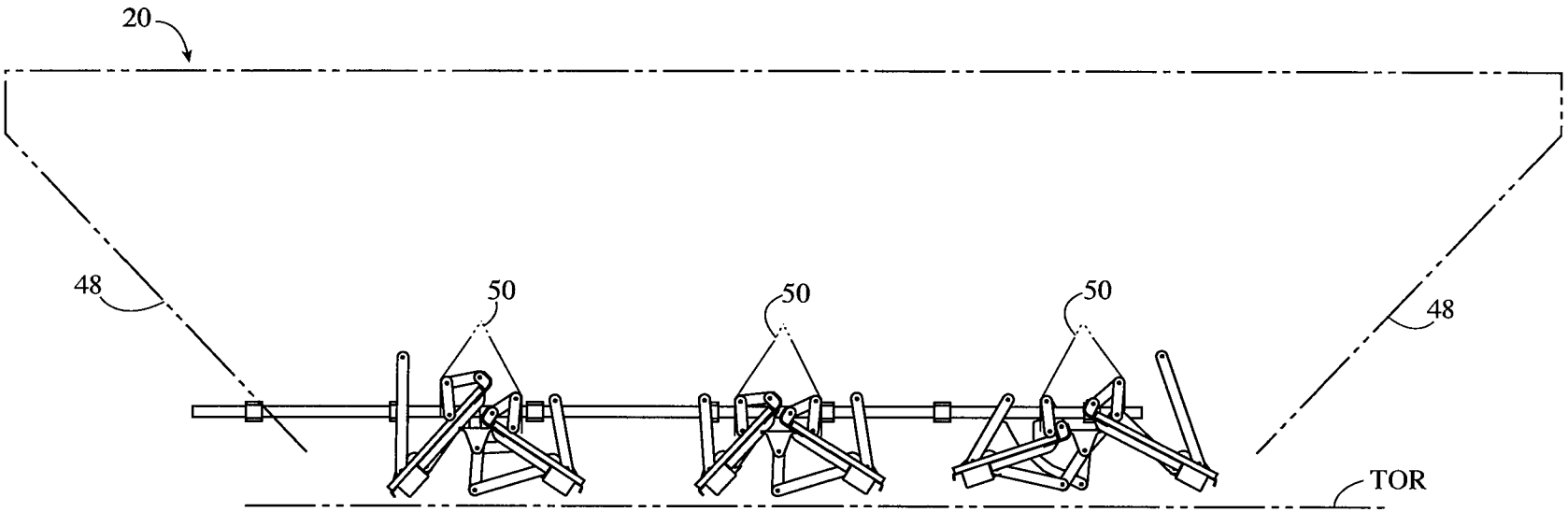
Figure 5F:
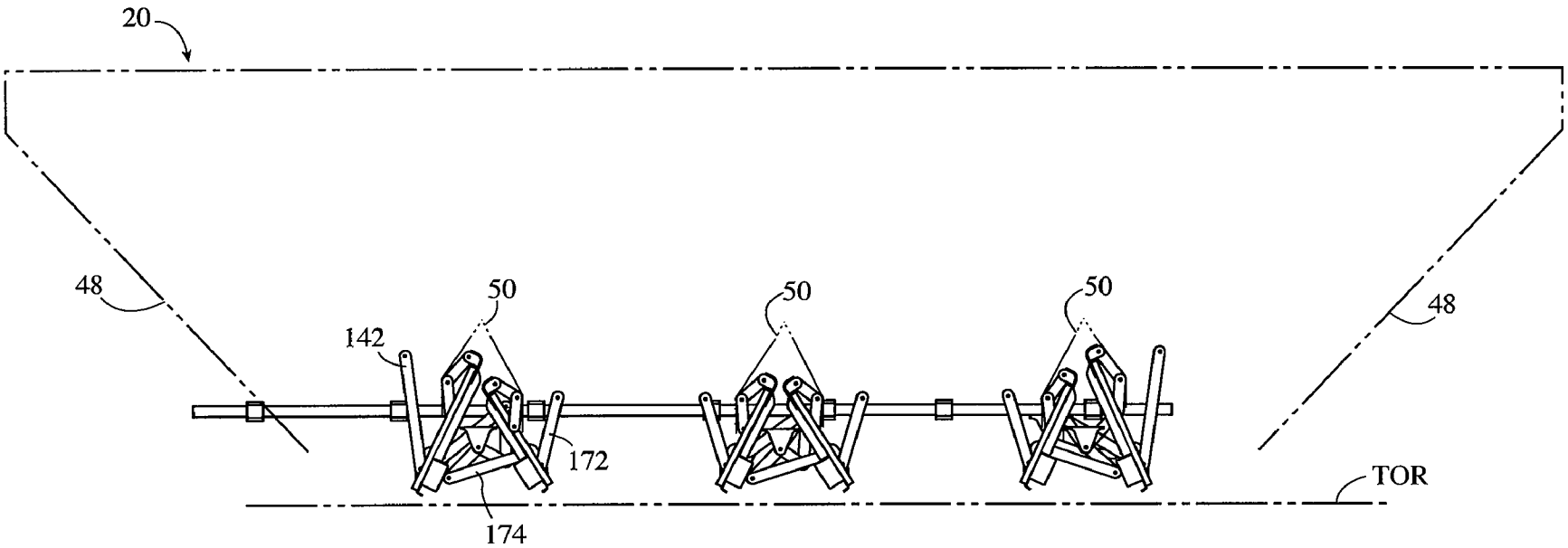
Figure 6A:
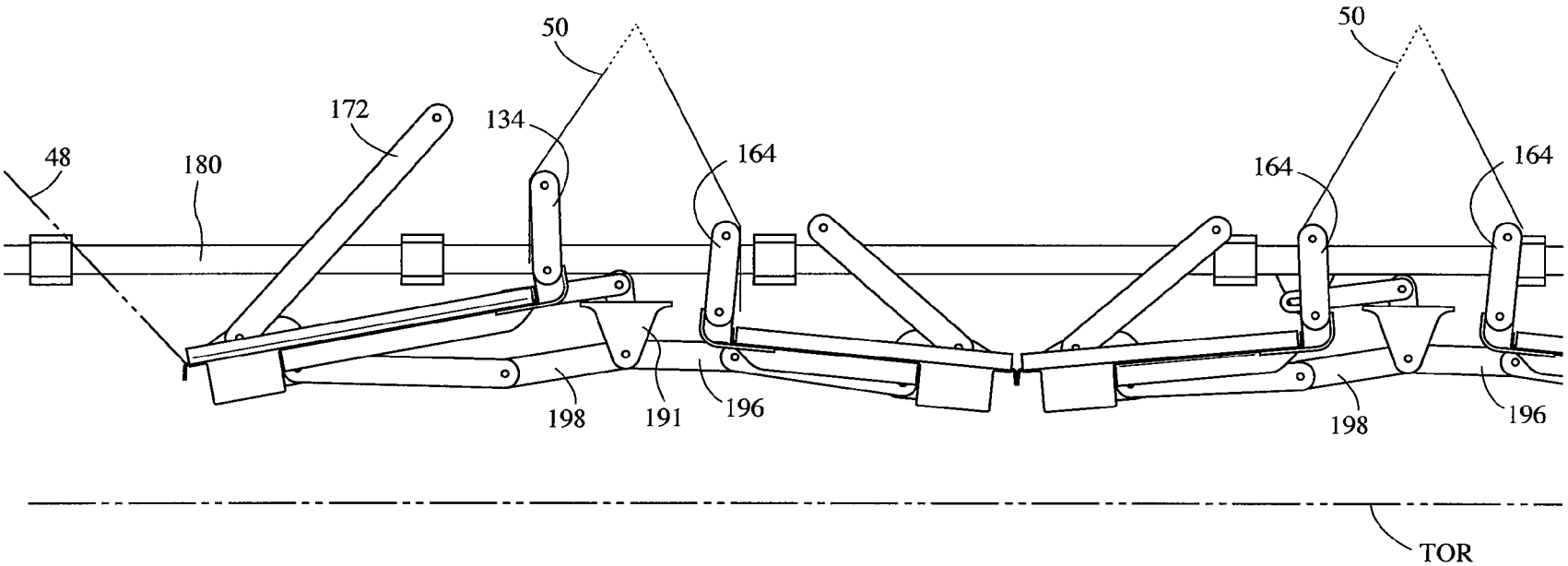
FIGS. 6*a*-6*f* show enlarged details of the evolution of FIGS. 5*a* to 5*f;*
Figure 6B:
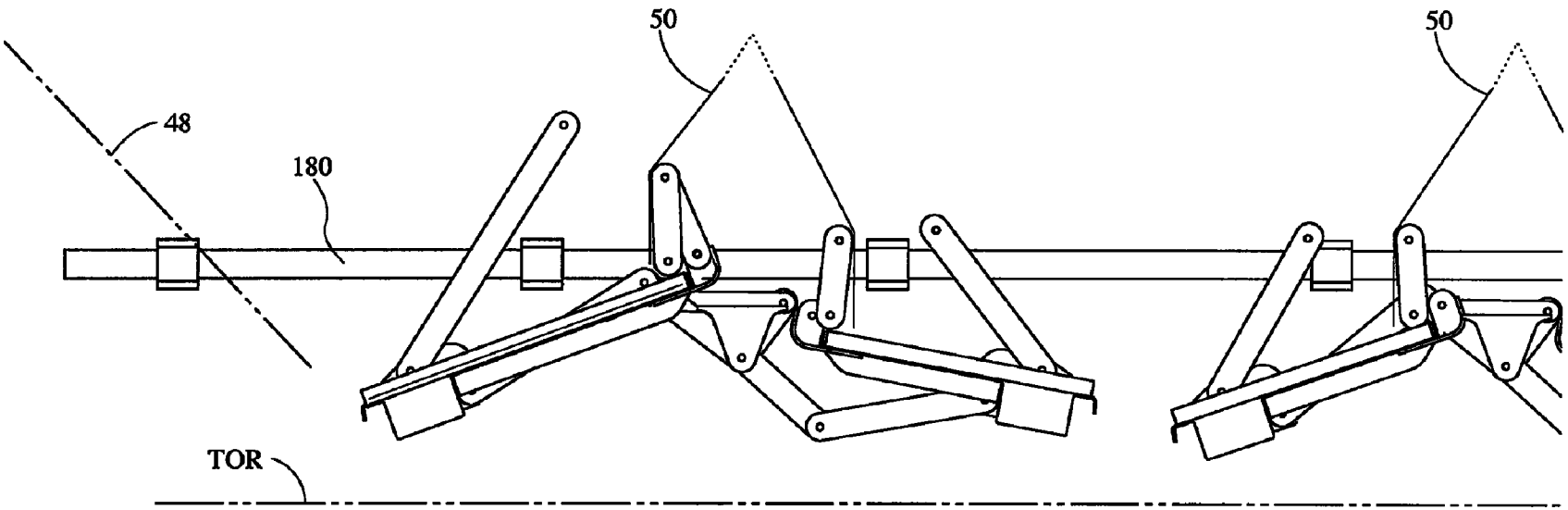
Figure 6C:
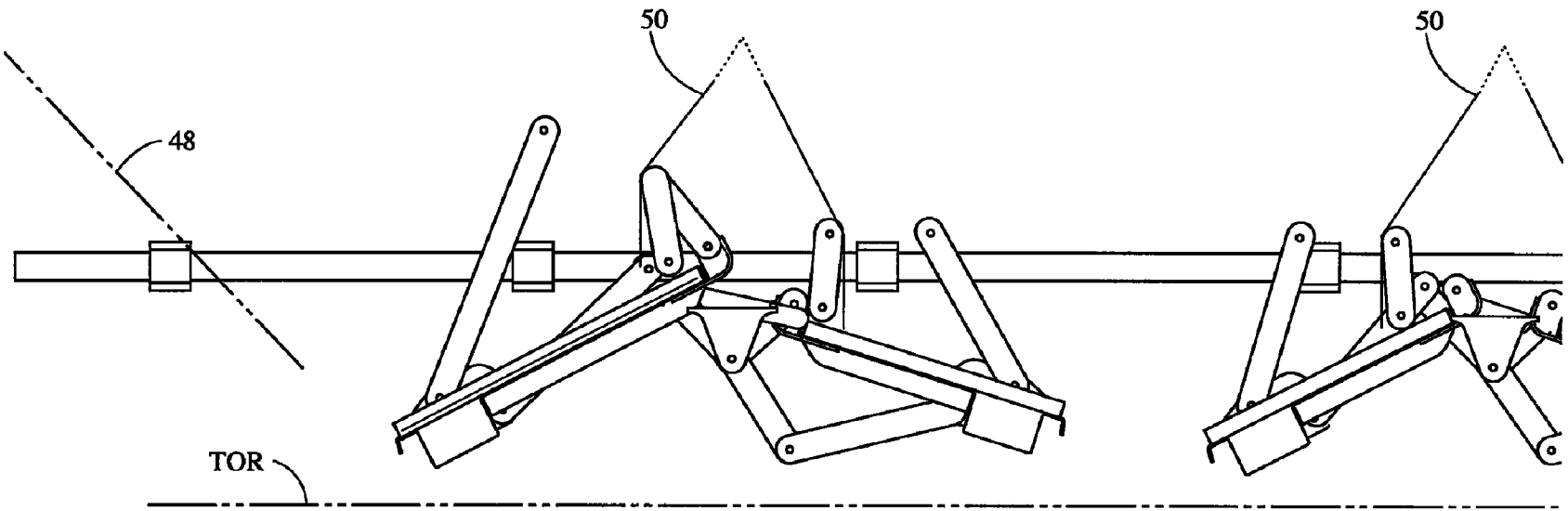
Figure 6D:
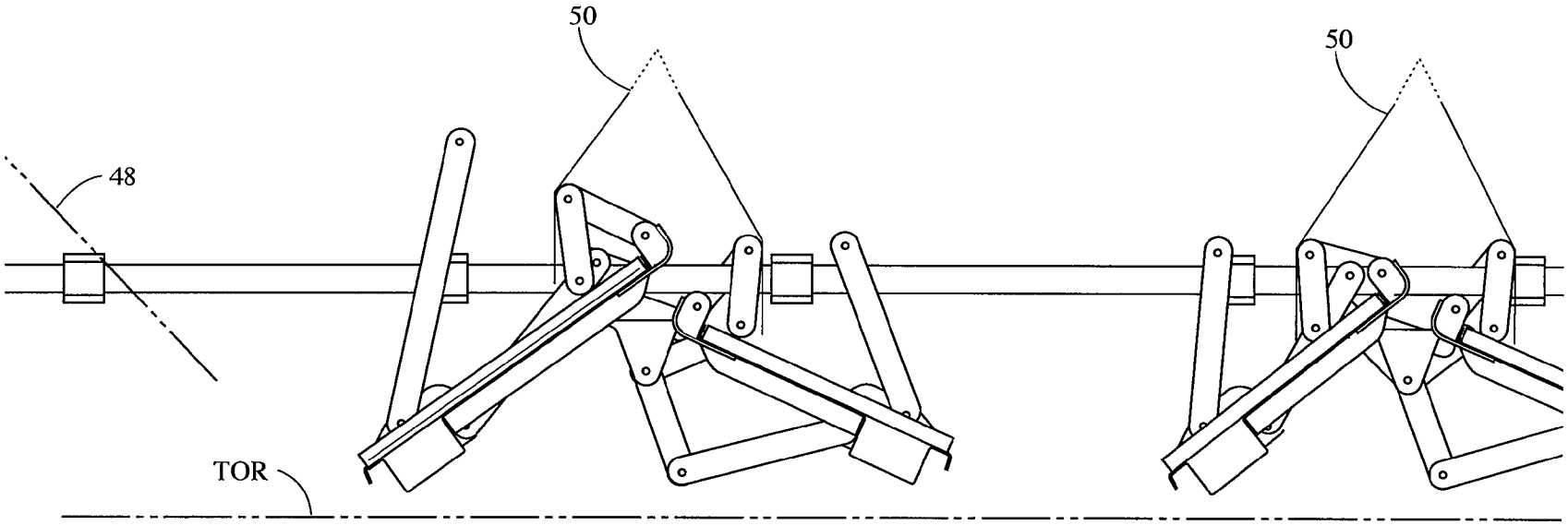
Figure 6E:
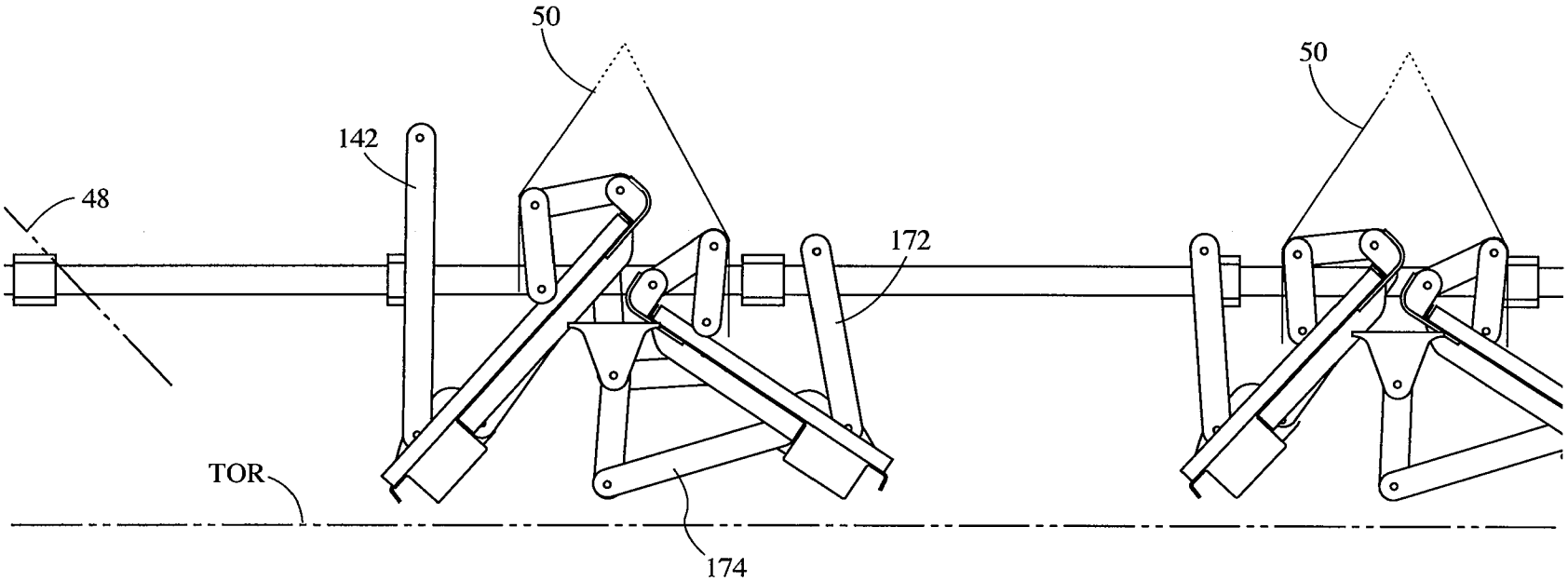
Figure 6F:
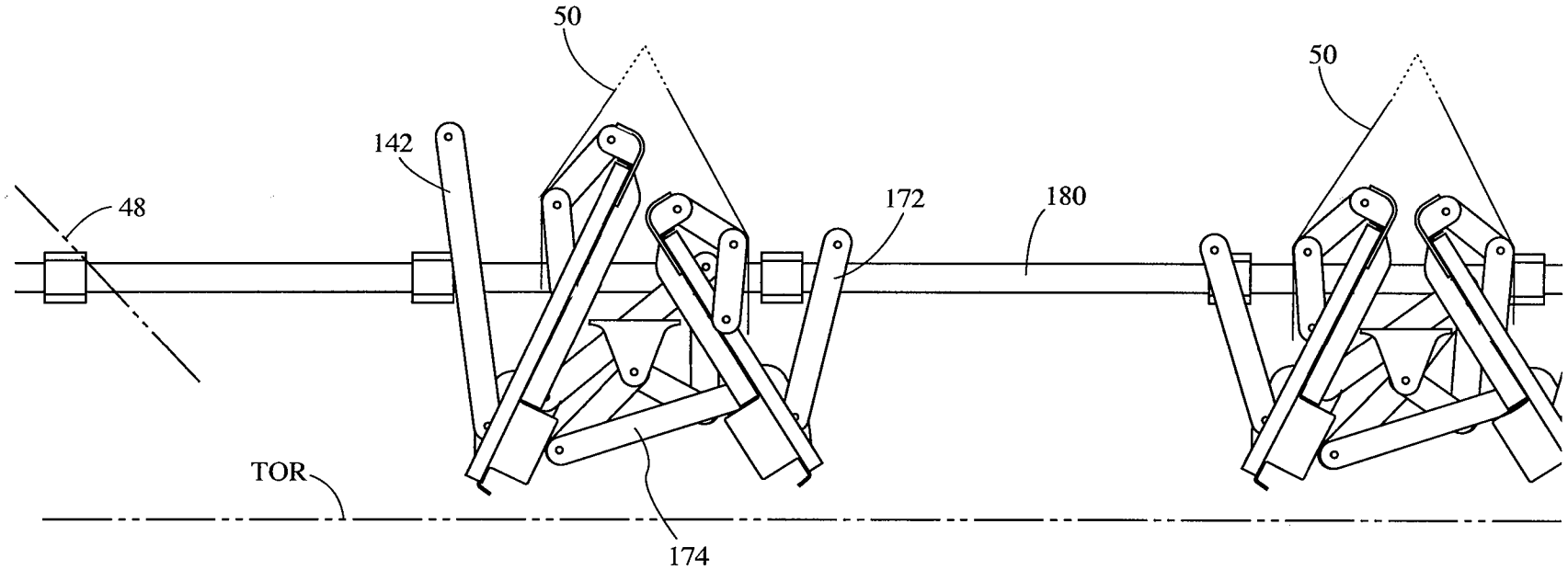

As shown in FIG. 1*c*, the interior of car body 22 may include end slope sheets 48. The car may have laterally extending members or reinforcements, indicated generally as 50, which may be cross-bearers, or cross-bearers with shrouds, or merely shrouds. These cross-members may run fully across the car from side sill to side sill, and may intersect the center sill, or the center sill shroud 52, as may be. The car may also include upper wall bracing, in the nature of diagonal struts 54 which extend diagonally upwardly and outwardly from the apices of the respective cross-members at the centerline of the car to upper regions of the side walls near or at the top chords; and lateral ties or struts 56 that run across the car from sidewall to side wall to meet the upper ends of the diagonal struts at their wall brackets 58. Those brackets are aligned with, and mated through the wall to, the vertical exterior posts 60 that run from the side sill to the top chord and reinforce the walls.

Both the center sill and the cross members may tend to have the shape of, or be provided with a cover or cap 62, 64 respectively, having the shape of a sloped roof, i.e., with a peak or ridge 66 that gives way to relatively steeply sloped or angled sides or flanks 68, 70 or 72, 74 as may be, which may then give onto substantially vertical side portions 76, 78, 80, 82. It may be noted that the cross-members divide the interior of the car into a series of longitudinal bays, or sub-spaces, sub-volumes, hoppers, or discharge sections, identified generally as 84, 86, 88, and 90. While the embodiment shown illustrates four such bays or regions, the car might have as few as two, three, or more than four. The cross-members, and for that matter the center sill, are flow dividers to the extend that lading flowing out of the car must flow around, and so be split by, those members. An accommodation is formed within the hollow center sill. and the cross-members. An accommodation 75 is also formed within each of the cross-members 50 between the flanks 72, 74 and the steeper extensions of those flanks (if any) symbolized by side portions 80, 82.

End sheets 48 may be slope sheets. Not atypically, each pair of fore-and aft opposed slope sheets, or sloped cover flanks, may be inclined at equal and opposite angles, and the angles of those sheets may be selected to be somewhat steeper than the free slope angle, or natural talus slope angle of the lading for which the car is designed, such that, when the gates are opened, the lading may tend to flow out, rather than sit at rest.

Each discharge section in the illustrated car 20 has first and second discharge openings, one to each side of the center sill. The end discharge sections 84, 90 have first and second openings 92, 94, while the intermediate discharge sections 86, 88 have first and openings 96, 98. It can be seen that egress of lading from these discharge sections is governed by the various door assemblies. To the extent that the car has both longitudinal and transverse symmetry of structural elements, it will be understood that, other than allowing for left and right handedness, the same door assembly 100 is used in each of end discharge sections 84, 90 to govern right hand and left hand openings 92, 94, and door assembly 110 is used in each of discharge sections 86, 88 to govern right hand and left hand openings 96, 98. Door assembly 100 is a single door in which there is only one moving door panel member. When closed, that door panel member engages stationary members about all four sides or edges of its periphery. Door assembly 110 is a double door assembly, in which there are two moving door panel members or assemblies 112, 114, the one being right handed, the other being left handed. Closing involves the co-operation of the two panels, such that each panel meets stationary members on three sides or margins or edges, and a moving member, namely the other door panel, on the fourth edge.

Car 20 may have relatively large slope sheets 48, which may tend to extend to a height relatively close to top chords 38. That is, taking either the coupler centerline height or the center sill cover plate upper surface as a datum, slope sheets 48 may terminate at a height that is at least half way to top chord 38, and which may, in some embodiments, extend more than ⅔, ¾ or ⅘ of that distance, as may be.

Consider the structure of door assembly 100. It includes a door panel, or sheet, or member 116, that is substantially planar, and of a length (i.e., extending predominantly in the longitudinal direction of the car when the door is closed) and width (i.e., dimension extending in the cross-wise direction relative to the car body more generally) for mating engagement with the stationary members defining the periphery of opening 92 or 94, as may be. Those stationary edge members are the lower edge of slope sheet 48, the lower edge of the center sill or center sill cover, as may be, the lower edge of the cross-member shroud opposite the slope sheet, and the lower edge of the side sill, or sloped side sill extension or side sill skirt 117 which may be considered as a side slope sheet of sorts, as may be. Member 116 has three upturned peripheral flange members 118, 120, 122 running along the centersill, side sill, and cross-member edges, respectively, and a spring lip, or seal 124, along the fourth edge, for spring loaded deflection against the slope sheet bottom margin, or lip. The fourth edge may be termed the distal or lower edge 126. It is the distal edge in the sense of being more distant from accommodation 75 of cross-member 50, being the side of the opening about which the door panel moves during the opening operation. It is the lower edge in the sense of the door panel being slightly slanted when in the closed position, in contrast to the proximal, or upper edge 128. The door may sit about 5 degrees from horizontal when closed. Typically, the door may have a closed angle of between 2 and 10 degrees or perhaps even as much as 15 degrees.

Door panel assembly 100 may also include longitudinal stiffeners 130 having the general form of angle irons. The upper or proximal ends of stiffeners 130 curve about proximal edge 128 and terminate in hard eyes, or lugs 132. These lugs are single degree of freedom fittings permitting rotational motion about the axis of the pivot pin bore of the lug, and define a first force transfer interface, or mounting point of door panel assembly 100. These lugs are pivotally connected to the ends of the first moving linkages 134 or a four bar linkage, the other end of linkages 134 being likewise pivotally mounted to stationary feet, or footings, or mounting points or force and motion connection interfaces identified as link mount lugs 136 mounted within, and near the lower flank margins of, accommodation 75. A rigid bar or spider, or torque tube 135 extends between the pair of lugs 134 to compel them to move together, rather than to permit the door to twist.

The left and right hand versions of door panel assembly 100 are yoked together to form a single door assembly by a laterally extending yoke, or beam, or reinforcement 138 which may have the form of an hollow structural section such as a seamless steel (or aluminum) tube, or channel with toes turned inward to form a hollow box section.

In the middle of the yoke, i.e., reinforcement 134, there is a gusset, or web, defining a footing or second force transfer interface, or mounting point or hard eye, identified as lug 140. Lug 140 has two pivot points, or bores, a first by which it is connected to the second pivoting linkage of the four bar linkage, identified as linkage 142. The other end of linkage 142 is mounted substantially along the centerline of the car within the accommodation formed in the lee of the center sill, or center sill cover, or cap plate, as may be. The second mounting point in lug 140 is defines an input force transfer interface at which the connection is made to a link, or strut, or push rod, or connecting rod 144 of the drive train. The remaining connections pertain to the transmission of force and displacement to door assembly 100 by the drive train, or transmission, described below.

Similarly, consider the structure of door assembly 110. Although of opposite hand, each of co-operating left and right hand door assemblies 112, 114 includes a door panel, or sheet, or member 146, that is substantially planar, and of a length (i.e., extending predominantly in the longitudinal direction of the car when the door is closed) and width (i.e., dimension extending in the cross-wise direction relative to the car body more generally) for mating engagement with the stationary members defining the periphery of opening 96 or 98, as may be. Those stationary edge members are the lower edge of one cross-member 50, the lower edge of the center sill or center sill cover, as may be, the lower edge of the next adjacent cross-member 50 opposite the slope sheet, and the lower edge of the side sill or side sill extension or side sill skirt 147, as may be, as above. Member 146 has three upturned peripheral flange members 148, 150, 152 running along the center sill, side sill, and cross-member edges, respectively, and a spring lip, or seal 154, along the fourth edge, for spring loaded deflection against the slope sheet bottom margin, or lip. The fourth edge may be termed the distal or lower edge 156. It is the distal edge in the sense of being more distant from accommodation 75 of cross-member 50, being the side of the opening about which the door panel moves during the opening operation. It is the lower edge in the sense of the door panel being slightly slanted when in the closed position, in contrast to the proximal, or upper edge 158. The door may sit about 5 degrees from horizontal when closed. Typically, the door may have a closed angle of between 2 and 10 degrees or perhaps even as much as 15 degrees. The spring seals 154 of the opposed and mutually engaging doors 112, 114 may be adjustably mounted on fit-up, as under adjustable plate members 157 indicated in FIG. 1*b*. The clearance between the door in the closed position and Top of Rail is, nominally 12⅞", i.e., just under 13".

Door panel assembly 110 may also include longitudinal stiffeners 160 having the general form of angle irons. The upper or proximal ends of stiffeners 160 curve about proximal edge 158 and terminate in hard eyes, or lugs 162. These lugs are single degree of freedom fittings permitting rotational motion about the axis of the pivot pin bore of the lug, and define a first force transfer interface, or mounting point of door panel assembly 110. These lugs are pivotally connected to the ends of the pair of laterally spaced first moving linkages 164 or a four bar linkage, the other end of linkages 164 being likewise pivotally mounted to stationary feet, or footings, or mounting points or force and motion connection interfaces identified as link mount lugs 166 mounted within, and near the lower flank margins of, accommodation 75. In the embodiment shown, the height of the axis of rotation defined by fixed lug 166 is about 38½ inches above top of rail, and the first link 164 has a length between pivot centers of 11 inches. A rigid bar or spider, or torque tube 165 extends between the pair of lugs 162 to compel them to move together, rather than to permit the door to twist. The lugs 162 of one door assembly 112 are laterally offset from the lugs 162 of the back-to-back door assembly 114 so that they will not foul each other during motion of the doors.

The left and right hand versions of door panel assembly 110 are yoked together to form a single door assembly by a laterally extending yoke, or beam, or reinforcement 168 which may have the form of an hollow structural section such as a seamless steel (or aluminum) tube, or channel with toes turned inward to form a hollow box section.

In the middle of the yoke, i.e., reinforcement 164, there is a gusset, or web, defining a footing or second force transfer interface, or mounting point or hard eye, identified as lug 170. Lug 170 has two pivot points, or bores, a first by which it is connected to the second pivoting linkage (or symmetrically mated pair of linkages) of the four bar linkage, identified as linkage 172. The other end of linkage 172 is mounted substantially along the centerline of the car within the accommodation formed in the lee of the center sill, or center sill cover, or cap plate, as may be. The cap plate of the center sill at the double door locations is lower than the cap of the center sill at the end door locations as the length of linkage 172 (25") may be shorter than linkage 142 (40"). It may also be noted that while the width of the double and single doors is the same, the length $L_{112}$ or $L_{114}$ of each of the double door members 112, 114, which, in the embodiment shown may be about 40 inches, is shorter than the length $L_{116}$ of the single door member 116, about 50 inches. The second mounting point in lug 170 defines an input force transfer interface at which the connection is made to the connecting rod 174 of the drive train. The remaining connections pertain to the transmission of force and displacement to door assembly 110 by the drive train, or transmission, described below.

The transmission, or drive train, may be designated generally as 180. It is the means by which both an informational signal to open or close the doors is transmitted, and also by which the force and displacement components of that signal are transmitted to achieve those motions. The drive signal originates when a pneumatic actuator, or cylinder 182 is activated in accordance with a desire to empty the car, for example. Cylinder 182 may typically be located at one of the end structures over one of the trucks and underneath the end slope sheet. The piston of cylinder 182 is connected to drive a lever, or a linkage mechanism by which the motion of the piston is converted to the translational motion of a drive shaft 184 or sting of linkages. Mechanisms of this nature are known, as shown for example in the aforementioned Shaver reference or as shown in U.S. Pat. No. 3,772,996 of Schuller, issued Nov. 20, 1973 or U.S. Pat. No. 5,249,531 of Taylor issued Oct. 5, 1993. Drive shaft 184, or a string of drive train linkages, as may be, is, or are carried in mounting fittings, whether slides, or collars, or bushings or hangers 186 mounted within the hollow center sill. Drive shaft 184 may be limited to a single degree of freedom of motion, namely translation in the longitudinal, or x-direction.

At the respective longitudinal stations of the various cross-members 50, drive shaft 184 has output force and displacement transmission interface members, illustrated as depending force transmission fingers or arms 188, as shown. A drag link, or symmetrically matched pair of parallel drag links 190 is, or are, pivotally mounted at one end to the pivot fitting of arms 188. The other end of the drag link is, or drag links are, mounted to the input force interface fitting, e.g., a pivot pin, of an intermediate motion and force transmission member such as may be in the nature of a bell crank fitting 192 which turns about an axis of rotation 193 of a pivot connection mounted between a pair of fulcrum support brackets or gussets 191. In the illustrated example fitting 192 has an input arm 194, a first output arm 196 and a second output arm 198. Link 190 is connected to input arm 194 as noted. The first and second output arms 194 and 196 have similar pivot connections 195, 197 to the connecting rods, or struts, or links 144, or 174, noted above, which may be singular, or may be in symmetrically matched pairs such as may pull or push in double shear and may thereby eliminate the creation of secondary out-of-plane moment couples in the transmission members. The far ends of links 144 or 174 are then connected to the input fittings, i.e. pivot connections 201, 203 of the various doors. It may be noted that links 144 or 174, and the co-operating output arms 194 and 196 have co-operating range of motion limiting over-center travel stops. That is, when the doors reach the closed position, the linkages have been driven over-center, i.e., past the 180 degree orientation of axis 193 and pivot pins 195, 201, or, alternatively axis 193 and pivot pins 197, 203, such that the weight of lading bearing against the various door panel members will then tend to lock the doors more tightly closed against the over-center travel stops. When opening of the doors is required, the piston of cylinder 182 forces drive shaft 184 in the other direction, taking up the relatively small amount of lost motion in the slot in the input end of the drag link. Thus a single bell crank fitting is used to drive a pair of door panels, those panels being in adjacent discharge sections.

The door arrangement shown and described can be considered "hingeless". That is, there is no hinge along the upper edge of the door. It can also be considered "hingeless" because in an hinged door, the door extends generally as a predominantly radially extending member that sweeps out a circular sector about a fixed axis of rotation, the door panel being constrained to have a single degree of freedom, namely rotation about the hinge axis.

The door is also "hingeless" in a third context, namely that unlike door panels that are hinged along one edge, the motion of the door panels from the closed, fully flow obstructing position to the open less obstructing position facilitating outflow, neither sweeps out a circular arc, nor follows a constant center of rotation in the manner of a circumferentially moving door. Rather the upper lugs and the lower lug follow the arcs of constant radius of the connecting pivoting links of the respective four bar linkages, yielding a non-circular swinging motion of the door generally. The upper links, or first pivoting linkages of the four bar linkage may tend to be short, and to sweep through a relatively large angular arc, from the closed position in which they are in the five o'clock orientation, to the open position in which they are in the 10 or 11 o'clock position. That is, they may travel through an arc of more than 120 degrees, and possibly approaching 150 to 165 degrees. The upper edge of the door then starts its motion by moving slightly downward and away from the stationary door members, then travels predominantly upwardly, such that while the initial dz/dx may be negative, the overall dz/dx is greater than 1, if not rather much greater, e.g., greater than 3 or 4. The long, or lower, links by contrast sweep out a much shorter angular arc, and the motion tends predominantly to be longitudinal rather than vertical, i.e., overall dz/dx is less than 1, possibly rather much less, such as less than ½, and, in the embodiment shown, about 0.4. In this motion, the proximal end of the door panel is drawn upwardly into accommodation 75 during opening, and the distal end of the door ends up pointing quite steeply downward, and clearing the vertical projection of the hopper door opening. The motion of the distal edge starts out with an instantaneous dz/dx<0, such that the door falls away from the lip or land against which it mates when closed, then passes through a mid stroke point at which dz/dx=0, and then ends the stroke with dz/dx>0. Meanwhile the door panel has a rotational component of motion about its own center that starts from nearly flat (perhaps 10-15 degrees of inclination) to nearly vertical (more than 60 degrees of inclination relative to horizontal), a change of perhaps in excess of 45 degrees.

Since the swing of the bottom edge of the door depends on the location of the fixed pivot of the second link of the four bar linkage, which is much higher than the upper edge of the door on closing, the bottom edge of the door swings through an arc that is longer and shallower than if hinged on the upper edge of the door opening. Hence a larger opening is achieved (door length of perhaps 50 inches for a single door, i.e., substantially more than 3½ ft, and somewhat more than 4 ft), and a combined door length of perhaps 80 inches for a double door, i.e., substantially more than 5 ft, and somewhat more than 6 ft), that lies closer to Top of Rail (i.e., about or slightly less than 13 inches clearance when closed, as measured to the lowest point of the yoke or spreader bar; or about 16 inches, or perhaps slightly less to the lowest edge of the actual door opening lip) because the door does not swing down as far as it otherwise would if it were of the same length and hinged along one edge. At no time does the actual vertical component of displacement downward exceed the initial clearance of about 13 inches, although the distal edge of the door travels over 50 inches, or more than three times, and, in one embodiment, more than four times, the TOR clearance to the lowest point of the door assembly in the closed position. Expressed differently, if the minimum clearance to the lowest point of the bottom edge of the door seat, or seal, or lip, or surround is roughly 16 inches, the lateral travel of the distal edge of the door is more than 2½ times, and in one embodiment more than three times that minimum opening height.

While the upper end of the door moves upward, its path is into the otherwise waste space in the hollow of the structural divider, i.e., cross-member 50. As a geometric expression of this condition, it may be said that the length of the door is greater than the clearance of the first pivot pin connection at the upper edge of the door to Top of Rail when the door is closed. Alternatively, the length of the door panel is greater, in fact more than 50% greater in the one instance (112, 114), and more than 100% greater in the other (116), than the vertical distance (21") from Top of Rail to the fixed pivot point on the car body at which the first (i.e., shorter) link is connected. Another way of expressing the effect is to note that the projected length of the opening $L_{86}$ (taken as representative of a double door) is more than 60% of the double door pitch length $L_{86\text{-}88}$ length from the centerline of opening 86 to the centerline of opening 88 (or, expressed alternatively, and equivalently, the pitch from the center of one cross-member 50 to the next cross-member 50. In the embodiment shown, the ratio is more than two thirds, being about 70%. Similarly, taking the single door length, over the length of the car from the last cross-member 50 to end wall 30 (or 32 as may be), gives a ratio in excess of ¼, and in the embodiment illustrated is roughly 30%. The overall door length to car length ratio is greater than ⅖ and in the embodiment shown is about 45%.

The comparatively large size of the door opening can also be expressed as a ratio of the overall width of the railroad car. For example, the double door width may be greater than the half width of the car overall, and, in one embodiment may be more than ⅗ of the overall car width. The single door length may be more than ¼ the overall car width, and in one embodiment may be more than ⅓ of the overall car width. Or, expressed differently, the length of the double doors may be more than five times, and in one embodiment more than six times, the closed door clearance above Top of Rail when the car is standing on flat tangent track This geometry and these proportions are not mere choices of size, but rather the result of employing a four bar linkage of suitable proportions, as described.

This has several features that may be desirable. In essence, it permits a larger door to be used, closer to Top of Rail. That is, first, it permits the use of a door with a shallow closed angle (i.e., about 5 degrees from horizontal in the embodiment illustrated in FIG. 1*a*). It tends to permit the use of a somewhat longer door, and so therefore a wider discharge section throat in the longitudinal direction, which may also imply a steeper inlet slope. In either case, the resultant opening is larger thus facilitating outflow, and the lower region of the car, i.e., the various discharge sections, tend to have somewhat larger volumetric capacity, which may tend both to increase the overall lading volume and to lower the center of gravity of the car.

Figure 7A:
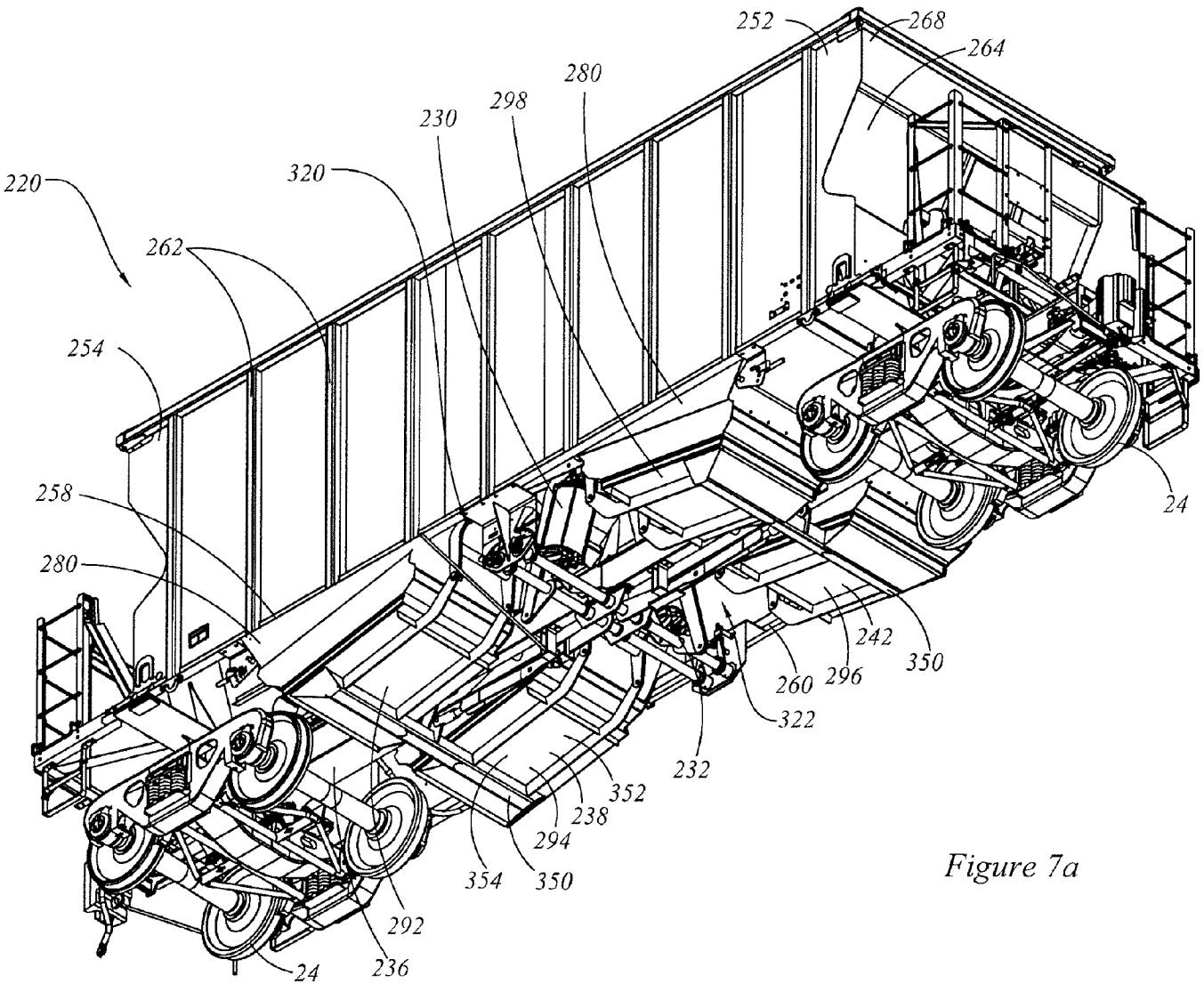
FIG. 7*a* is a perspective view from below, to one end and to one side, of an alternative railroad freight car to that of FIG. 1*a;*
Figure 7B:
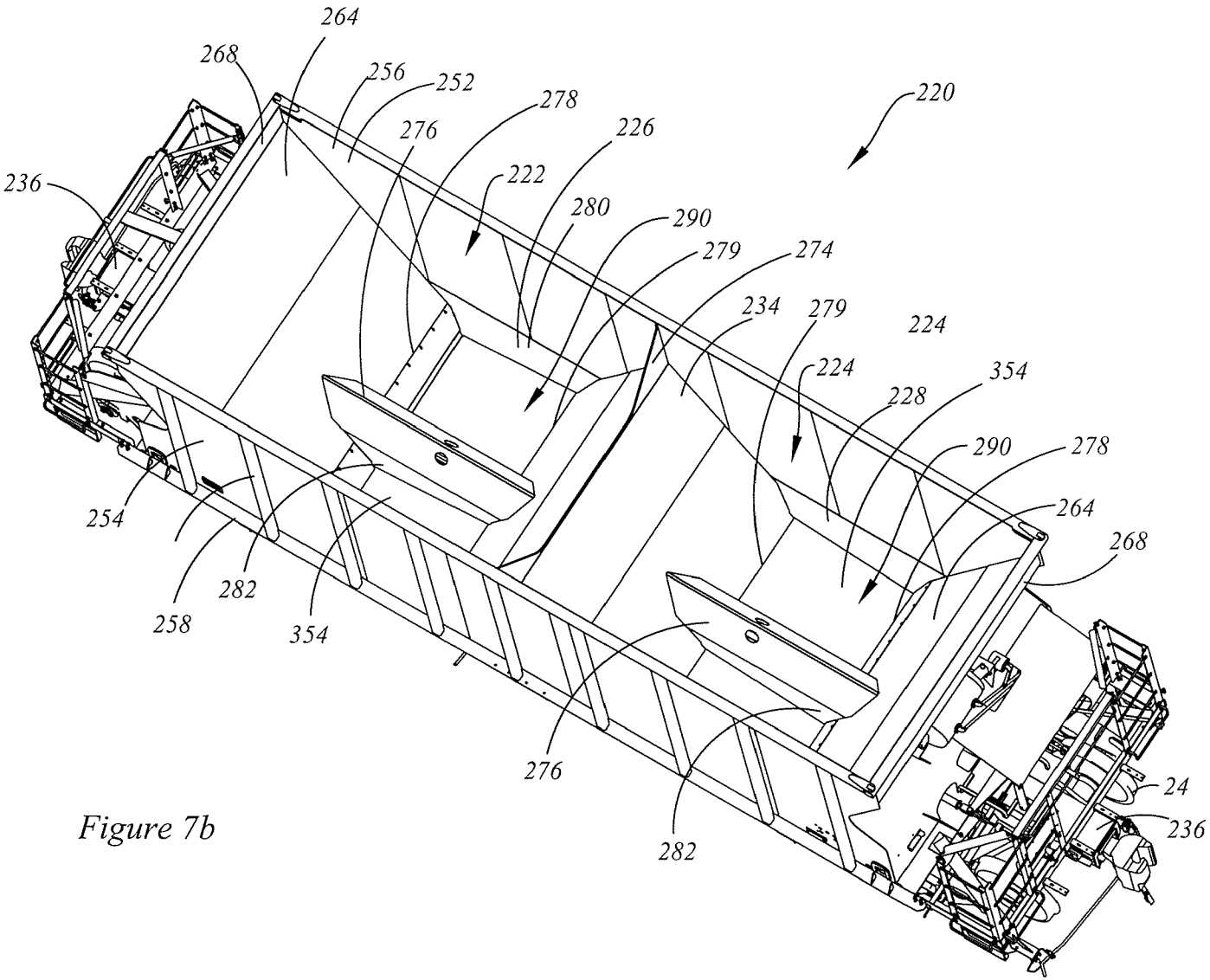
FIG. 7*b* is a view from above and to one side of the freight car of FIG. 7*a;*
Figure 7C:
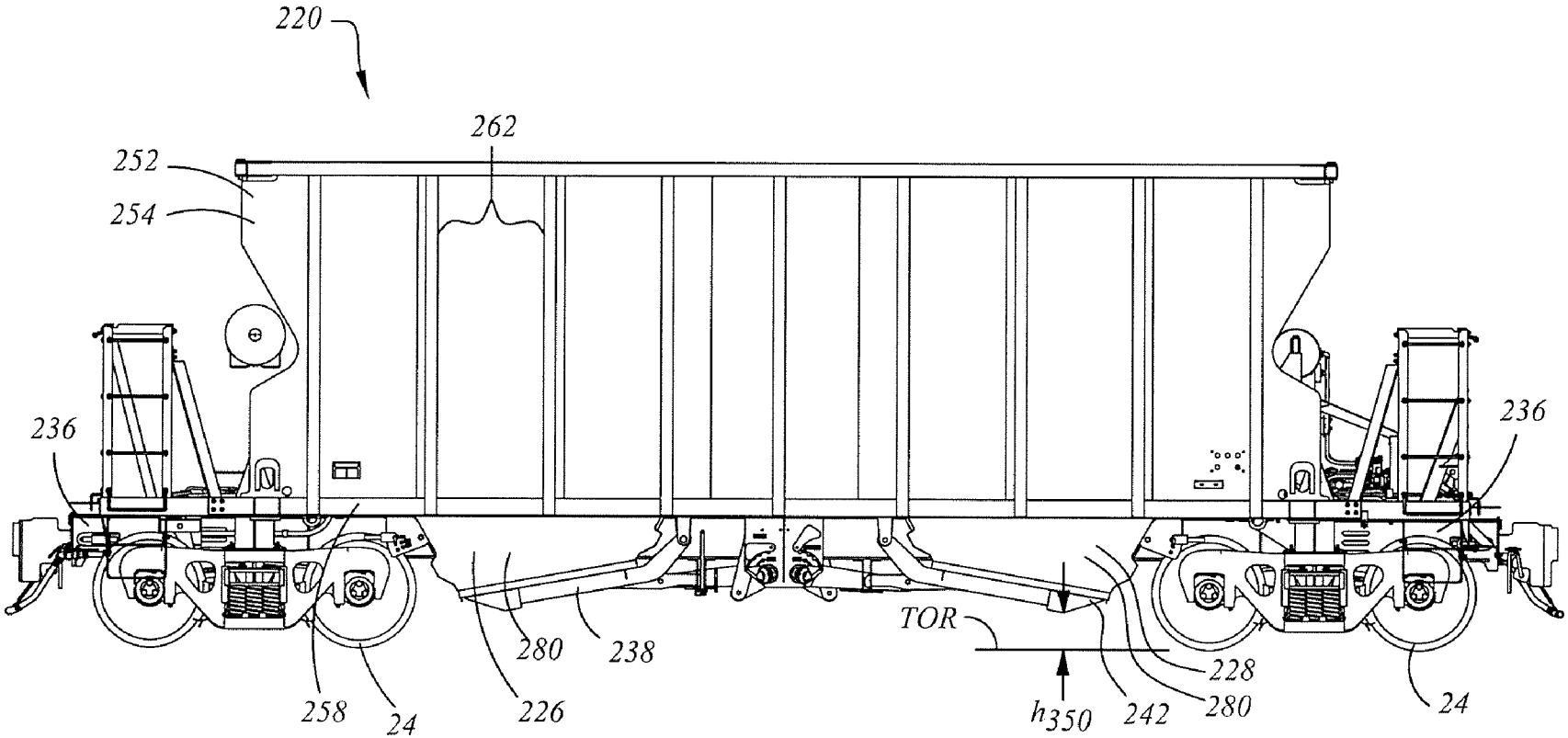
FIG. 7*c* is a side view of the railroad freight car of FIG. 7*a;*
Figure 7D:
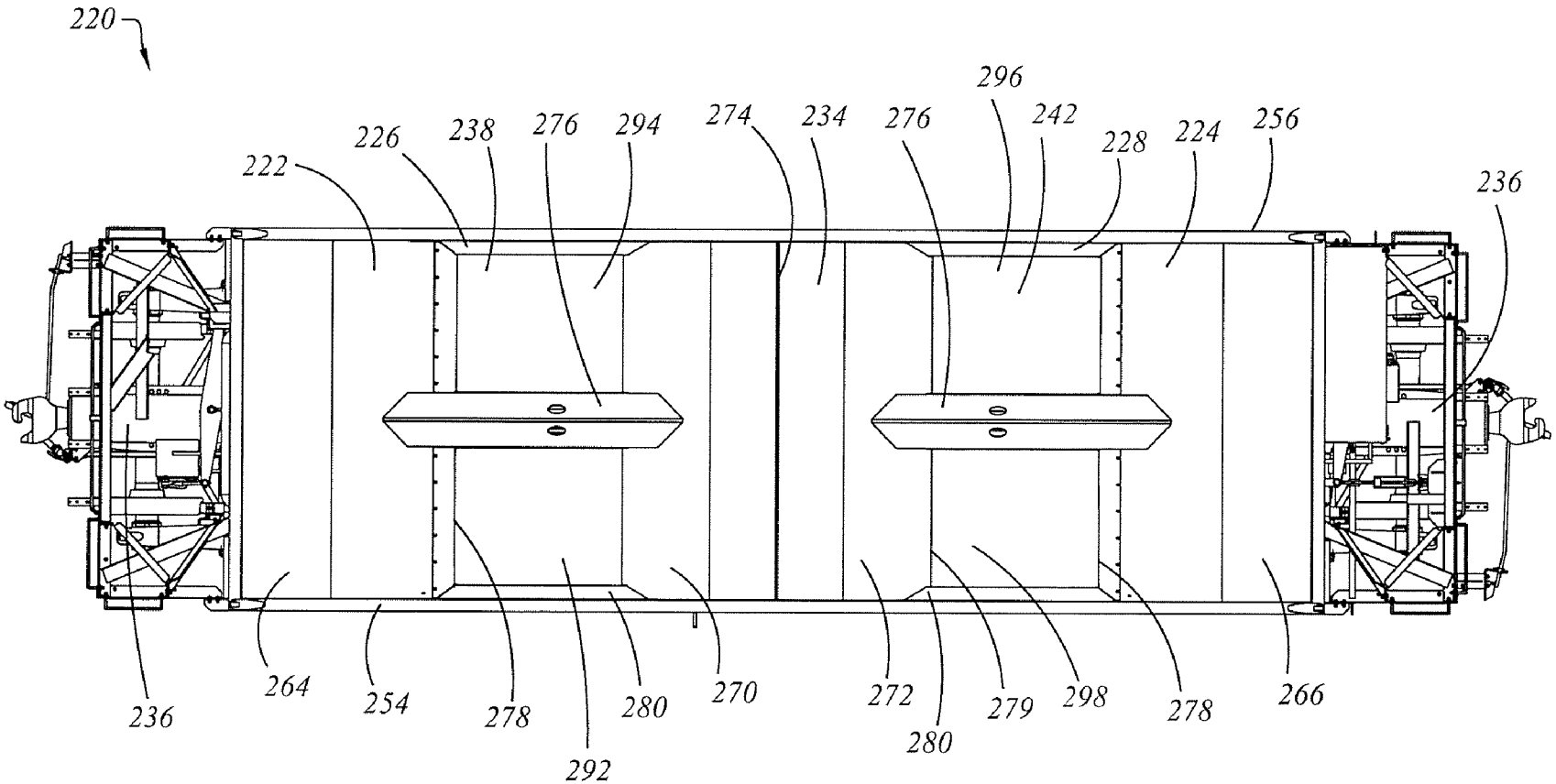
FIG. 7*d* is a top view of the railroad freight car of FIG. 7*a;*
Figure 7E:
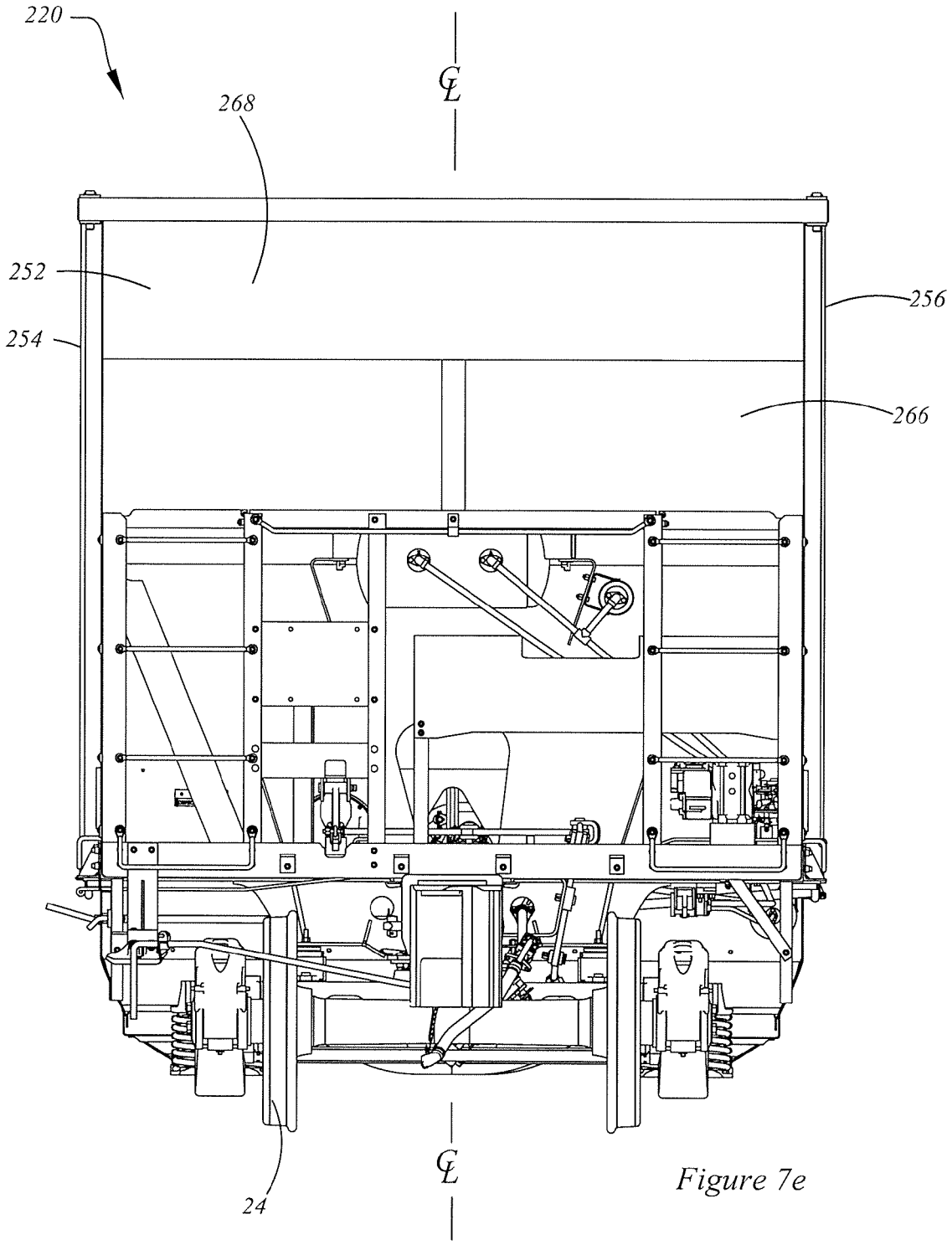
FIG. 7*e* is an end view of the railroad freight car of FIG. 7*b;*

In the embodiments of FIG. 7*a* et seq., there is a bottom dump gondola car 220. To avoid duplication of description, the general construction of car 220 may be taken as being similar to that of car 20, and the force transfer interfaces terminology, the degrees of freedom in the four bar linkages, and so on, may be taken as applicable without repeating the foregoing commentary. Car 220 has a number of feature that are different from those of the gondola car of FIG. 1*a* et seq., namely rail road freight car 20. Among the more prominent differences, whereas car 20 has a set of several pairs of doors that are all slaved together on a single drive mechanism, that is, all of the doors are driven by the motion of linkage 172, it may be that it is desirable in some instances to be able to operate less than all of the doors at one time, or through one mechanism. It may be desirable to operate a single door, or door pair, separately from all other doors, or it may be desirable to operate different groups of two or more door pairs separately from other groups or two or more door pairs, and so on. For example, it may be desired to release a portion of the lading in one place, and another portion of the lading elsewhere. Thus the rail road freight car identified as bottom dump gondola car 220 has two separate door opening actuators and drive linkage transmissions. Clearly, although two such drives are shown and described in the context of car 220 having two hoppers 222, 224, and two corresponding bottom dump hopper discharge sections 226, 228, the car could have more such hoppers and more such drives as may be suitable.

Second, whereas in car 20 the actuator cylinder is located at the end section of the car, and on the centerline such that the car has left and right hand symmetry, in car 220 the actuators, which may have the form of actuators 230, 232 such as pneumatic cylinders and pistons or rams that are located under the intermediate load shedding shroud, or hopper divider, or divider assembly, 234 between two adjacent hoppers, one being to each side of center sill 236, and each being connected to drive one set of doors. That is, actuator 230 drives a first door set 238 of hopper 222 through a first drive train or mechanical transmission 240, while actuator 232 drives a second door set 242 of hopper 224 through a second drive train or mechanical transmission 244. Although actuators 230 and 232 are in a sense symmetrically mounted on either side of center sill 236, each actuator is actually eccentrically mounted relative to the doors that it drives itself, and each actuator faces in the opposite direction in the longitudinal sense of the car as an whole. Further, the actuators are not mounted with their pistons oriented to drive horizontally, or predominantly horizontally, but rather vertically or predominantly vertically oriented such that the predominant action is up-and-down. It is this non-horizontal, inclined and predominantly up-and-down orientation that permits the actuator to be installed in the sheltered of the roomy accommodation under the intermediate divider, which may, itself, be somewhat larger than it might otherwise be to accommodate the actuators, transmission members, and so on. This predominantly vertical orientation may also tend to reduce or eliminate the need for the actuator to have a secondary lock to prevent accidental release: gravity is already preventing that release.

As above, it is often thought that it is generally advantageous for the doors to be quite low relative to top of rail, and for the stroke of the door (or third bar of the four bar linkage) at closing (or, conversely, at opening) to be predominantly horizontal, and, if nearly horizontal, for that door to be large. As discussed, this may yield a larger volume for lading at a lower level, which contributes to a lower center of gravity (C of G). It also means that the door opening may be larger, which may contribute to three generally desirable outcomes, namely that unloading can be faster, bridging of the lading within the hopper may tend to be deterred, and the fore and aft hopper discharge slope sheets leading to the doors may be either spaced further apart in the longitudinal direction, or may, for the same length of car be steeper. In either way, this last feature may tend to equate to a hopper that has a larger volume than it might otherwise have, which, in turn, may permit fewer hopper sections to be used for the same volume of lading. Fewer hopper sections may generally result in either or both of a shorter car between truck centers (usually desirable since the upshot is more lading per unit of train length) and less structure in the car. Less structure may tend to simplify manufacturing and to reduce the weight of the car. Since gondola cars of this nature typically weigh out before they bulk out (i.e., with higher density lading the car tends to reach the maximum gross weight on rail (GWR) before the lading fills the maximum lading volume of the car), less material weight in the car body means a greater capacity for lading both absolutely and in proportion to the weight of the car.

In cars of this nature, once the lading has been released, and the hoppers are empty, it is desirable not merely for the operator to be able to close the doors, but also to confirm that the doors are securely closed, typically with the release linkage locked in a self-sustaining, or self energizing state. By self-sustaining, what is usually meant is that the very presence of the lading itself, and most usually the weight of the lading, the closure becomes tighter as lading is added. By self-energizing, what is meant is that release of the door requires some kind of motion, which may be relatively slight, that increases the stored potential energy in the systems, whether that increase is in gravitational potential or in energy stored in a spring or compressed air cylinder or other means. An over-center condition in a mechanical linkage is an example of both a self sustaining and self-energizing mechanism, or apparatus have corresponding self-sustaining or self-energizing states or conditions.

Considering bottom dump gondola car 220 in greater detail, the car has trucks 24, surmounted by a car body 252 for rolling motion along railroad tracks as in the usual manner. The carbody has straight-through center sill 236 which has draft sills at either end of the car, the draft sills having draft gear and couplers as is customary. The upper structure of the car above the side sills is substantially similar to car 20. In this case, though, car 220 has two hoppers as indicated, each hopper being bounded laterally by the side beams, or side walls 254, 256 which may have side sills 258, 260, upwardly extending side sheets, and top chord members. The sidewalls may have vertical stiffeners 262 connected to, and extending up-and-down between the side sills and the top chords. The hoppers are bounded lengthwise by slope sheets, those slope sheets including end slope sheets 264, 266 at either end of the car, which terminate at vertical end walls 268; and internal fore-and-aft inclined slope sheets 270, 272, which may meet at a ridge plate assembly 274 such as shown and described in co-pending patent application U.S. Ser. No. 11/530,334 published Mar. 20, 2008 as Publication US 2008/0066642, the content of which is incorporated herein by reference. The lading containment volume or space of first hopper 222 is defined between end slope sheet 264 and first internal slope sheet 270 and includes the space lying within the side and end walls of the car thereabove. Similarly that of second hopper 224 is defined between and above second internal slope sheet 272 and second end slope sheet 266.

Skirts, or cowlings, or shrouds, or cover sheets identified as members 276 may be mounted over center sill 236, and inclined shedding sheets or skirts to discourage hang-up or accumulation of lading above the side sills as well. The lower or distal margins 278 of the end slope sheets extend to a level below the level of the side sills. Margin 278, the bottom edges of side sheet extensions 280 and of center-sill cheek plates 282, and the lower edge 279 of intermediate slope sheet 270 or 272, as may be, co-operate to define four edges of an opening 290 whence lading may exit the respective hopper, the throat so defined being, or defining the discharge section of hopper car 220 more generally. Egress of lading through opening 290 is controlled by a discharge governor in the nature of a door, or gate, or closure member, such as may be identified as left or right hand gates 292, 294 (of hopper 222), and 296 or 298 (of hopper 224). Gates 292, 294, 296 and 298 are movable through a range of motion between respective closed positions and open positions. The respective left and right hand pairs of doors are connected by laterally extending yokes, or spreader bars, or channels, that pass beneath center sill 236.

The stationary structure of the car also includes first and second main (or upper) laterally extending slope sheet reinforcement members 300, 302, which may have the form of formed channels having their toes turned inward and welded across the sheet to form a closed section. Members 300, 302 may extend the full width of the car. The stationary structure may also include lower or distal slope sheet edge reinforcements, 304, 306 which may also have the form of channels welded toes-in across the back of the slope sheet. The distal margin 308 of the end slope sheets may include a spring deflecting land or lip, such as at 310. The structure also includes end section and intermediate shear web plates or members 312, 314, respectively, that extend upwardly and laterally outwardly from the center sill to mate with the end and internal slope sheets as may be.

A machinery space, or accommodation, generally indicated as 320 or 322, is defined laterally to either side of the center sill in the lee of the internal slope sheets, laterally outboard of internal shear web members 314 and inboard of the sidewalls, such that the machinery space has a generally triangular prism shape, with the upper two sides of the triangular cylinder being defined by internal slope sheets 270, 272, and the third side being open below. This space or accommodation may not necessarily be small. For example, the open space along the bottom edge of the triangular cylinder may have a width corresponding, more or less, to two pitches of the vertical stiffeners of the sidewalls, as shown in FIG. 7*a*. This distance may be of the order of 6 ft. The distance from the bottom of the sidesill to the apex at which the internal slope sheets meet may be something of the order of more than ⅖ of the overall wall height from side sill to top chord, and in one embodiment may be more than half that height and less than ¾ of that height. The height from side sill to top chord may be, for example, perhaps 8 ft, and the height to the apex at which the internal slope sheets meet may be about 5 ft-6 ft. It is generally desirable for the slope sheets to be relatively steep to discourage hang-up of the lading. In one embodiment the angle of the slope sheets may be about 60 degrees as measured from the horizontal. Other suitable angles could also be used.

The adjacent left and right hand machinery spaces 320, 322 can be thought of as a single machinery space having first and second portions lying to opposite sides of the center sill, or as a pair of first and second, left and right hand adjacent machinery spaces located on opposite sides of the center sill with lengthwise operating drive train members mounted to work along, parallel to, or in the plane of the center sill. However this space, or these spaces, may be considered, they may accommodate in whole or in part (a) a four bar linkage mechanism indicated generally as 324 that includes each door assembly; (b) a linkage drive train or mechanical transmission assembly, indicated as 326; and (c) a drive or power source, 328, which in this instance may be represented by a pneumatic cylinder and ram or piston 330 (in space 320) or 332 (in space 322).

Like car 20, car 220 has "hingeless" door assemblies, using four bar linkages instead. In car 220, the first "bar" of the linkage is the base, or reference, or datum member, which may be considered to be stationary. That member may be considered to be the rigid primary structure of the car body, notionally indicated as 334. The second bar of the linkage is arbitrarily chosen to be the first, or long, or primary, or main member, or pivot arm 336. The third bar of the linkage is the door assembly, 338. The fourth bar of the linkage is the second, or short, or secondary member, or lever arm, or pivot arm 340.

First pivot arm 336 is, in effect, two mated bar members, or plates, or arms, mounted symmetrically on the longitudinal centerline of the car laterally inboard of to either side web of the center sill, the center sill having a top flange, bottom flange and pair of first and second webs. The bottom flange and top flange of center sill 236 have apertures or slots formed therein to accommodate first pivot arm 336 such that it may swing therealong through the center sill without obstruction. A footing, or anchor plate, or base plate, or lug, indicated as plate 342 is rigidly mounted to the center sill 236 above each of the side webs of center sill 236 in the corresponding vertical planes of those center sill webs, extending upwardly therefrom in a somewhat triangular or peaked manner, with a shaft fitting or bushing and a pin mounted at the upper vertex to pick up on the base, root, or first end pivot connection 346 of first pivot arm 336, this being the location at which the second bar of the four bar linkage is pivotally fixed to the reference structure. The two spaced plates that co-operate to define first pivot arm 336 also have an intermediate pin, or stop member, 344 mounted crosswise between them roughly midway along their length. At the far or distal, or free, end of first pivot arm 336 there is a further pivot pin connection 348 to a lug mounted on the yoke or door reinforcement or spreader bar 350 of door assembly 338. First end pivot connection 346 is located at a longitudinal position along the center sill that is intermediate the vertically projected positions of the fore and aft door margins, 278 and 279. In one embodiment, the longitudinal location of connection 346 is between ¼ and ½ of this distance, being closer to margin 279.

Door assembly 338 includes a pan assembly 352 which includes the large rectangular lading-containing surface plate 354, and laterally inboard and laterally outboard upturned flanges indicated generically as 356. The two adjacent left and right hand door panel portions are slaved, or yoked, together with a common spreader bar 350 that runs along the back of the door panels relatively close to the distal margins of the doors. Each distal margin also includes a box-like set of reinforcement plates, including an angled closure plate 360 running from the back of the spreader bar to the distal edge, such that the door may be used as a plow in some circumstances. The doors also include lateral reinforcement flanges 364 running adjacent to the proximal margins of the door panels. Further the doors each have a pair of laterally spaced, longitudinally running stringer members, or arm members 368, 370 that run in the lengthwise direction of the doors, with one end terminating at, and welded to the spreader bar, and the other end having a dog-leg bend, the dog leg end 372 having a final pivot pin fitting at which the assembly is pivotally linked to the second or short pivot arm of the four bar linkage. It may be noted that the second or short pivot arm is actually two laterally spaced apart, dog-legged arms, 374, 376 that are slaved together by a common linkage 378 in the form of cross-wise extending torque tube welded between them.

Door assembly 338 also includes drive transmission assembly 326. Each pair of doors has a drive transmission assembly 326, those drive transmission assemblies 326 being mounted back-to-back and sharing the same mounting fittings at the side sills and center sill, namely side sill mounting suspension brackets 380, 382, and center sill suspension mounting brackets 384, 386, which, as their names suggest, are mounted to depend from the side sills and center sill respectively. Each mechanical drive transmission assembly 326 has a first transmission member in the nature of a drive shaft or torque tube 388 extending cross-wise relative to the car body, slung to pass below, and clear of, the center sill. Each torque tube 388 carries a torque input member, or force and displacement input member, in the nature of a crank arm 390 such as may be welded thereto. It may be noted that crank arm 390 is not located on the car centerline, but rather is eccentric relative to the centerline, being offset laterally to one side thereof, and lying intermediate the center sill and the respective side sill. This offset corresponds to the lateral offset of motive power drive 330 (or 334 as may be). Each drive transmission assembly also includes an output force and displacement, or member, or output motion transmission assembly, 392 in the nature of an over-center linkage 394 that may include a first portion 396 rigidly mounted, e.g., by welding, to torque tube 388, and a second, double-shank portion 398 pivotally mounted to the end of first portion 396 and also having an end fitting in the nature of a slack adjuster 400 pivotally mounted to a lug welded to the spreader bar. Each half of portion 398 has an horn 402 that engages an over center stop plate 404 mounted to first portion 396, such that when the door mechanism is closed, lading on the door will tend to drive the mechanism more firmly into the over-centered, and therefore locked, condition.

The inventors believe that it is known to install a pneumatic actuator atop the end section shear plate of the car, with the cylinder working horizontally along the centerline of the car to drive a door operating linkage. In the embodiment illustrated in FIG. 7*a* et seq., the pneumatic actuator arrangement differs from this layout. Pneumatic actuators 330, 332 are not mounted at the respective ends of the car. They are not mounted over an end section horizontal main shear plate of the end section (indeed, it may be that neither car 20 nor car 220 has an horizontal main shear plate). They are not mounted long the centerline of the car. They are not mounted with the piston aligned in an horizontal plane. On the contrary, actuators 330, 332 are each located at an intermediate span location between the trucks, and, indeed, in the accommodation intermediate two adjacent hoppers, transversely offset from the longitudinal centerline of the car to either side respectively.

Figure 11A:
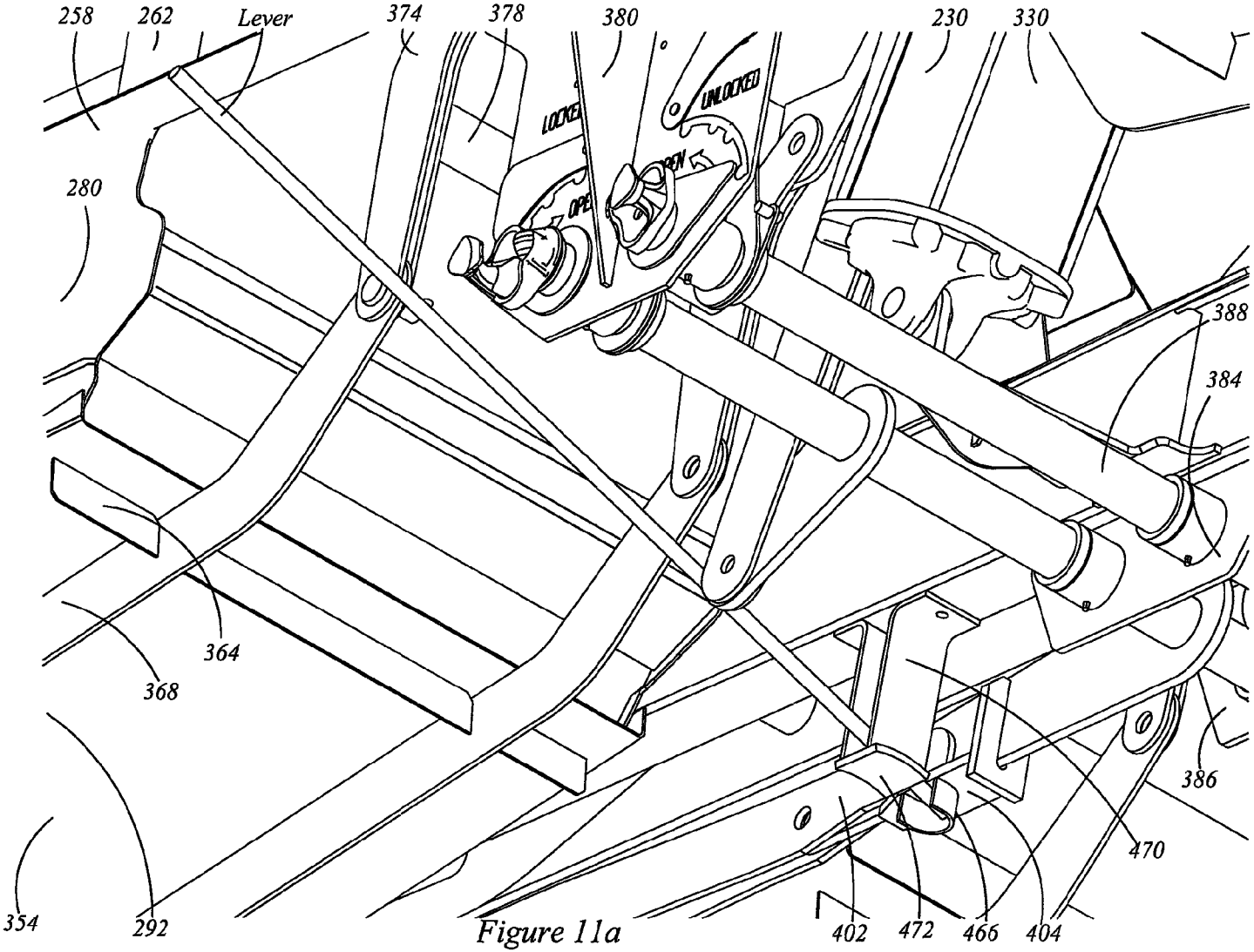
FIG. 11*a* shows a lever mechanism for manual release of the door assembly of the railroad freight car of FIG. 7*a;*
Figure 11B:
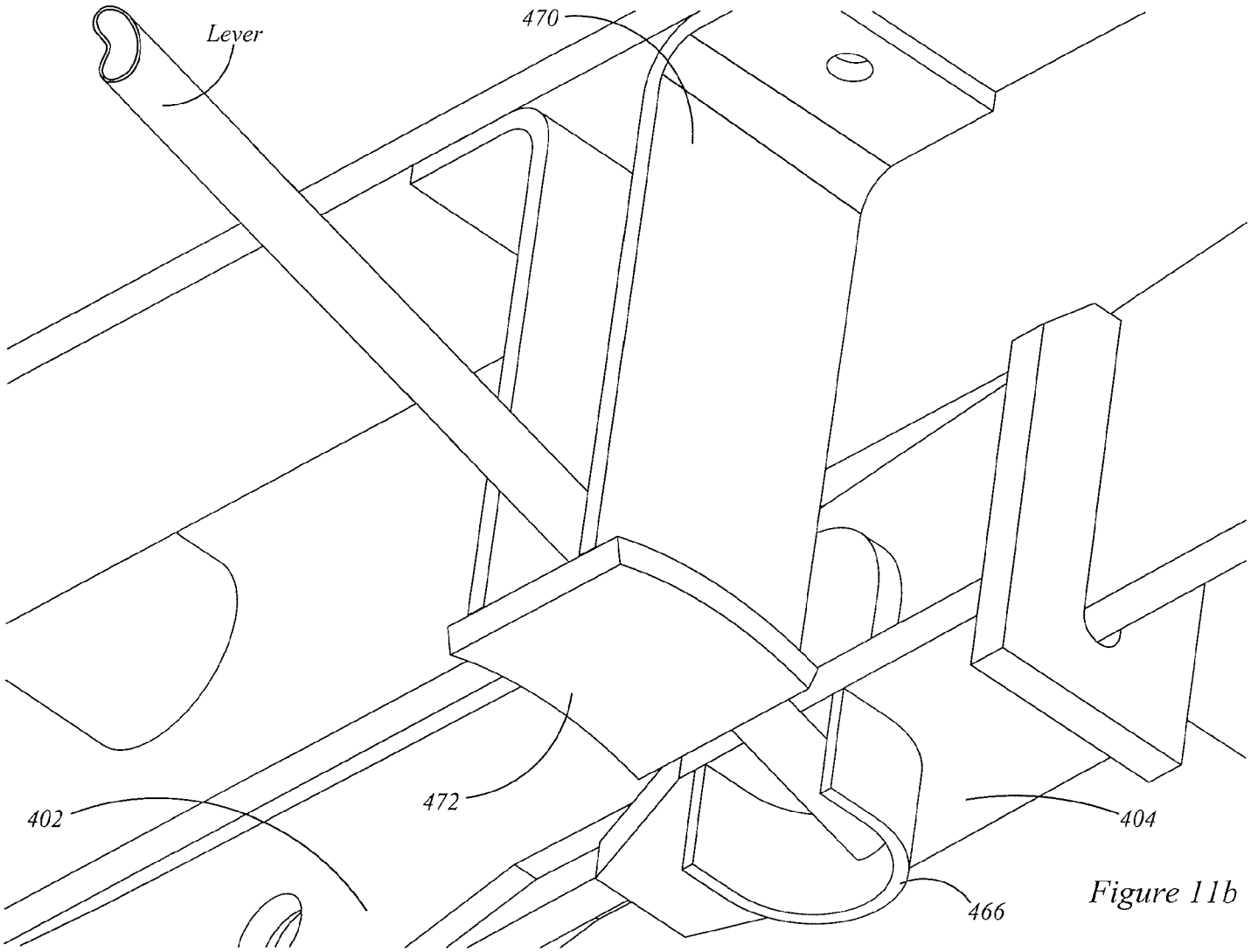
FIG. 11*b* shows an enlarged detail of a portion of the mechanism of FIG. 11*a*

To that end, car 220 has cantilevered lug support arms 410 (shown in FIG. 11*a*) mounted on opposite sides of the center sill, each cantilevered lug support arm carrying at its distal extremity transversely outboard of the center sill an actuator connection fitting, such as an eye, lug 412. Support arms 410 associated with actuators 330 and 332 respectively may be mounted directly in line with each other on either side of the center sill such that there is flange and web continuity across the center sill. The lower end pivoting lug connection of each actuator 330, 332 is then pivotally connected by a pin to lug 412. The lug or fitting at the upper end of the actuator, be it 330 or 332, namely the end fitting or lug of the ram itself, is pivotally connected by a pin to the "free" or swingingly displaceable end of an intermediate transmission lever 416 that has its first end pivotally connected to primary structure, i.e., the reference datum, as at lug 418 mounted to the transverse stiffener of internal slope sheet 270 or 272.

Figure 8A:
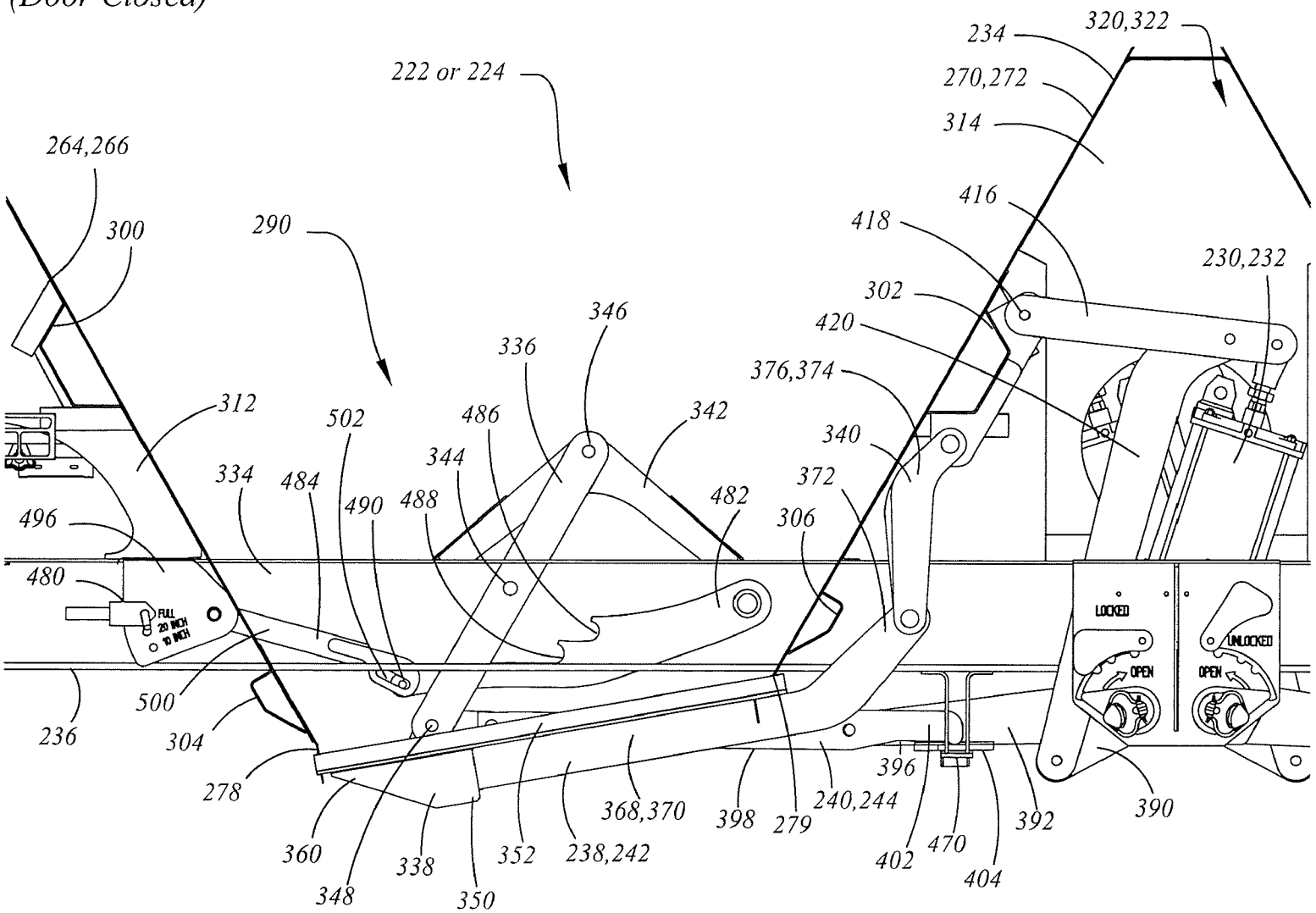
FIG. 8*a* shows an enlarged sectional detail of a door operating mechanism of the railroad car of FIG. 7*a* in a fully closed condition.
Figure 8B:
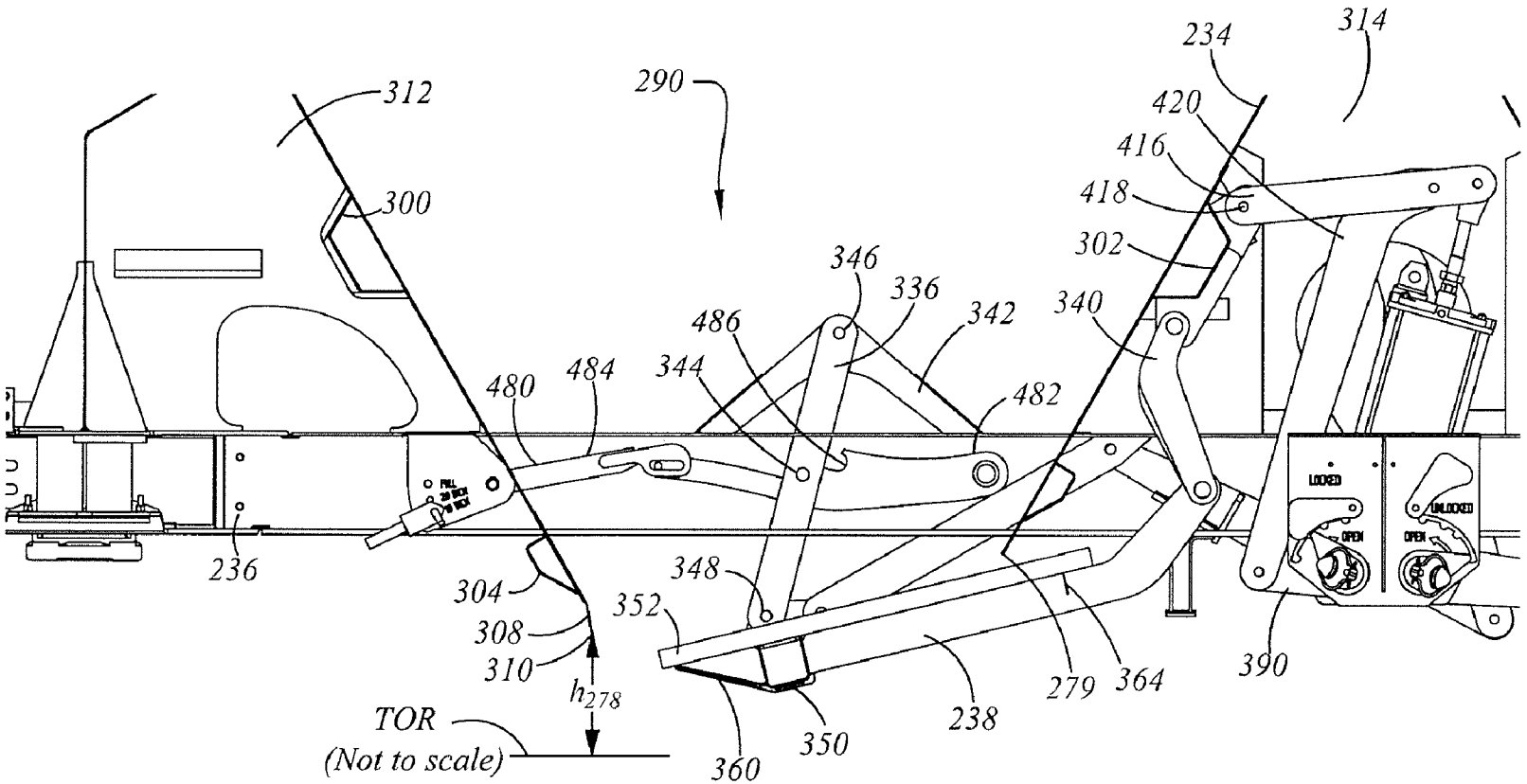
FIG. 8*b* shows the enlarged sectional detail of FIG. 8*a* in a 25% open position or condition.
Figure 8C:
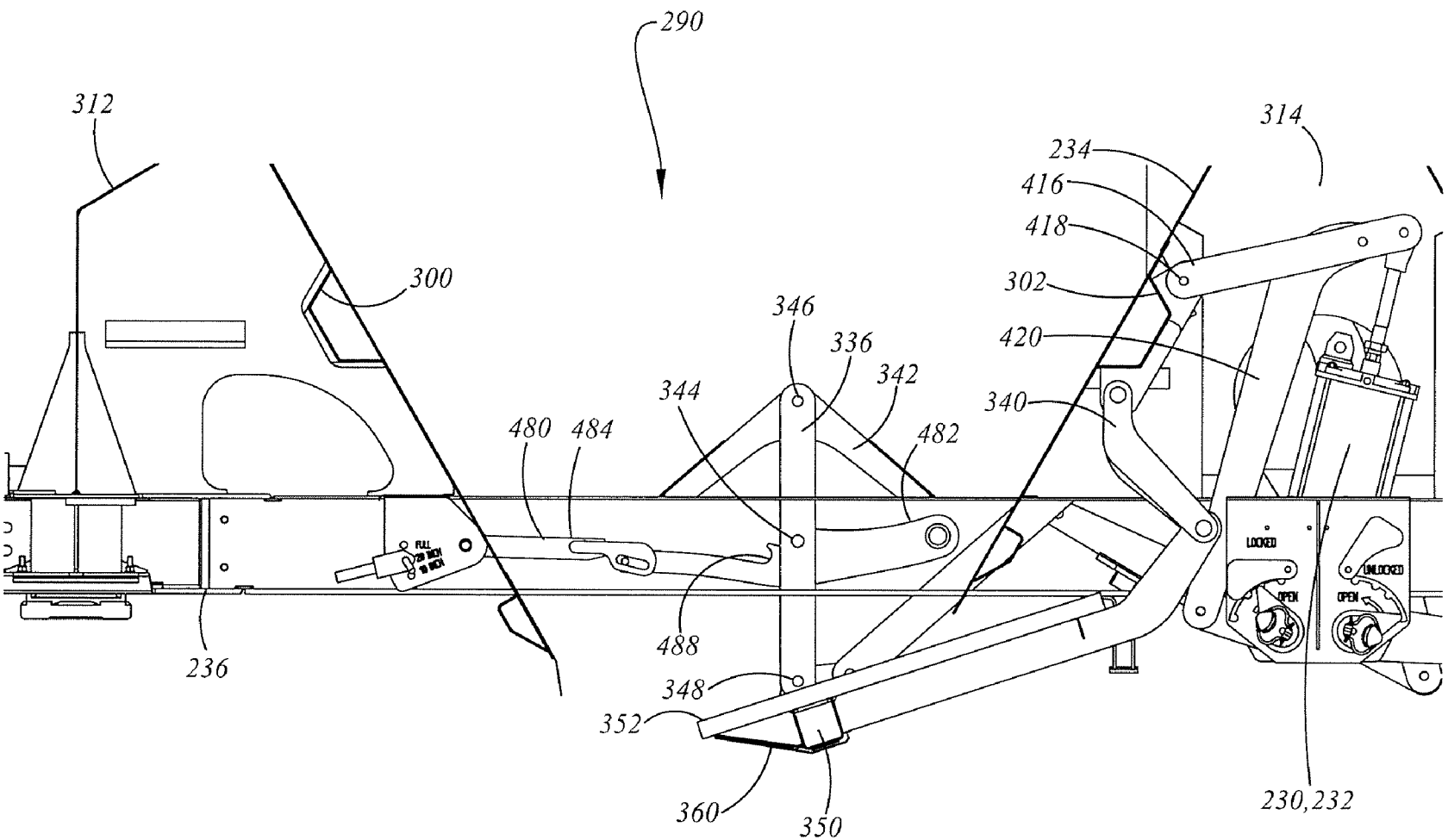
FIG. 8*c* shows the enlarged sectional detail of FIG. 8*a* in a 50% open position or condition.

A connecting rod, or force transfer bar or link 420 is connected at one end, the upper end, by a pivot pin to lever 416 adjacent to the end connection of the actuator. The second, or lower end of link 420 is pivotally connected by a pin connection to the radially outermost end of crank arm 390. The actuator, be it 330, or 332, the ram inside the actuator, lever 416 and the primary structure of car 220 define another four bar linkage, such that ever position of the pneumatic ram yields a particular, unique, output position of link 420, and therefore of crank arm 390. Link 420, in effect, merely transfers this motion from a high location, above the actuator, to a low location at crank arm 390. When the ram is fully extended, the door is open. When the ram is fully retracted, the door is closed, and locked over center. As may be noted, actuators 330 and 332 are predominantly upright, or substantially vertical when the car is seen in side view as in FIG. 8*a*. That is, the orientation is more vertical than horizontal, the actual angle of inclination being variable during operation in a range of perhaps 60 or 65 or 70 degrees to about 80 or 90 degrees from horizontal over the range of motion. In one embodiment the range is from about 70 degrees when the door is fully closed to about 85 degrees when the door is fully open. Since the output end of the ram is uppermost, gravity will tend to urge the ram to the retracted position, corresponding to the closed position of the door when the system is unpowered (i.e., no air pressure, or reduced air pressure). This is a fail safe condition tending not to trip the over-center lock of the transmission assembly, thus the assembly does not have a "secondary lock" as a back up, gravity on the ram performing that function by default.

In operation, as shown in the evolution of positions shown in FIGS. 9*c*-9*f*, the motion again includes an initial motion to lift the door panel off its seal, or seat. This "lift" is actually a motion having a downward component, or drop, or at least a component of motion normal to the seat, which itself is inclined at a small angle. Thus the initial motion at both ends of the door assembly has a dz/dx component that is negative to separate the door panel from the footprint of the surrounding edges of the opening. Thereafter, the dz/dy component of motion of the rear link becomes strongly positive, the shorter link traveling through more than 120 degrees of arc. The dz/dx motion of the front margin passes through 0 at mid stroke, and becomes increasingly positive toward the end of stroke. The overall dz/dx of the front portion is a few inches, considerably less than half the vertically projected opening length of the door. The motion of the forward edge of the door is predominantly horizontal. Similarly, the motion of the rearward edge is predominantly vertical, with and overall dz/dx of more than 3, and in one embodiment more than 4. As above, the clearance of the spreader bar ($h_{350}$) in the closed position is about 13 inches, and of the lowest portion of the edge of the opening ($h_{278}$) is about 16 inches, both as measured from TOR. The various ratios discussed above in the context of car 20 also apply. The overall ratio of projected door length to clearance height may be greater than 4 relative to the spreader bar, and more than 3 relative to the lowest portion of the opening edge. As with the doors of car 20, given that the door panel is mounted to a set of long linkage pivot arms and short linkage pivot arms (i.e., linkages, or bars of unequal lengths) the door assemblies of car 220 may be both hingeless, and travel in a non-circular path, i.e., a path without a fixed, unique center of rotation. Further, in both cases the doors travel in a longitudinal-vertical plane, i.e., although the doors have a breadth in the transverse direction, during operation any given point on the doors travels in a longitudinal vertical plane, substantially parallel to the vertical plane of the center sill.

Figure 9A:
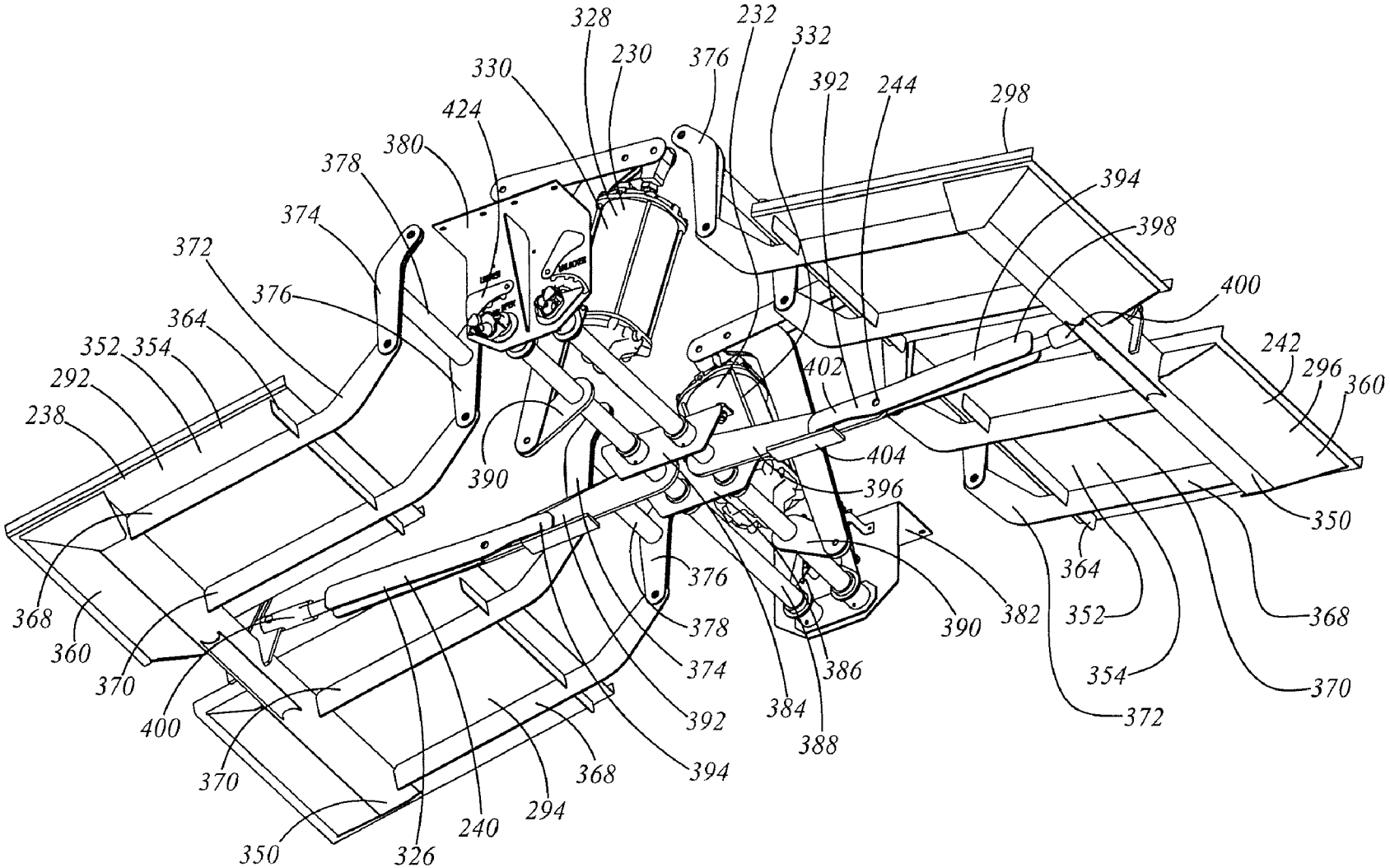
FIG. 9*a* shows a perspective view from below of the door opening mechanism of FIGS. 8*a* to 8*d* with all other car structure removed, in the closed position with the drive members in their full closed, or locked and over-center condition.
Figure 9B:
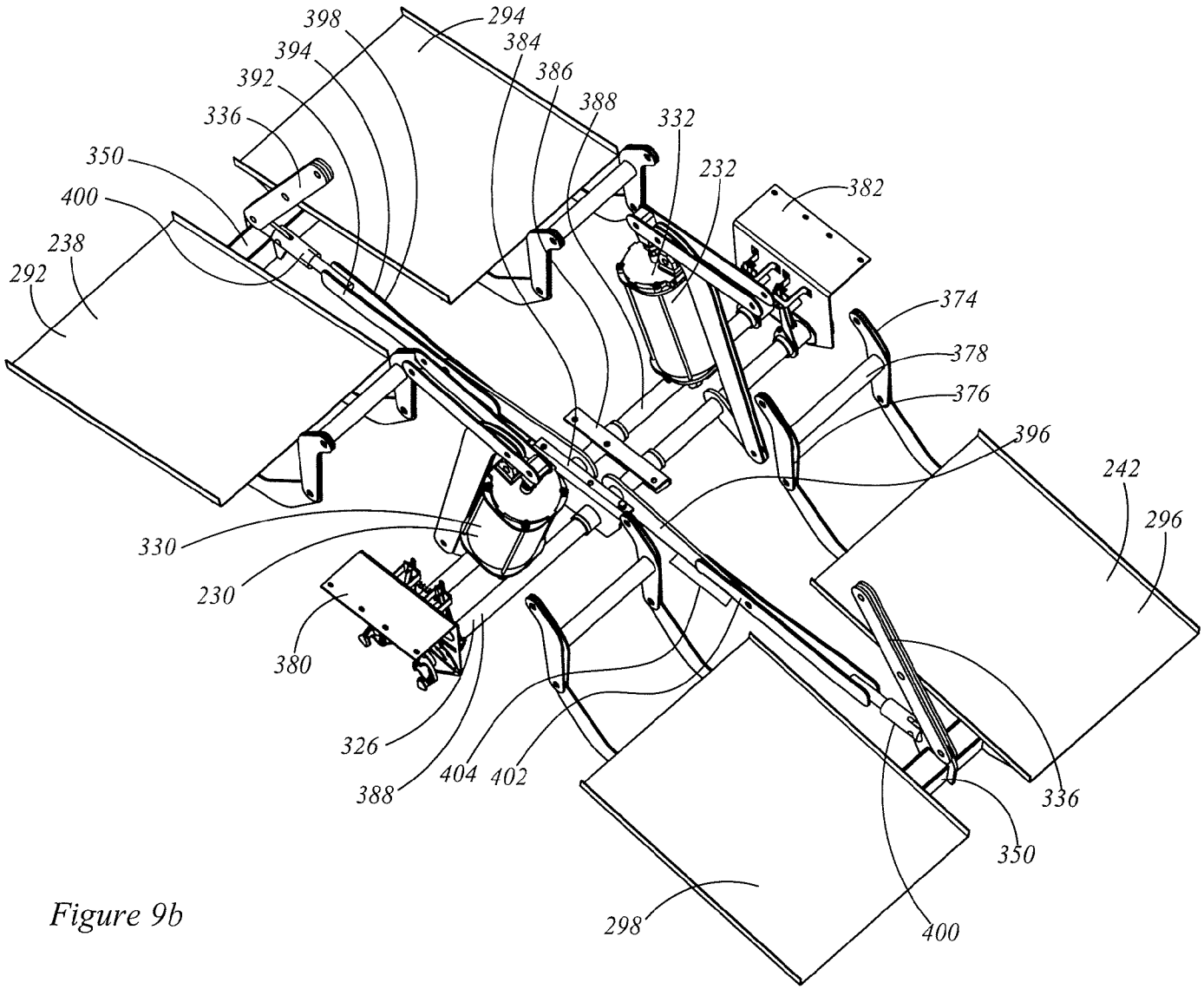
FIG. 9*b* shows a view of the door opening mechanism of FIG. 9*a* from above.
Figure 9C:
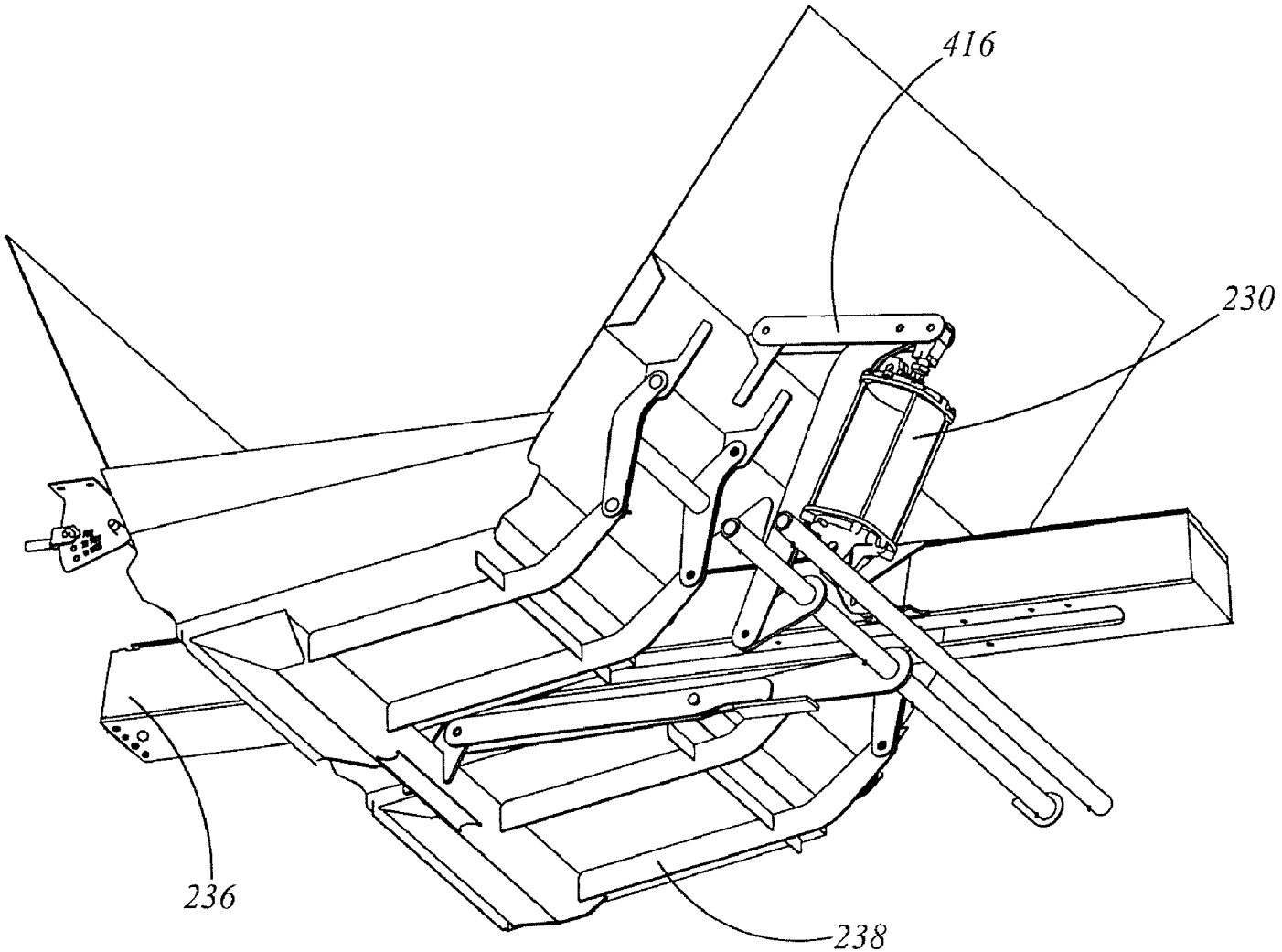
FIGS. 9*c* to 9*f* show the door opening mechanism of FIG. 9*a* in the 25%, 50%, 75% and 100% open position or condition.
Figure 9D:
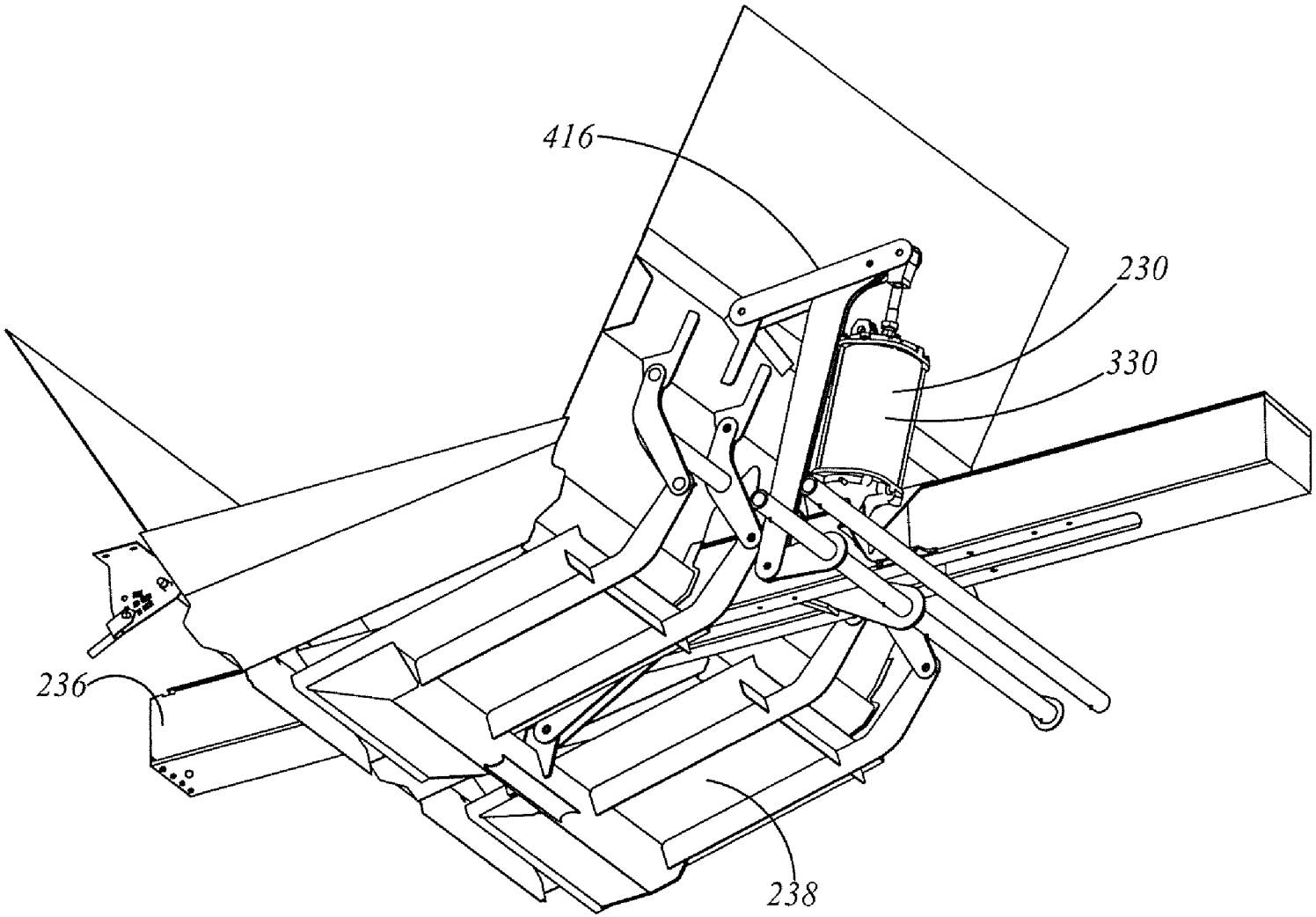
Figure 9E:
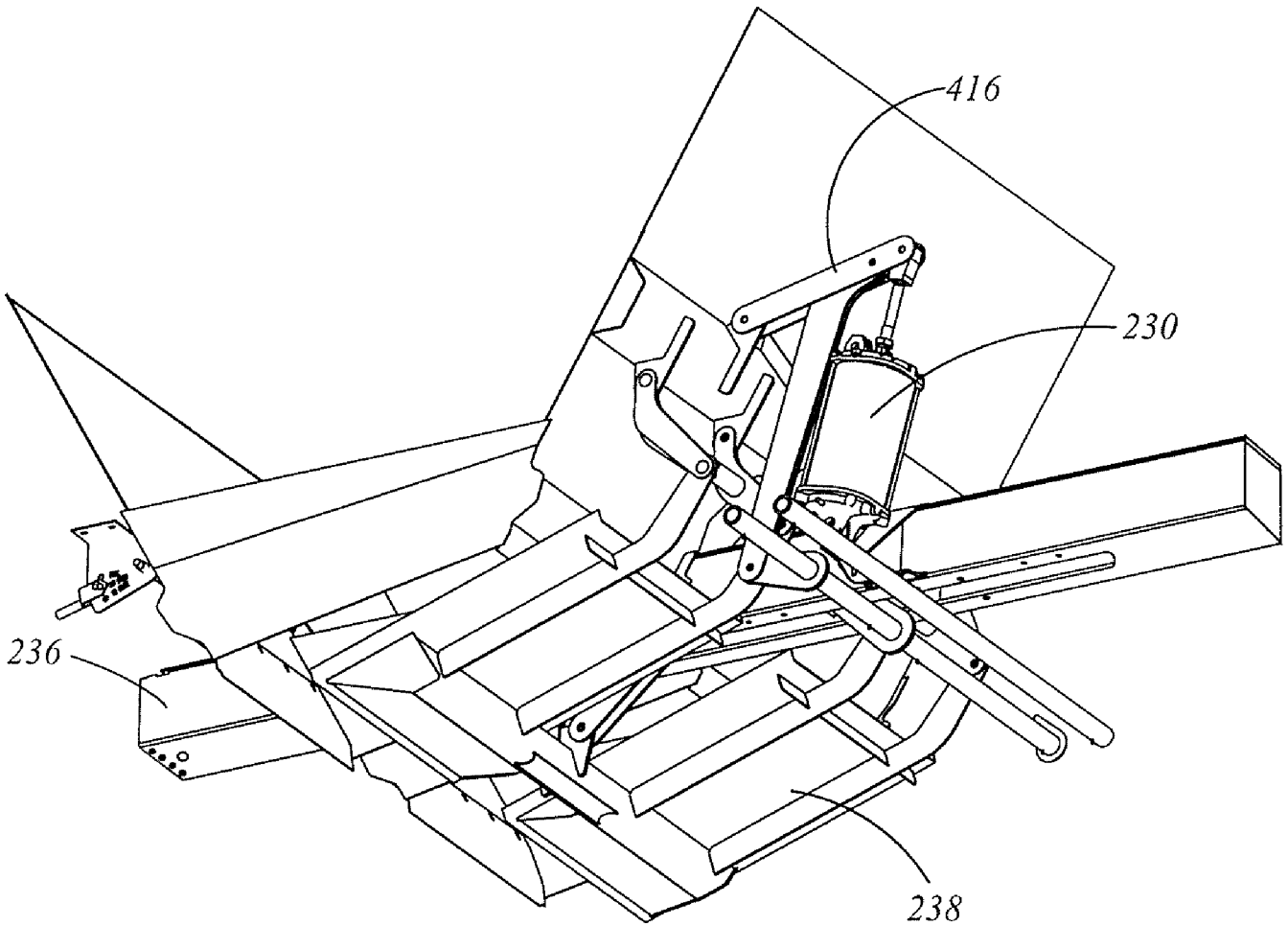
Figure 9F:
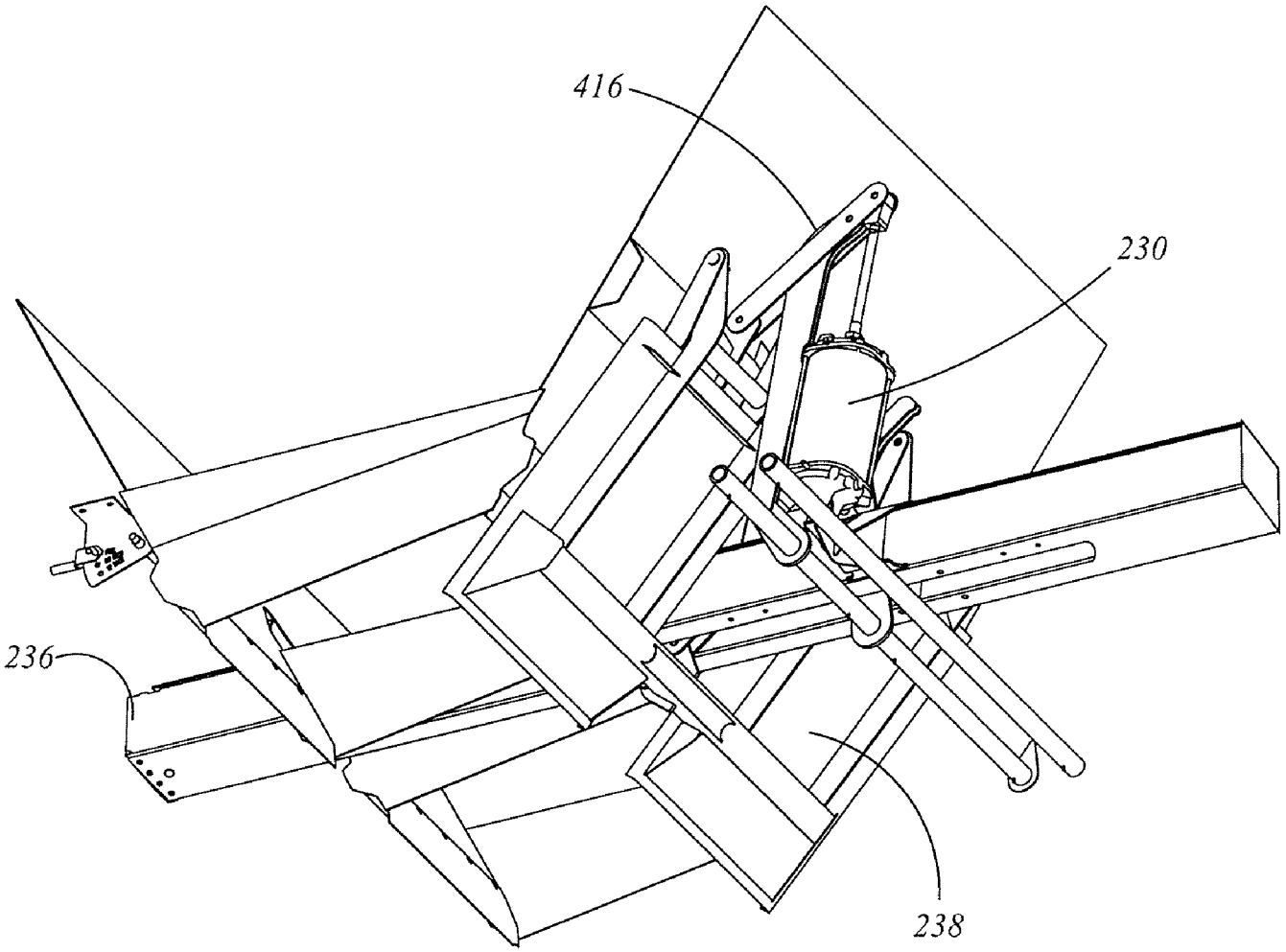
Figure 10A:
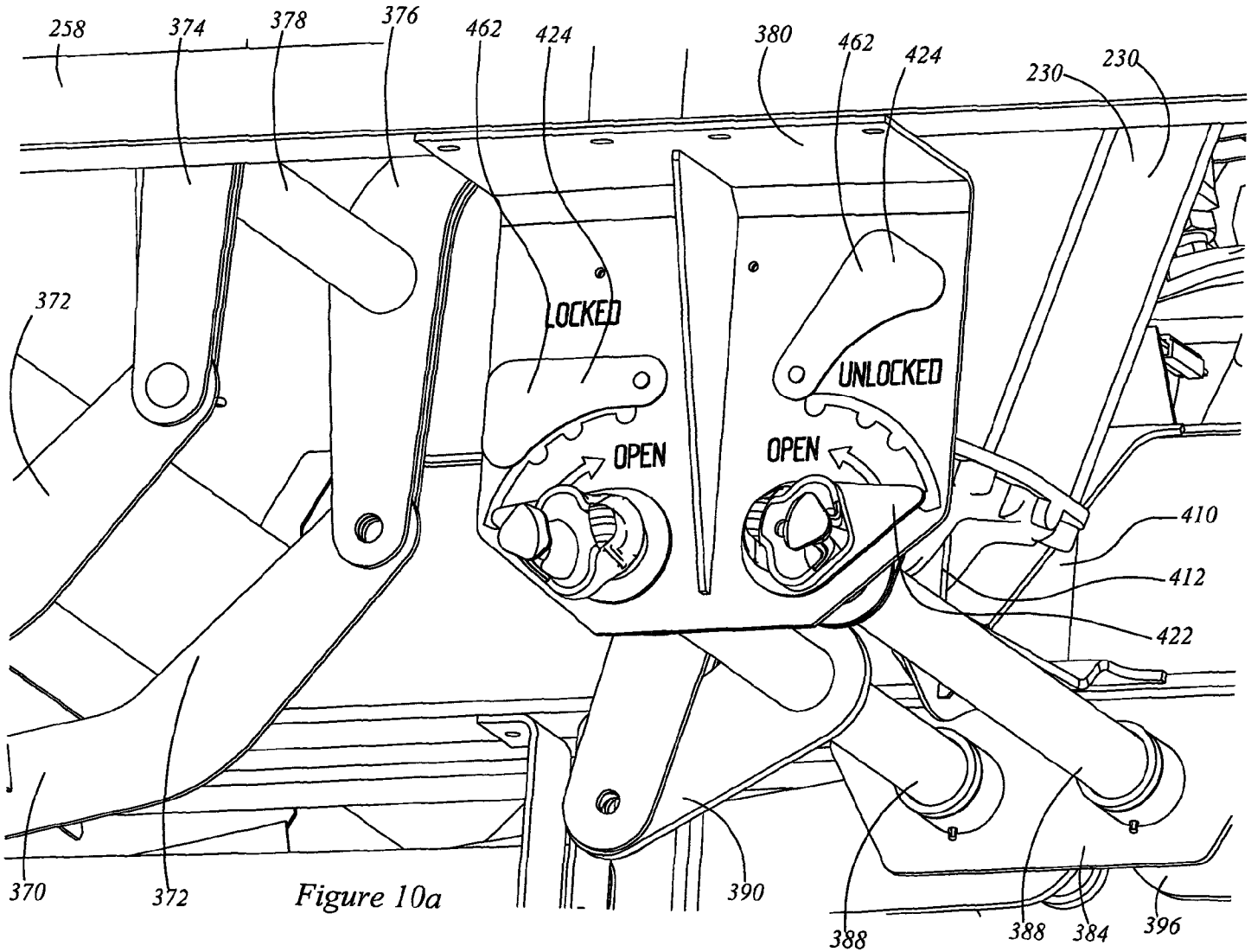
FIG. 10*a* shows a perspective detail of a front face of a door mechanism position indicator assembly of the railroad freight car of FIG. 7*a;*

As shown in FIGS. 9*a* and 10*a*, the mechanical transmission torque tubes of the door assemblies extend the full width of the car across the side sills. The depending side sill brackets 380, 382 that carry the end of the torque tubes also carry position indicia for each of the door drive tubes or shafts, such that a person at track level can tell from either side of the car whether the doors are open or closed, or, if closed, whether closed and locked. The position indicators include an angular pointer 422, and a lock condition indicator 424, such as may have an appearance somewhat like a mailbox flag. The pointer, 422, is mounted directly to the end of the torque tube, and the faceplate has detents at the fully closed, ¼ open, ½ open, and fully open conditions.

Figure 10B:
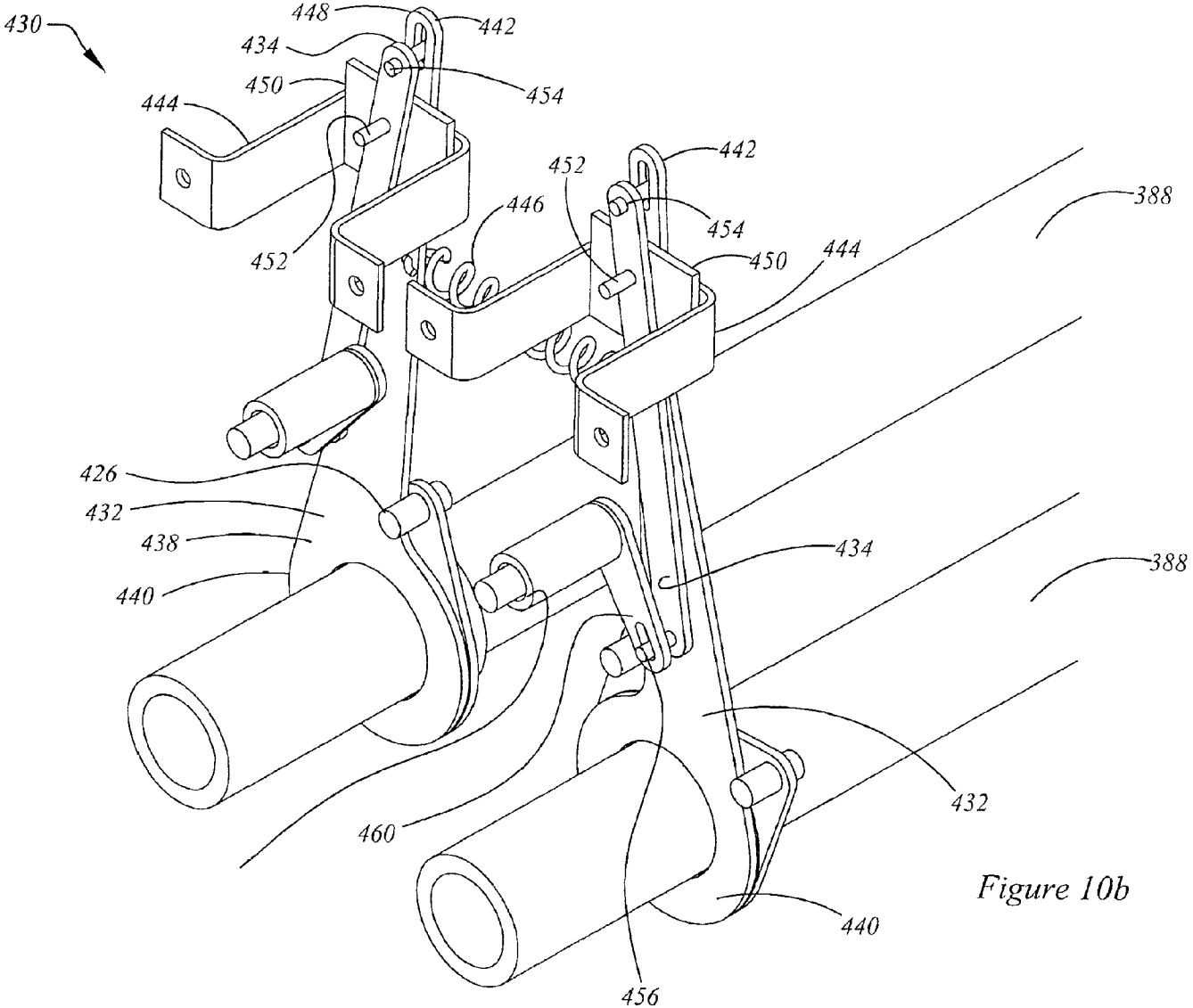
FIG. 10*b* shows the door mechanism position indicator assembly of FIG. 10*a* with the face plate, manual actuator fitting, and pointers removed.
Figure 10C:
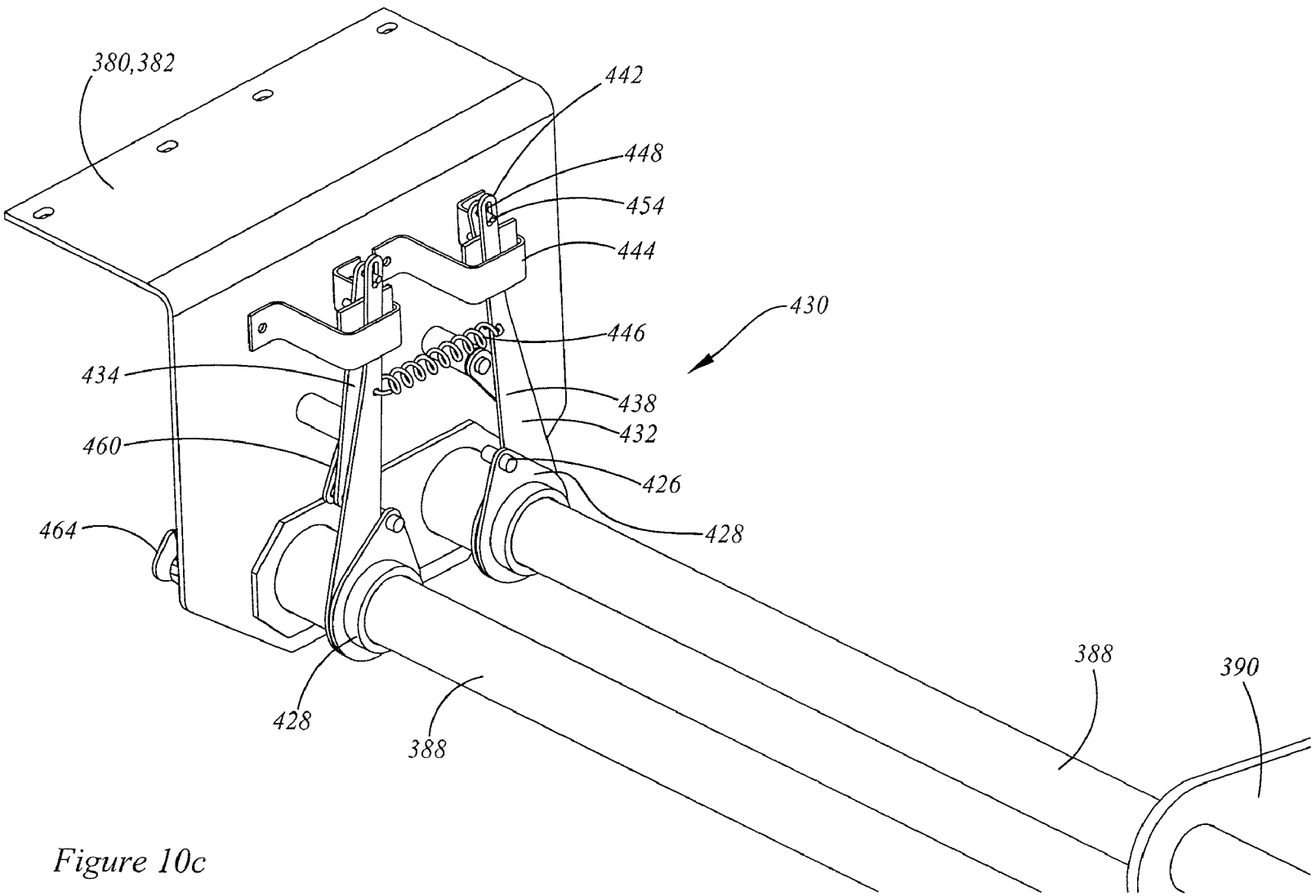
FIG. 10*c* shows a view of the door position indicator assembly of FIG. 10*a* from inside and above the side sill.
Figure 10D:
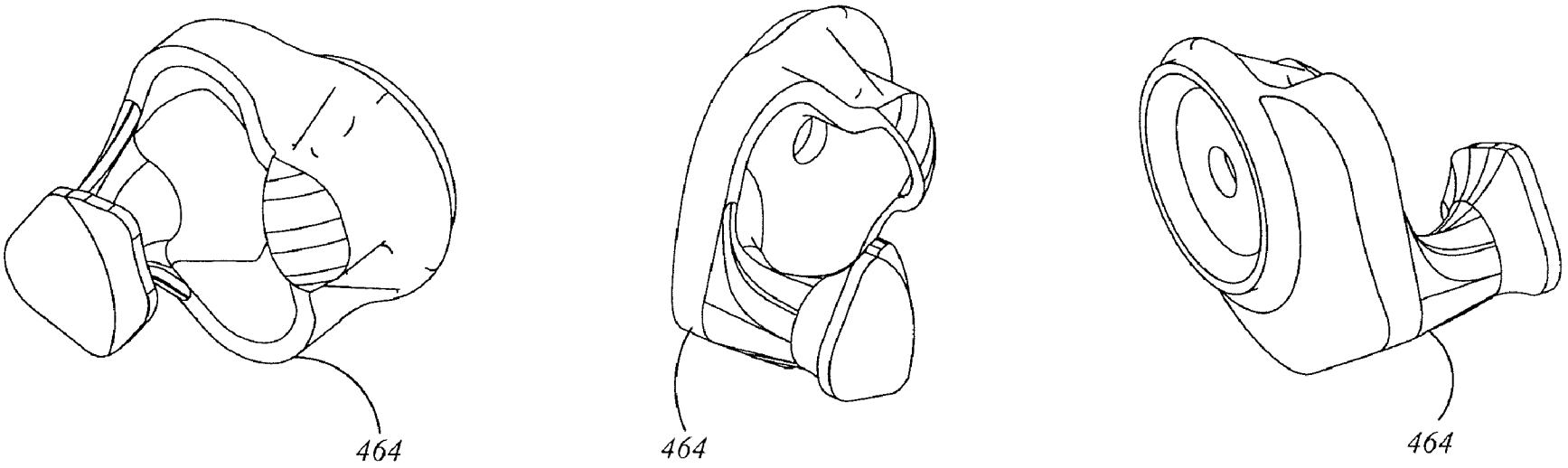
FIG. 10*d* shows three views of the manual door closure fitting of the door assemblies of the railroad freight car of FIG. 7*a;*

The lock-unlock condition indicator 424 is shown in FIGS. 10*b* and 10*c*. Each shaft, or torque tube has an output signal member, such as pin 426, whose angular position is rigidly linked to the angle of rotation of the torque tube. When the tube turns, the pin sweeps through the same angle of arc. To this end pin 426 is mounted in a ring or collar 428 that is rigidly mounted to the shaft or tube in question. Through most of the range of motion, pin 426 travels free. However, a small angular distance from end of travel, such as perhaps about 3 degrees before end of travel, pin 426 encounters a mechanical motion amplifier 430.

Amplifier 430 includes a first lever 432, a second lever 434, and an output member, 436. First lever 432 may have the form of an arm 438 that floats free of the respective torque tube, i.e., the torque tube shaft can turn without turning the arm. This "float" may be achieve by providing a loose fitting ring 440 at on a first end of arm 438, the loose fitting rings fitting over the respective torque tube. The range of motion of the second end 442 of arm 438 is constrained to lie within a retainer 444 which may have the form of a U-shaped bracket rigidly mounted to the main bracket. Second end 442 is then constrained to move only within the range of motion permitted between the legs of the U. Second end 442 is biased toward one side of the range of travel, the "unlocked" side, by a biasing member such as spring 446. Since the annunciator assemblies for both doors are side by side, a single spring 446 is used to bias both adjacent members as shown in FIG. 10*c*. Second end 442 has an output transmission fitting 448, which may be a pin or a slot, or other suitable fitting. Given that pin 426 moves at a much smaller radial distance from the center of the torque tube than output fitting 448, the displacement at fitting 448 will be amplified by the ratio of the two respective radii.

A fulcrum plate 450 is mounted between the legs of the U-shaped bracket of retainer 444. Fulcrum plate 450 includes a fulcrum pin 452 on which second lever 434 is pivotally mounted. The input fitting of second lever 434, shown in the example to be a pin 454, is at a much shorter radius from fulcrum pin 452 than is output pin 456 at the opposite end of second lever 434. Thus, again, the input motion at fitting 454 will be amplified by the ratio of the lengths of the lever arms. The resultant overall amplification is obtained by multiplying the two amplification ratios together. The output displacement at output pin 456 is then carried into the input fitting of crank arm 460 which itself turns the output shaft to which the Locked-Unlocked indicator flag or flap 462 is attached. In operation, rotation of torque shaft 388 eventually causes pin 426 to engage arm 438, the torque in the shaft being very large compared to the counter-acting return biasing force provided by spring 446.

The car may also have manually operated mechanisms for releasing and then re-closing the doors. For closing the doors, the ends of each torque tube have a special fitting 464 that can be pried with a bar to rotate the torque tube in the closing direction. The fitting is a commonly used fitting known in the industry which allows the bar to release if the load comes off the fitting. It can be cranked with a bar in either direction. For opening the doors it is necessary to release the over-center lock. For that purpose car 220 may have a pry rod seat 466 welded to the underside of the overcenter stop plate 404. This seat may be an half round cut from pipe. In line with this seat in the transverse direction there is a fitting in the nature of a bracket 470 having a pair of legs depending from the outboard margin of the center sill flange, and a back member 472 welded cross-wise between the ends of the legs. Back member 472 has a radiused, upwardly facing crown. It may be made from a section of cut pipe. When manual release of the overcenter lock is desired, an operator at track level may introduce the end of a long rod between the legs of release bracket 470, to end in the accommodation of seat 466. As the operator bears down on the outer end of the bar, the crowned upward face of back member 472 acts as a fulcrum, and the short end of the bar works to lift the over-centered members. As this motion progresses, the locus of contact between the pry bar and the crown progresses transversely outward and away from the centersill, reducing the mechanical advantage on the lever as it does so, and thereby somewhat reducing the speed at which load comes off the pry bar as the operator pushes down.

The general idea of having an abnormally large door area may be to permit rapid discharge of lading. However, it may be that under certain circumstances it may be desirable for the lading to discharge more slowly. For example, it may be desired to release lading somewhat more slowly, perhaps as the car is rolling, and using the edge of the door to plow or otherwise encourage spreading of the material.

Figure 8D:
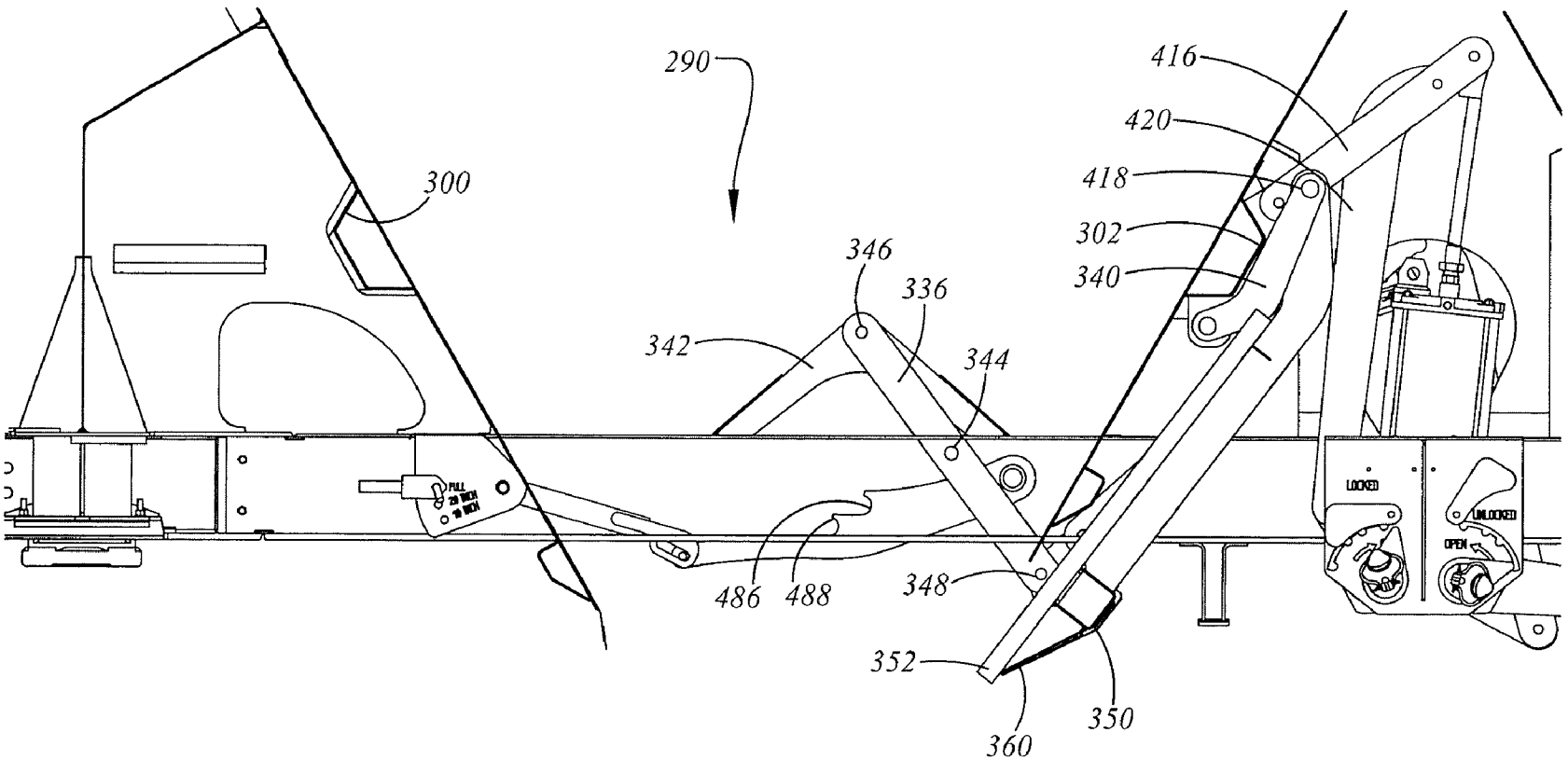
FIG. 8*d* shows the enlarged sectional detail of FIG. 8*a* in a 100% open position or condition.
Figure 12B:
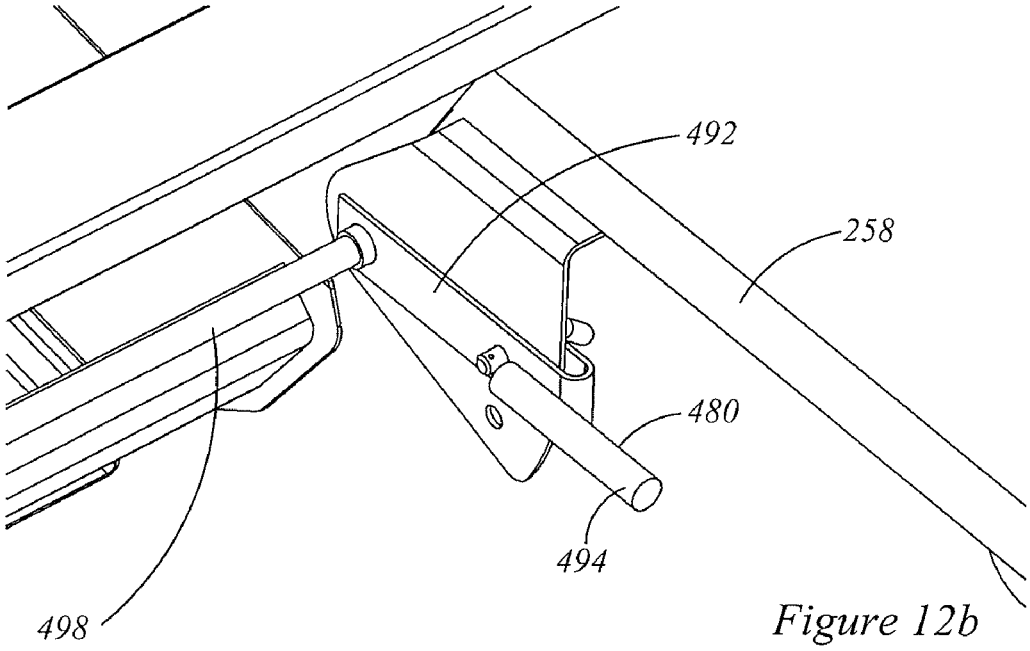
FIG. 12*b* shows a view from inboard of the side sill of the door stroke limiting apparatus of FIG. 12*a*.
Figure 12A:
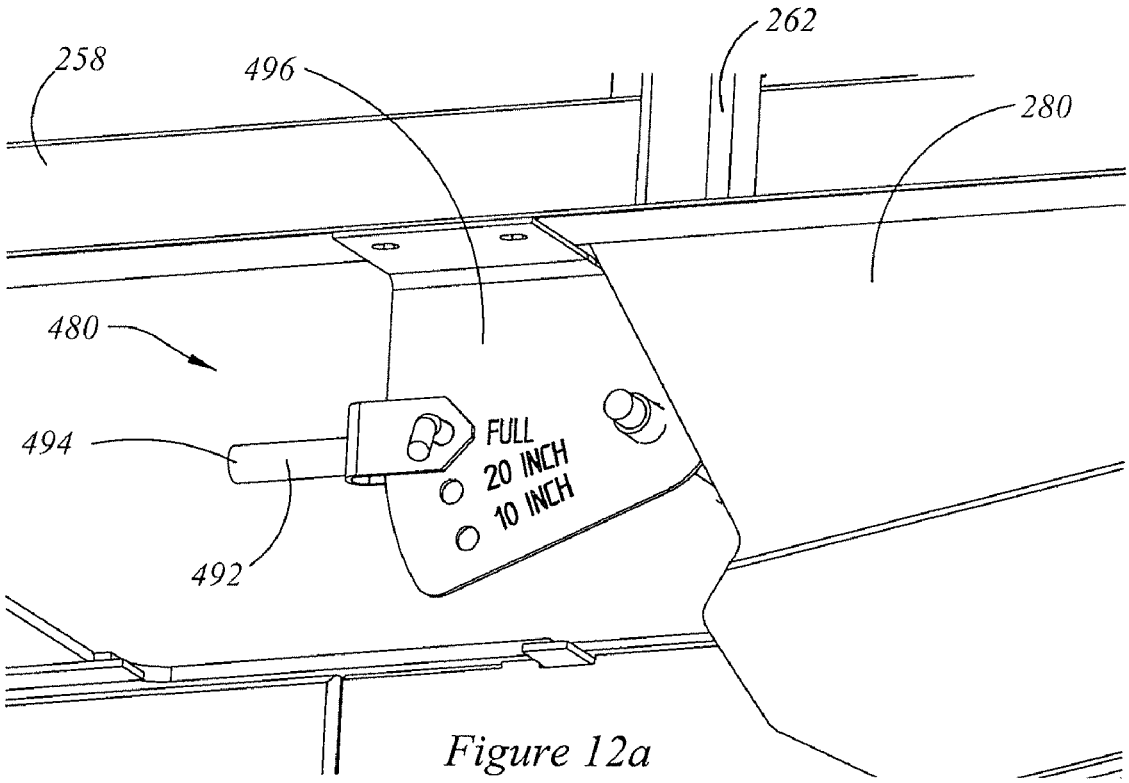
FIG. 12*a* shows a view from outside the side sill of the railroad car of FIG. 7*a* of a door stroke limiting apparatus adjustment mechanism.

To that end, car 220 may include a door opening adjustment assembly 480 operable to govern the limit of travel of the door assembly toward the open position. In one embodiment assembly 480 may include a first member 482, and a second member 484. First member 482 may have the form of a bar with one or more stops, or indexing fittings or features 486, 488. First member 482 may have a bend of dog-leg. One end of first member 482 may be pivotally mounted within the center sill, as indicated in FIG. 8*d*. The other end has a fitting 490 for engaging second member 484. Second member 484 may be an adjustment actuator assembly 492, such as may include an input, which may be in the form of an handle 494 mounted to the side sill, a display member 496 to which the handle is movably mounted, the display member having a face plate with indicator settings (e.g., "Full", ½, ¼) corresponding to the various indexing stops 486, 488 to allow the door to be fully open, half open or ¼ open. The indicator may also have a lock, whether in terms of a pin and cotter pin as shown in FIG. 12*a*, or some other arrangement. Handle 494 includes a pointer for alignment with the chosen slots, or detents, as may be. Handle 494 is rigidly connected to a transmission member, in this case a shaft or torque tube 498. The other, transversely inboard end of torque tube 498 is rigidly connected to an output arm 500 whose radially distant extremity has a fitting 502 for engaging fitting 490. In this instance fitting 490 may be a pin, and fitting 502 may be a slot. Each angularly unique setting of handle 494 corresponds to an angular output of output arm 500, which moves first member 482 to a unique angular position. In the full position stop member 344 of first pivot arm 334 can swing clear of first member 332. In the "half" position of first member 482, indexing stop 486 arrests, and thereby limits the range of motion of, stop member 344, and therefore of the door assembly, be it first door set 222 or second door set 224, to a portion of travel, which may in some nominal sense be "half" of the normal range, and which is less than the full range of travel. Similarly, in the "one quarter" position of first member 432, indexing stop 438 arrests the motion of member 344 and limits motion to the ¼ range. In contrast to previous door travel limiting mechanisms for hopper cars of the nature, this assembly does not require that personnel climb into the hoppers, e.g., for the purpose of adjusting door chains, and does not rely on chains or such other loose objects.

Under the AAR rules governing the industry, the maximum permissible width of railroad cars in interchange service in North America is 128 inches, provided that the truck centers are no further apart than 46'-3". Given that the width is fixed, one measure of the efficacy of having a large door operated by a four bar linkage is that for a car of any particular height, the height of the upper edge of the door opening is as low as possible relative to Top of Rail, and relative to the overall car height, and that the vertically projected component of door length be large both in proportion to overall hopper wall height and in proportion to the height of the upper edge of the door opening.

That is, in a conventional car with a piano hinge along the upper edge of the door, the vertical projection of the length of the door can never be longer than the distance from TOR to the hinge. With a conventional hinged door, if the upper edge is at a level near or slightly below the height of the side sill, and the height of the side sill is roughly comparable to the coupler centerline height, namely 34½" from Top of Rail for a new car with new wheels, then the vertically projected horizontal door length cannot be more then 34½ inches, whatever the angle of the door opening may be. With a door such as door 238 or 244, the vertically projected length of the door opening can be much larger in proportion to either the overall sidewall height or the height of the upper edge of the door opening, as may be. For example, in car 220, the upper edge height may be about 40 inches above TOR. The nominal door opening length may be about 55-60 inches (in one embodiment 55½"). The angle of inclination of the side edges of the opening is about 10 degrees. Cos(10 degrees) is about 0.98, such that the nominal length and the projected length are only slightly different, and may be taken as 55-60 inches. This gives a ratio of $H_{edge}$: Projected Door Opening Length of greater than 1, and, in one embodiment, somewhere in the range of about 1.25 to 1.5. In some embodiments it may also give a ratio of vertically projected door opening length to hopper height, as measured from TOR, of less than 4:1, and in one embodiment about 3:1. These ratios are not arbitrary arithmetical values, but rather an attempt quantitatively to capture the qualitative concepts of low door opening height (associated with increased lading volume and lower center of gravity), and large projected door area (associated with rapid lading discharge, and, if the door is low, with greater longitudinal slope sheet spacing and therefore greater hopper volume at a lower height).

Various embodiments have been described in detail. Since changes in and or additions to the above-described examples may be made without departing from the nature, spirit or scope of the invention, the invention is not to be limited to those details.

We claim:

1. A railroad hopper car comprising:

a body for carrying lading in the form of particulate matter, said body being mounted upon railroad car trucks for rolling motion along railroad tracks in a longitudinal direction, and having draft sills at either end thereof to permit said railroad hopper car to be connected to other railroad car bodies;

said body including a hopper having a discharge through which the lading may be disgorged under the influence of gravity;

said discharge being governed by a door mechanism, said door mechanism including a door panel movable from a first position to a second position, said first position defining a closed position of said discharge in which said door panel obstructs exit of the lading, said second position defining an open position of said discharge;

said door panel is movably connected to said car body by at least a first linkage member and a second linkage member, said first linkage member being pivotally connected to said body and pivotally connected to said door panel;

said second linkage member being pivotally connected to said body and to said door panel; and said car body, said linkage members and said door panel defining a four bar linkage, said door panel has a proximal portion and a distal portion, said first linkage member is pivotally connected to said door panel at a connection that is closer to said proximal portion than to said distal portion, said second linkage member is connected to said door panel closer to said distal portion than is said first linkage member, and one of (a) said first linkage member is connected to said body of said railroad hopper car at a first pivotal connection, and said proximal portion of said door panel moves from a position lower than said first pivotal connection to a position higher than said first pivotal connection during motion of said door panel from said closed position to said open position; and (b) said proximal portion of said door panel has an overall dz/dx when said door panel moves between said first position and said second position that is greater than one.

2. The railroad hopper car of claim 1 wherein said railroad hopper car has a center sill, said center sill including one of (a)

a stub sill and (b) a straight through center sill and said door mechanism includes a longitudinally acting drive shaft sheltered by said center sill.

3. The railroad hopper car of claim 1 wherein said door panel extends cross-wise relative to said car body, said door mechanism is a transverse door, and said first linkage member and said second linkage member swing in the longitudinal direction.

4. The railroad hopper car of claim 1 wherein said door panel extends cross-wise relative to said car body, and said railroad hopper car includes a longitudinally acting drive mechanism connected to move said door panel between said open position and said closed position.

5. The railroad hopper car of claim 4 wherein said drive mechanism includes members acting in both longitudinally forward and longitudinally rearward directions.

6. The railroad hopper car of claim 5 wherein said drive mechanism includes a bell crank having a range of travel of greater than 90 degrees as said door mechanism moves between said open position and said closed position.

7. The railroad hopper car of claim 6 wherein said door panel is a first door panel, said railroad hopper car has a second door panel, and said door mechanism said bell crank drives said first door panel and said second door panel in opposite directions.

8. The railroad hopper car of claim 7, said railroad car being an hopper car, wherein said railroad hopper car has a straight-through center sill, said drive mechanism includes a longitudinally acting drive shaft, and said longitudinally acting drive shaft is connected to said bell crank by a drag link.

9. The railroad hopper car of claim 1 wherein said first linkage member is shorter than said second linkage member.

10. A railroad hopper car comprising:

a body for carrying lading in the form of particulate matter, said body being mounted upon railroad car trucks for rolling motion along railroad tracks in a longitudinal direction, and having draft sills at either end thereof to permit said railroad hopper car to be connected to other railroad car bodies;

said body including a hopper having a discharge through which the lading may be disgorged under the influence of gravity;

said discharge being governed by a door mechanism, said door mechanism including a door panel movable from a first position to a second position, said first position defining a closed position of said discharge in which said door panel obstructs exit of the lading, said second position defining an open position of said discharge;

said door panel is movably connected to said car body by at least a first linkage member and a second linkage member, said first linkage member being pivotally connected to said body and pivotally connected to said door panel;

said second linkage member being pivotally connected to said body and to said door panel; and said car body, said linkage members and said door panel defining a four bar linkage;

said first linkage member is shorter than said second linkage member; and said railroad hopper car has a center sill having spaced apart center sill webs, and said second linkage member is mounted to swing between said center sill webs in the longitudinal direction.

11. The railroad hopper car of claim 9 wherein:

said railroad hopper car body has a cross-member extending cross-wise to the longitudinal direction;

said door panel is a transverse door panel;

said first and second linkage members are mounted to swing in the longitudinal direction;

and said first linkage member is sheltered by said cross-member.

12. The railroad hopper car of claim 11 wherein said railroad hopper car has a center sill having spaced apart center sill webs, and said second linkage member is mounted to swing between said center sill webs in the longitudinal direction.

13. The railroad hopper car of claim 1 wherein said door panel moves through a non-circular arc during motion from said first position to said second position.

14. The railroad hopper car of claim 1 wherein said first linkage member pivots in a first plane, said second linkage member pivots in a second plane, and said first linkage member pivots in a different plane from said second linkage member.

15. The railroad hopper car of claim 14 wherein said railroad hopper car has a center sill, said second linkage member pivots in a vertical plane that intersects the center sill, and said first linkage member pivots in a plane that is offset cross-wise away from said center sill.

16. The railroad hopper car of claim 1 wherein said first and second linkage members travel through arcs of travel of different angular magnitudes when said door panel moves between said first position and said second position.

17. The railroad hopper car of claim 1 wherein said discharge has an horizontal length when seen in a vertical projection on to an horizontal plane, said discharge has a peripheral edge for engagement by said door panel, said peripheral edge has a clearance distance from Top of Rail when said car is on level tangent track, and said horizontal length is greater than three times said clearance distance.

18. The railroad hopper car of claim 17 wherein any one of:

(a) said distal portion of said door panel has an overall dz/dx when said door panel moves between said first position and said second position that is less than one; and (b) said distal portion of said door panel has an overall (dz/dx) when said door panel moves between said first position and said second position; and said (dz/dx) of said proximal portion of said door panel is greater than said (dz/dx) of said distal portion of said door panel.

19. The railroad hopper car of claim 17 wherein said first linkage member is mounted to said railroad hopper car at a first pivot fulcrum located a first distance above Top of Rail; said door panel has a width and a length, said width being oriented cross-wise relative the direction of opening of said door panel, and said length being greater than said first distance.

20. The railroad hopper car of claim 1 wherein said first linkage member is mounted to said railroad hopper car at a first pivot fulcrum located a first distance above Top of Rail; said door panel has a width and a length, said width being oriented cross-wise relative the direction of opening of said door panel, and said length being greater than said first distance.

21. A railroad hopper car having at a lading containment car body comprising:

a pair of first and second hopper discharges and respective first and second transverse doors operable to facilitate egress of lading from said hopper discharges;

said first and second hopper discharges having a discharge flow dividing member located therebetween, said discharge flow dividing member having first and second flanks extending downwardly therefrom toward said first and second discharges respectively, a sheltered accommodation being defined between said flanks;

each of said doors being movable from a closed position obstructing egress of lading from said respective hopper discharges to a second position less obstructive of discharge of lading from said respective hopper discharges;

in said second position each of said doors being more predominantly vertical than horizontal;

each of said transverse doors having a proximal region and a distal region, said proximal region being closer to said flow dividing member than is said distal region when said doors are in their respective closed positions;

each of said transverse doors being connected by first and second linkages to said car body;

said first and second linkages having pivoting connections at either end thereof;

said first linkages being connected to said transverse doors nearer to said proximal regions of said doors than are said respective second linkages; and in opening operation, said proximal regions of said first and second doors moving upwardly and inwardly into said accommodation defined between said flanks of said flow dividing member.

22. The railroad hopper car of claim 21 wherein said flow dividing member is a cross-bearer.

23. The railroad hopper car of claim 21 wherein said railroad hopper car includes a longitudinally extending straight-through center sill, and each said second linkage has one end pivotally mounted to its respective door, and a second end pivotally mounted within said center sill.

24. The railroad hopper car of claim 21 wherein each of said first and second transverse doors is mounted to respective ones of said first and second linkages, each said door, its associated linkages and said car body defining a four bar linkage.

25. The railroad hopper car of claim 21 wherein each of said first and second doors is mounted on respective ones of said first and second linkages such that each said door is an hingeless door, said second position is an open position, each said door includes a respective door panel, said respective door panels each being mounted to move on a non-circular path during motion between said closed position and said open position.

26. The railroad hopper car of claim 21 wherein each said door has a fully open position, and in moving between said closed position and said fully open position said first linkages pivot through an angle of at least 120 degrees.

27. The railroad hopper car of claim 21 wherein said railroad hopper car has at least one actuator mounted to drive said doors, and said at least one actuator is also sheltered from lading by said accommodation.

28. The railroad hopper car of claim 21 wherein said flanks project toward an apex of said flow divider, and when said doors are in said second position said proximal region is adjacent said apex.

29. A railroad hopper car having at a lading containment car body comprising:

a pair of first and second hopper discharges and respective first and second transverse doors operable to facilitate egress of lading from said hopper discharges;

said first and second hopper discharges having a discharge flow dividing member located therebetween, said discharge flow dividing member having first and second flanks extending downwardly therefrom toward said first and second discharges respectively, a sheltered accommodation being defined between said flanks;

each of said doors being movable from a closed position obstructing egress of lading from said respective hopper discharges to a second position less obstructive of discharge of lading from said respective hopper discharges;

each of said transverse doors having a proximal region and a distal region, said proximal region being closer to said flow dividing member than is said distal region when said doors are in their respective closed positions;

each of said proximal regions being connected by first and second linkages to said car body;

said first and second linkages having pivoting connections at either end thereof; and in opening operation, said proximal regions of said first and second doors moving upwardly and inwardly into said accommodation defined between said flanks of said flow dividing member;

said first discharge has an horizontal length when seen in a vertical projection on to an horizontal plane, said first discharge has a peripheral edge for engagement by said doors, said peripheral edge has a clearance distance from Top of Rail when said car is on level tangent track, and said length is greater than three times said clearance distance.

30. A railroad hopper car having at a lading containment car body comprising:

a pair of first and second hopper discharges and respective first and second transverse doors operable to facilitate egress of lading from said hopper discharges;

said first and second hopper discharges having a discharge flow dividing member located therebetween, said discharge flow dividing member having first and second flanks extending downwardly therefrom toward said first and second discharges respectively, a sheltered accommodation being defined between said flanks;

each of said doors being movable from a closed position obstructing egress of lading from said respective hopper discharges to a second position less obstructive of discharge of lading from said respective hopper discharges;

each of said transverse doors having a proximal region and a distal region, said proximal region being closer to said flow dividing member than is said distal region when said doors are in their respective closed positions;

each of said proximal regions being connected by first and second linkages to said car body;

said first and second linkages having pivoting connections at either end thereof; and in opening operation, said proximal regions of said first and second doors moving upwardly and inwardly into said accommodation defined between said flanks of said flow dividing member;

in said closed position of each said door said door is in a predominantly horizontal orientation, said second position is an open position, and in said open position each said door is in a less predominantly horizontal predominately vertical orientation than in said closed position; and said open position is a fully open position, and in said fully open position each said door is predominantly vertically oriented.

* * * * *

UNITED STATES PATENT AND TRADEMARK OFFICE

CERTIFICATE OF CORRECTION

PATENT NO. : 8,356,560 B2
APPLICATION NO. : 12/694896
DATED : January 22, 2013
INVENTOR(S) : James W. Forbes and Tomasz Bis It is certified that error appears in the above-identified patent and that said Letters Patent is hereby corrected as shown below:

Claim 30; Column 28; Lines 56 and 57: delete "predominately vertical" and insert --and more predominately vertical--.

Signed and Sealed this
Twenty-sixth Day of March, 2013

Teresa Stanek Rea
*Acting Director of the United States Patent and Trademark Office*